US010865592B2

(12) United States Patent
Liang et al.

(10) Patent No.: US 10,865,592 B2
(45) Date of Patent: Dec. 15, 2020

(54) SASH LOCK AND TILT LATCH ALSO FUNCTIONING AS A WINDOW VENT STOP, WITH AUTOMATIC LOCKING UPON CLOSURE

(71) Applicant: Vision Industries Group, Inc., So. Plainfield, NJ (US)

(72) Inventors: Luke Liang, So. Plainfield, NJ (US); David Chen, Guang Zhou (CN); Glen Paesano, Pt. Pleasant Beach, NJ (US)

(73) Assignee: VISION INDUSTRIES GROUP, INC., Secaucus, NJ (US)

( * ) Notice: Subject to any disclaimer, the term of this patent is extended or adjusted under 35 U.S.C. 154(b) by 870 days.

(21) Appl. No.: 15/397,968

(22) Filed: Jan. 4, 2017

(65) Prior Publication Data

US 2017/0152688 A1 Jun. 1, 2017

Related U.S. Application Data

(60) Continuation-in-part of application No. 14/881,312, filed on Oct. 13, 2015, which is a division of
(Continued)

(51) Int. Cl.
*E05B 19/02* (2006.01)
*E05B 65/08* (2006.01)
(Continued)

(52) U.S. Cl.
CPC ..... *E05C 9/02* (2013.01); *E05B 9/08* (2013.01); *E05B 65/08* (2013.01);
(Continued)

(58) Field of Classification Search
CPC .... Y10S 292/04; Y10S 292/20; Y10S 292/47; E05C 2007/007
(Continued)

(56) References Cited

U.S. PATENT DOCUMENTS 36,524 A 9/1862 Minor
51,222 A 11/1865 Ridell
(Continued)

FOREIGN PATENT DOCUMENTS

GB 2 256 627 8/1995
GB 2 461 079 12/2009
(Continued)

*Primary Examiner* — Carlos Lugo
(74) *Attorney, Agent, or Firm* — Thomas A. O'Rourke; Booner & O'Rourke, LLP

(57) ABSTRACT

A sash window fastener includes: a latch assembly; a sash lock assembly mounted upon the meeting rail; and a stop member mounted to the master window frame. The lock assembly includes a pivotable cam to engage a keeper on the master frame to lock the window, and a pivotable follower arm. The arm interconnects with the latch assembly within the meeting rail, so cam rotation that drives arm rotation also causes translation of the latch. The cam may occupy: an extended position to secure the cam to the keeper, with the latch engaging the master frame to prevent tilting, and being positioned below a protrusion on the stop member to redundantly lock the window; a first retracted cam position permitting sliding of the window; and a second retracted position permitting tilting of the sash window. Additional protrusions may be used on the stop member to serve as vent stop positions.

3 Claims, 63 Drawing Sheets

Related U.S. Application Data application No. 14/879,436, filed on Oct. 9, 2015, now Pat. No. 10,704,297, and a continuation-in-part of application No. 14/879,164, filed on Oct. 9, 2015, now Pat. No. 10,570,652, said application No. 14/879,436 is a continuation-in-part of application No. 14/566,908, filed on Dec. 11, 2014, now abandoned, said application No. 14/879,164 is a continuation-in-part of application No. 14/566,908, filed on Dec. 11, 2014, now abandoned, which is a continuation-in-part of application No. 14/278,226, filed on May 15, 2014, now Pat. No. 10,323,446, which is a continuation-in-part of application No. 14/198,986, filed on Mar. 6, 2014, now Pat. No. 10,119,310.

(60) Provisional application No. 62/425,196, filed on Nov. 22, 2016.

(51) Int. Cl.

| | |
|---|---|
| ***E05C 9/02*** | (2006.01) |
| ***E06B 3/50*** | (2006.01) |
| ***E05C 3/16*** | (2006.01) |
| ***E05C 1/06*** | (2006.01) |
| ***E05C 1/12*** | (2006.01) |
| ***E06B 7/03*** | (2006.01) |
| ***E05B 9/08*** | (2006.01) |
| ***E05C 3/04*** | (2006.01) |
| ***E05C 17/02*** | (2006.01) |
| *E05C 9/20* | (2006.01) |
| *E05C 7/00* | (2006.01) |

(52) U.S. Cl.

CPC ..... *E05B 65/0841* (2013.01); *E05C 1/06* (2013.01); *E05C 1/12* (2013.01); *E05C 3/045* (2013.01); *E05C 3/16* (2013.01); *E05C 9/025* (2013.01); *E05C 17/02* (2013.01); *E06B 3/5063* (2013.01); *E06B 7/03* (2013.01); *E05C 9/20* (2013.01); *E05C 2007/007* (2013.01); *Y10S 292/20* (2013.01); *Y10S 292/47* (2013.01); *Y10T 292/0977* (2015.04)

(58) Field of Classification Search

USPC ..... 49/449, 451

See application file for complete search history.

(56) References Cited

U.S. PATENT DOCUMENTS 108,778 A 11/1870 Gorman
115,781 A 6/1871 Steele
126,872 A 5/1872 Buckman
148,857 A 3/1874 Smith
166,842 A 8/1875 Berryman
178,360 A 6/1876 Cooper
192,614 A 7/1877 Andrews
192,919 A 7/1877 Hoyt
201,146 A 3/1878 Adler
215,125 A 5/1879 Hunter
226,033 A 3/1880 Burns
230,476 A 7/1880 Green
234,387 A 11/1880 Burgess
284,993 A 9/1883 Abele
314,350 A 3/1885 Smith
316,285 A 4/1885 McKeen
331,005 A 11/1885 Sahr
336,302 A 2/1886 Dudgeon
346,788 A 8/1886 Teufel
350,678 A 10/1886 Hussey
353,287 A 11/1886 Chumard
369,885 A 9/1887 Shaw
375,656 A 12/1887 Shaw
376,252 A 1/1888 McIntyre
379,910 A 3/1888 Rosentreter
410,728 A 9/1889 Brown
417,868 A 12/1889 Janes
423,761 A 3/1890 Hasenplug
452,723 A 5/1891 Schmalhausen
480,148 A 8/1892 Theby
493,159 A 3/1893 Gibson
509,941 A 12/1893 Perry
512,593 A 1/1894 Webster
520,754 A 5/1894 Burmeister
526,118 A 9/1894 Sharp
528,656 A 11/1894 Burmeister
530,078 A 12/1894 Ammerman
532,935 A * 1/1895 Woolery ..... E06B 3/44 49/417
534,185 A 2/1895 Winchester
537,258 A 4/1895 Wilcox
539,030 A 5/1895 Bitner
551,181 A 12/1895 Dillon
551,242 A 12/1895 Wallace
564,426 A 7/1896 Hubbard
554,448 A 12/1896 Kail
587,424 A 8/1897 Bonine
590,225 A 9/1897 Hill
653,458 A 7/1900 Paguetta
683,928 A 10/1901 Geraghty
688,491 A 12/1901 Sigler
695,736 A 3/1902 Kendrick
699,696 A 5/1902 Mellen
708,406 A 9/1902 Robison
714,343 A 11/1902 Wellman
718,007 A 1/1903 Linn
719,981 A 2/1903 Adams
722,162 A 3/1903 St. Louis
724,466 A 4/1903 Hannan
743,716 A 11/1903 Hadka
744,755 A 11/1903 Hasenplug
745,888 A 12/1903 McEiwee
756,453 A 4/1904 Arens
756,559 A 4/1904 Arens
757,249 A 4/1904 Barnard
759,642 A 5/1904 Sparks
764,493 A 7/1904 Noseworthy
769,386 A 9/1904 Johnson
769,767 A 9/1904 Phelps
774,536 A 11/1904 Saunders
775,602 A 11/1904 Heamshaw
800,043 A 9/1905 Witte
804,994 A 11/1905 Andrews
815,537 A 3/1906 Kissinger
833,900 A 10/1906 Sigier
836,313 A * 11/1906 Fox ..... E05B 63/044 292/244
837,811 A 12/1906 Ebbeson
840,427 A 1/1907 Brister
865,090 A 9/1907 Eddy
866,073 A 9/1907 Saunders
878,206 A 2/1908 Johnson
878,781 A * 2/1908 De La Matyr ..... E05F 11/00 292/238
881,658 A 3/1908 Bowman
886,108 A 4/1908 Allen
887,690 A 5/1908 Pearce
922,894 A 5/1908 Heid
897,719 A 9/1908 Daubaignan
900,079 A 10/1908 Bittorf
910,850 A 1/1909 Petrie
926,899 A 7/1909 Roy
928,408 A 7/1909 Taube
948,628 A 2/1910 Jefferis
959,150 A 5/1910 Morris
966,063 A 8/1910 Toothaker
976,777 A 11/1910 Brown
980,131 A 12/1910 Shean
998,642 A 7/1911 Shean
1,003,386 A 9/1911 Welker
1,006,211 A 10/1911 Hermon
1,020,454 A 3/1912 Seidenbecker

(56) References Cited

U.S. PATENT DOCUMENTS 1,041,803 A 10/1912 Kilbum
1,051,913 A 2/1913 Rowley
1,059,999 A 4/1913 James
1,069,079 A 7/1913 Voght
1,077,487 A 11/1913 Miller
1,080,172 A 12/1913 Rusk
1,100,820 A 6/1914 Edwards
1,102,531 A * 7/1914 Mason ..... E06B 3/44 49/421
1,121,228 A 12/1914 Burkhart
1,122,026 A 12/1914 O'Rourke
1,127,835 A 2/1915 Westlund
1,133,217 A 3/1915 Barton
1,141,437 A 6/1915 Unterlender
1,148,712 A 8/1915 Overland
1,163,086 A 12/1915 Harper
1,173,129 A 2/1916 Taliafarro
1,177,637 A 4/1916 Lane
1,177,838 A 4/1916 Wilkinson
1,207,989 A 12/1916 O'Rourke
1,232,683 A 7/1917 Hollis
1,243,115 A 10/1917 Shur
1,247,182 A 11/1917 Tuekmantel
1,253,810 A 1/1918 Giannincio
1,261,274 A 4/1918 Newsam
1,269,467 A 6/1918 Winters
1,270,740 A 6/1918 Keyes
1,272,900 A 7/1918 Berman
1,279,353 A 9/1918 Kelley
1,311,052 A 7/1919 Danforth
1,322,677 A 11/1919 Ditlefaan
1,338,250 A 4/1920 Parkes
1,338,416 A 4/1920 Bellinger
1,339,362 A 5/1920 L'Heuraux
1,341,234 A 5/1920 Horton
1,350,698 A 8/1920 Boedtcher
1,387,302 A 8/1921 Page
1,388,272 A 8/1921 Lawrence
1,393,628 A 10/1921 Leichter
1,398,174 A 11/1921 Carson
1,399,897 A 12/1921 Singer
1,412,154 A 4/1922 Wollesen
1,439,585 A 12/1922 Trost
1,461,467 A 7/1923 Stuart
1,463,866 A 8/1923 Bourbeau
1,485,382 A 3/1924 Foley
1,490,874 A 4/1924 Webb
1,516,995 A 11/1924 Trigueiro
1,550,532 A 8/1925 French
1,552,690 A 9/1925 Frantz
1,587,037 A 6/1926 Rudolph
1,601,051 A 9/1926 Wiltert
1,605,717 A 11/1926 Gregg
1,619,031 A 3/1927 Ostrovsky
1,622,742 A 3/1927 Shipman
1,658,818 A 1/1928 Dillon
1,692,579 A 11/1928 Schrader
1,704,946 A 3/1929 Lindgren
1,712,792 A 5/1929 Hansen
1,715,957 A 6/1929 Stein
1,724,637 A 8/1929 Bergstrom
1,750,715 A 3/1930 Jeffers
1,794,171 A 2/1931 Grutel
1,812,288 A 6/1931 Drapeau
1,819,824 A 8/1931 McAllister
1,864,253 A 6/1932 McIntyre
1,869,274 A 7/1932 Phillips
1,891,940 A 12/1932 McAllister
1,900,936 A 3/1933 Huttger
1,901,974 A 3/1933 Macy
1,922,062 A 8/1933 Sullivan
1,960,034 A 5/1934 Stewart
1,964,114 A 6/1934 Gerach
2,095,057 A 10/1937 Corrado
2,122,661 A 7/1938 Rightmyer
2,126,996 A 8/1938 Kingdon
2,136,408 A 11/1938 Bedell
2,158,260 A 5/1939 Stillman
2,202,561 A 5/1940 Lahiere
2,272,145 A 2/1942 Anderson
2,326,084 A 8/1943 Westrooe
2,369,584 A 2/1945 Lundholm
2,452,521 A 10/1948 Johnson
2,480,016 A 8/1949 Granberg
2,480,988 A 9/1949 Walton
2,500,349 A 3/1950 Menns
2,503,370 A 4/1950 Zanona
2,523,559 A 9/1950 Couture
2,527,278 A 10/1950 Schemansky
2,537,736 A 1/1951 Carlson
2,560,274 A 7/1951 Cantelo
2,590,624 A 3/1952 James
2,599,196 A 6/1952 Peremi
2,605,125 A 7/1952 Emerson
2,612,398 A 9/1952 Miller
2,613,526 A 10/1952 Holmsten
2,621,951 A 12/1952 Ostacsl
2,645,515 A 7/1953 Thomas
2,648,967 A 8/1953 Holmsten
2,657,086 A * 10/1953 Sweet ..... E05D 13/06 292/175
2,670,982 A 3/1954 Banham
2,692,789 A 10/1954 Pivard
2,758,862 A 8/1956 Encler
2,766,492 A 10/1956 Day
2,789,851 A 4/1957 Lickteig
2,818,919 A 1/1958 Sylvan
2,846,258 A 8/1958 Granberg
2,855,772 A 10/1958 Hollgren
2,884,276 A 4/1959 Baptist
2,941,832 A 6/1960 Grossman
2,967,595 A * 1/1961 Zitomer ..... E06B 3/44 49/450
3,027,188 A 3/1962 Eichstadt
3,129,470 A * 4/1964 Schneider ..... E05D 13/06 49/450
3,135,542 A 6/1964 Wilkenson
3,187,526 A 6/1965 Moler
3,267,713 A 8/1966 McQuiston
3,288,510 A 11/1966 Gough
3,352,586 A 11/1967 Hakanson
3,362,740 A 1/1968 Burns
3,422,575 A 1/1969 Armstrong
3,438,153 A 4/1969 Lemme
3,599,452 A 8/1971 Maruyama
3,600,019 A 8/1971 Toyota
3,642,315 A 2/1972 Alpern
3,645,573 A 2/1972 Strang
3,683,652 A 8/1972 Halopoff
3,706,467 A 12/1972 Martin
3,762,750 A 10/1973 Orr
3,811,718 A 5/1974 Bates
3,907,348 A 9/1975 Bates
3,919,808 A 11/1975 Simmons
3,927,906 A 12/1975 Mieras
4,054,308 A 10/1977 Prohaska
4,059,298 A 11/1977 van Klompenburg
4,063,766 A 12/1977 Granberg
4,068,871 A 1/1978 Mercer
4,095,827 A 6/1978 Stavenau
4,095,829 A 6/1978 Van Klompenburg
4,102,546 A 7/1978 Costello
4,151,682 A 5/1979 Schmidt
4,165,894 A 8/1979 Wojciechowski
4,223,930 A 9/1980 Costello
4,227,345 A 10/1980 Durham
4,235,465 A 11/1980 Costello
4,253,688 A 3/1981 Hosooka
4,261,602 A 4/1981 Anderson
4,274,666 A 6/1981 Peck
4,293,154 A 10/1981 Cassells
4,303,264 A 12/1981 Uehara
4,305,612 A 12/1981 Hunt
4,392,329 A 7/1983 Suzuki

(56) References Cited

U.S. PATENT DOCUMENTS 4,429,910 A 2/1984 Anderson
4,470,277 A 9/1984 Uyeda
4,475,311 A 10/1984 Gibson
4,525,952 A 7/1985 Cunningham
4,580,366 A 4/1986 Hardy
4,587,759 A 5/1986 Gray
4,621,847 A 11/1986 Paulson
4,624,073 A 11/1986 Randall
4,639,021 A 1/1987 Hope
4,643,005 A 2/1987 Logas
4,736,972 A 4/1988 Mosch
4,801,164 A 1/1989 Mosch
4,813,725 A 3/1989 Mosch
4,824,154 A 4/1989 Simpson
4,827,685 A 5/1989 Schmidt
4,893,849 A 1/1990 Schlack
4,922,658 A 5/1990 Coddens
4,949,506 A 8/1990 Durham
4,961,286 A 10/1990 Bezubic
4,991,886 A 2/1991 Nolte
5,042,855 A 8/1991 Bennett
5,072,464 A 12/1991 Draheim
5,076,015 A 12/1991 Manzalini
5,087,087 A 2/1992 Vetter
5,087,088 A 2/1992 Milam
5,090,750 A 2/1992 Lindqvist
5,090,754 A 2/1992 Thompson
5,110,165 A 5/1992 Piltingsrud
5,127,685 A 7/1992 Dallaire
5,139,291 A 8/1992 Schultz
5,143,412 A 9/1992 Lindqvist
5,161,839 A 11/1992 Piltingsrud
5,165,737 A 11/1992 Riegelman
5,183,310 A 2/1993 Shaughnessy
5,219,193 A 6/1993 Piltingsrud
5,244,238 A 9/1993 Lindqvist
5,248,174 A 9/1993 Matz
5,274,955 A 1/1994 Dallaire
5,341,752 A 8/1994 Hambleton
5,398,447 A 3/1995 Morse
5,437,484 A 8/1995 Yamada
5,448,857 A 9/1995 Stormo
5,452,925 A 9/1995 Huang
5,454,609 A 10/1995 Slocomb
5,516,160 A * 5/1996 Kajuch ..... E05B 53/00 292/1.5
5,560,149 A 10/1996 Lafevre
5,582,445 A 12/1996 Olsen
RE35,463 E 2/1997 Vetter
5,636,475 A 6/1997 Nidelkoff
5,688,000 A 11/1997 Dolman
5,715,631 A 2/1998 Kailian
5,741,032 A 4/1998 Chaput
5,778,602 A 7/1998 Johnson
5,791,700 A 8/1998 Biro
5,839,767 A 11/1998 Piltingsrud
5,901,499 A 5/1999 Delaske
5,901,501 A 5/1999 Fountaine
5,911,763 A 6/1999 Quesada
5,927,768 A 7/1999 Dallmann
5,970,656 A 10/1999 Maier
5,992,907 A * 11/1999 Sheldon ..... E05D 15/22 292/141
6,000,735 A 12/1999 Jourdenais
6,086,121 A 7/2000 Buckland
6,116,665 A 9/2000 Subliskey
6,135,510 A 10/2000 Diginosa
6,139,071 A 10/2000 Hopper
6,142,541 A 11/2000 Rotondi
6,155,615 A 12/2000 Schultz
6,176,041 B1 1/2001 Roberts
6,178,696 B1 1/2001 Liang
6,183,024 B1 2/2001 Schultz
6,209,931 B1 4/2001 Von Stoutenborough
6,217,087 B1 4/2001 Fuller
6,230,443 B1 5/2001 Schultz
6,279,266 B1 8/2001 Searcy
6,349,576 B2 2/2002 Subliskey
6,364,375 B1 4/2002 Szapucki
6,546,671 B2 4/2003 Mitchell
6,565,133 B1 5/2003 Timothy
6,588,150 B1 7/2003 Wong
6,592,155 B1 7/2003 Lemley
6,607,221 B1 8/2003 Elliott
6,631,931 B2 10/2003 Magnusson
6,634,683 B1 10/2003 Brannan
6,817,142 B2 11/2004 Marshik
6,848,728 B2 2/2005 Rotondi
6,871,885 B2 3/2005 Goldenberg
6,871,886 B2 3/2005 Coleman
6,877,784 B2 4/2005 Kelley
6,925,758 B2 8/2005 Pettit
6,957,513 B2 10/2005 Pettit
6,983,963 B2 1/2006 Eslick
7,000,957 B2 2/2006 Lawrence
7,013,603 B2 3/2006 Eenigenburg
7,063,361 B1 6/2006 Lawrence
7,070,211 B2 7/2006 Polowinczak
7,070,215 B2 7/2006 Kelley
7,100,951 B2 9/2006 Jien
7,147,255 B2 12/2006 Goldenberg
7,159,908 B2 1/2007 Liang
7,296,831 B2 11/2007 Generowicz
7,322,620 B1 1/2008 Lawrence
7,407,199 B2 8/2008 Richardson
7,481,470 B2 1/2009 Eenigenburg
7,490,873 B1 * 2/2009 Ricke ..... E05B 65/0876 292/5
7,510,221 B2 3/2009 Eenigenburg
7,607,262 B2 * 10/2009 Pettit ..... E05B 5/003 49/185
7,607,703 B2 * 10/2009 Cho ..... E05B 77/06 292/137
7,665,775 B1 2/2010 Miller
7,922,223 B2 4/2011 Lawrence
7,976,077 B2 7/2011 Flory
8,205,919 B2 6/2012 Flory
8,205,920 B2 6/2012 Flory
8,272,164 B2 9/2012 Albrecht
8,550,507 B2 10/2013 Barton
8,726,572 B2 5/2014 Derham
8,789,862 B2 7/2014 Liang
8,844,985 B2 9/2014 Liang
9,140,033 B2 9/2015 Wolf
2006/0192391 A1 8/2006 Pettit
2006/0244270 A1 11/2006 Rotondi
2007/0205615 A1 9/2007 Eenigenburg
2008/0169658 A1 7/2008 Wolf
2010/0199726 A1 8/2010 Varney
2010/0218425 A1 9/2010 Nolte
2010/0263415 A1 10/2010 Ruspil
2013/0214545 A1 8/2013 Wolf
2013/0283695 A1 10/2013 Hollermann
2016/0076282 A1 3/2016 Wolf
2018/0340355 A1 * 11/2018 Liang ..... E05B 65/087

FOREIGN PATENT DOCUMENTS

GB 2 461 107 12/2009
GB 2 461 108 12/2009

* cited by examiner

200

200

200

200

200

211C
211
214A
214B
214C
214D
213
212
216B
216A

200

200

200

216A
218
215
216B 213
200

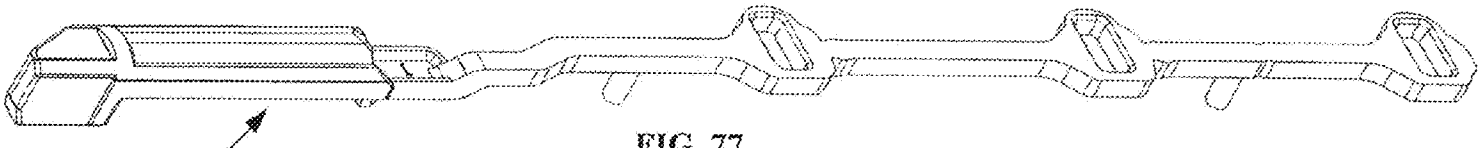
FIG. 77
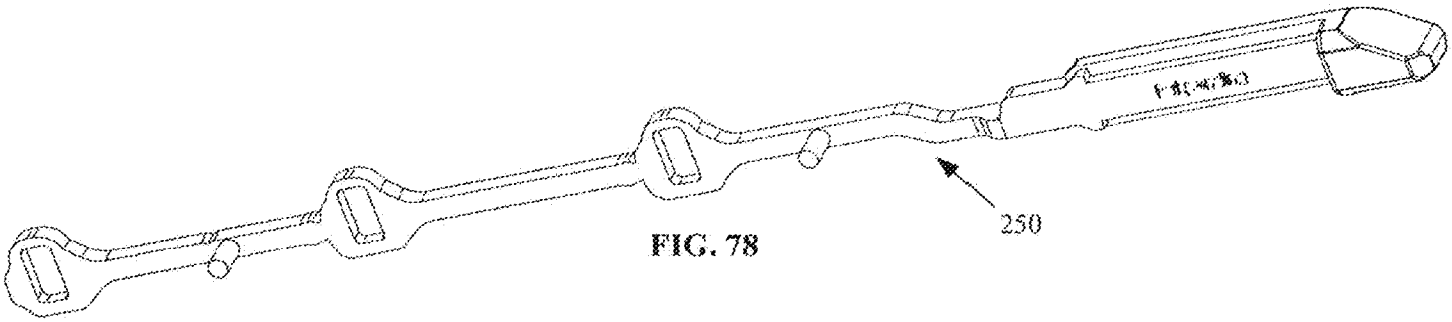
FIG. 78
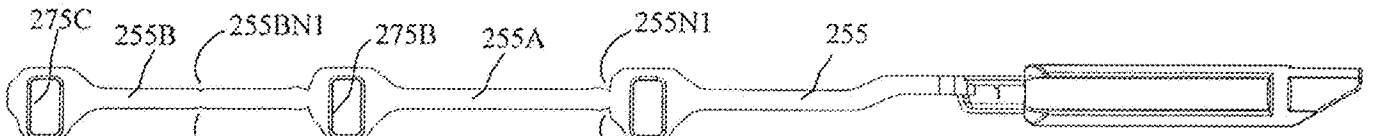
FIG. 80
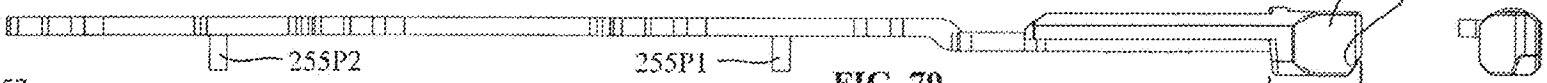
FIG. 79
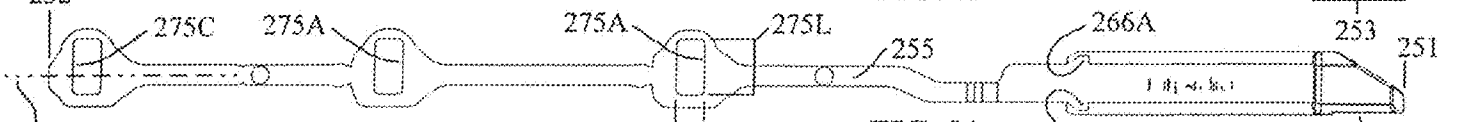
FIG. 81
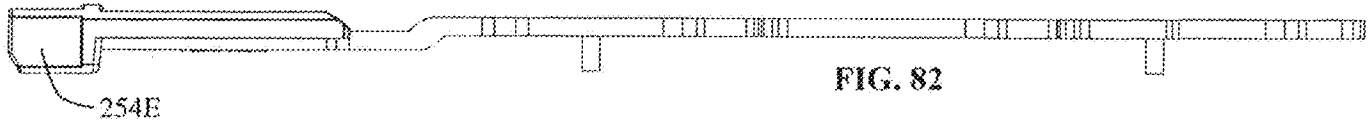
FIG. 82
FIG. 83

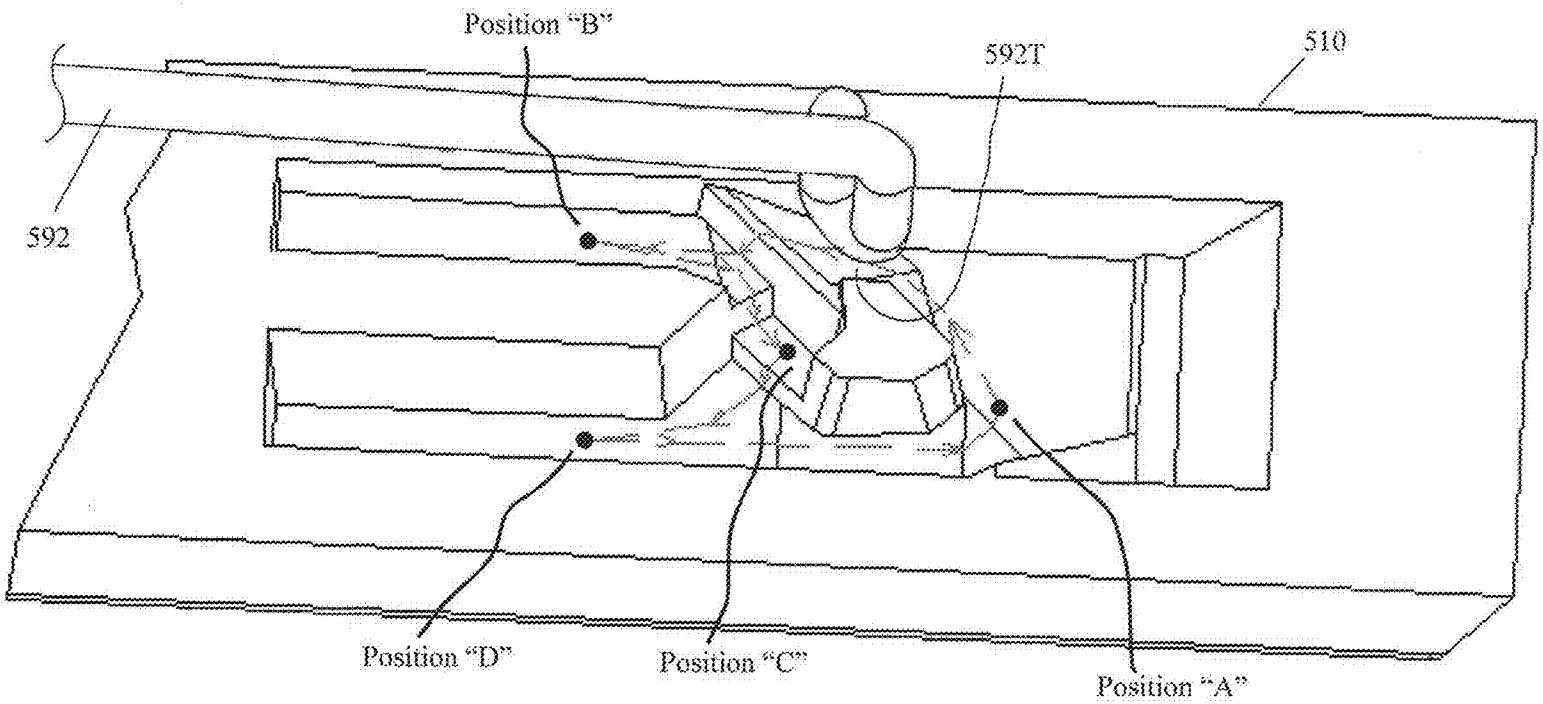
FIG. 165
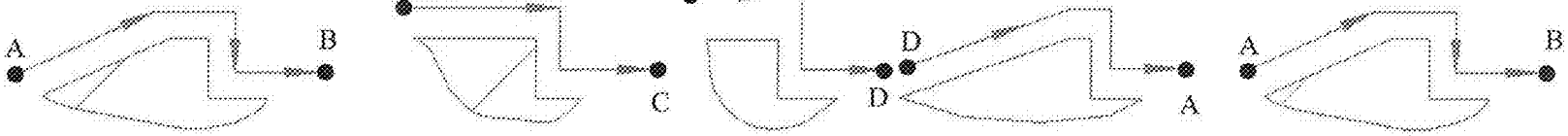
FIG. 165A
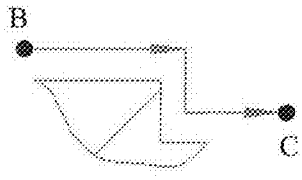
FIG. 165B
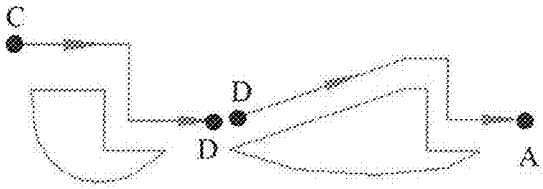
FIG. 165C
FIG. 165D
FIG. 165E

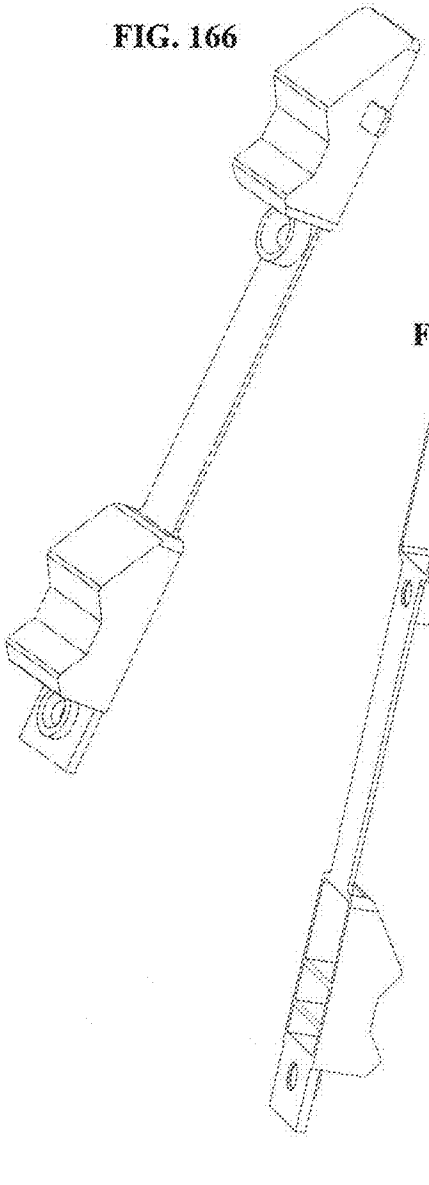
FIG. 166
FIG. 167
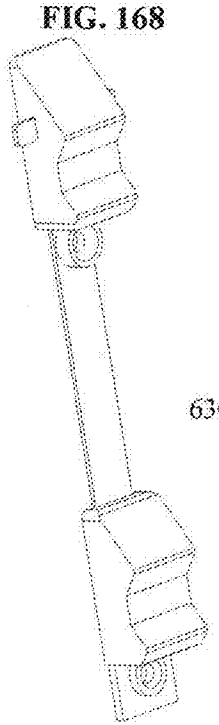
FIG. 168
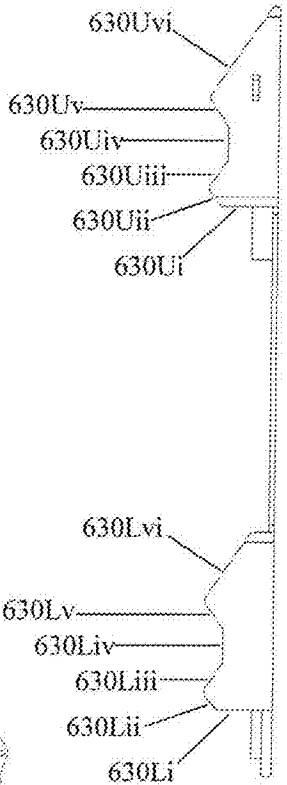
FIG. 170
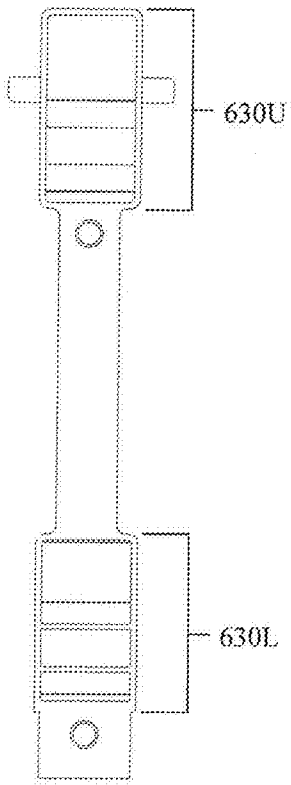
FIG. 169
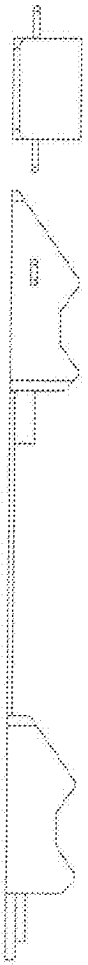
FIG. 171
FIG. 172

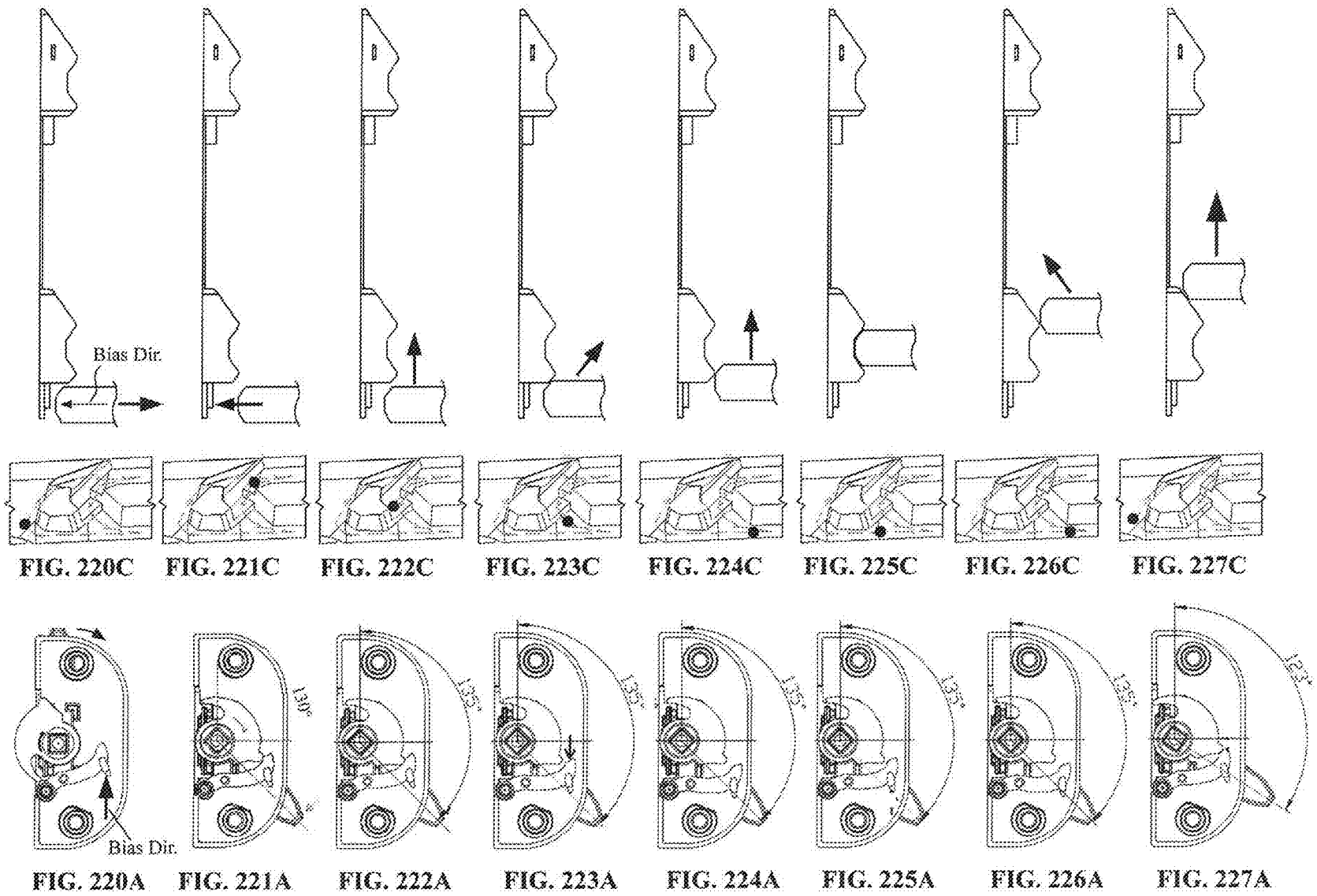
Bias Dir.
Bias Dir.
130°
135°
135°
135

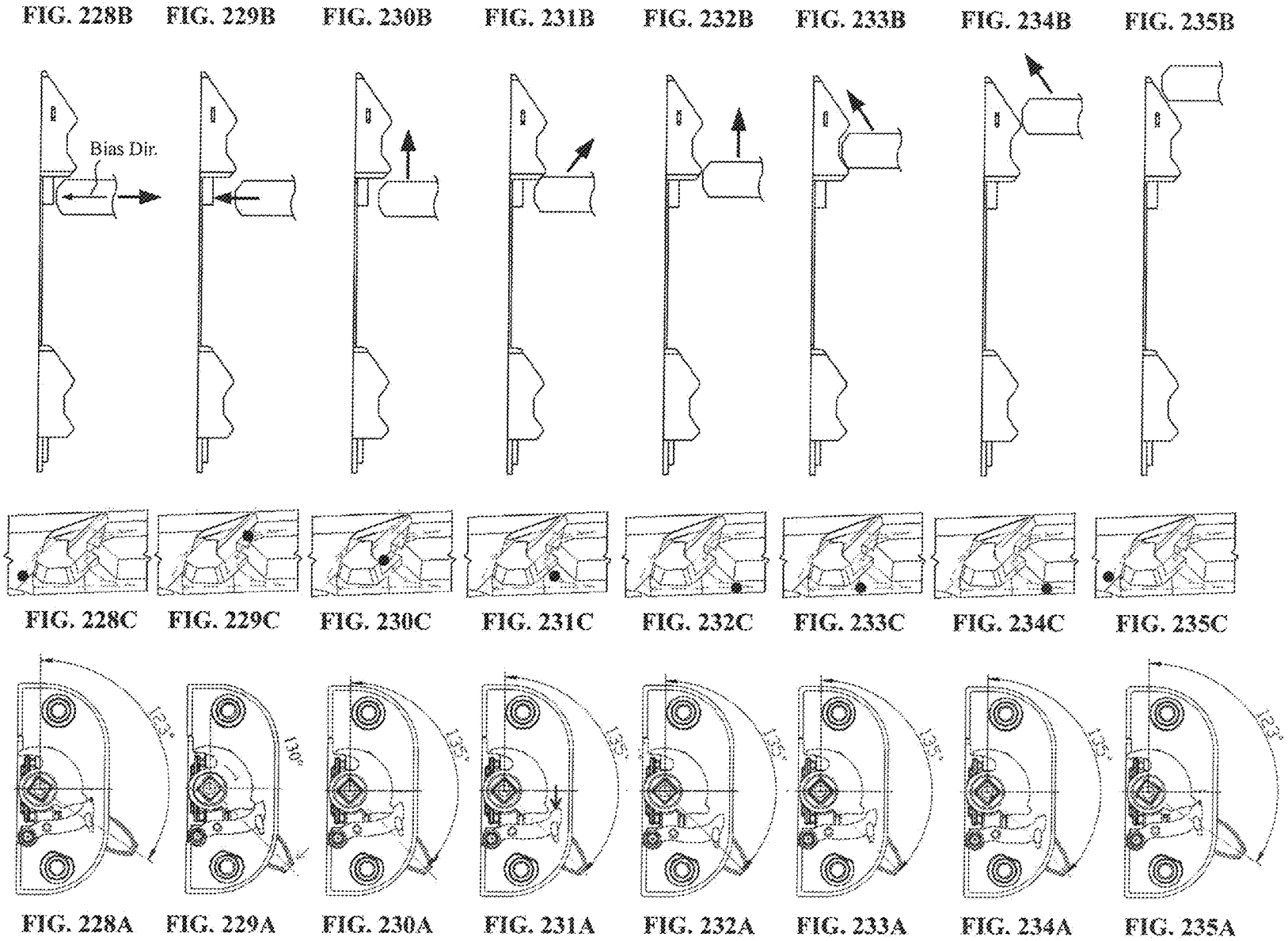
Bias Dir.
123°
130°
135°
135°
135

SASH LOCK AND TILT LATCH ALSO FUNCTIONING AS A WINDOW VENT STOP, WITH AUTOMATIC LOCKING UPON CLOSURE

CROSS REFERENCE TO RELATED APPLICATIONS

This application claims priority on U.S. Provisional Application Ser. No. 62/425,196, filed on Nov. 22, 2016, and is a continuation-in-part of U.S. application Ser. No. 14/881,312, filed on Oct. 13, 2015, which is a continuation-in-part of U.S. application Ser. No. 14/879,436, having the title "Impact-Resistant Lock and Tilt Latch Combination for a Sliding Sash Window," and U.S. application Ser. No. 14/879,164, having the title "Integrated Sash Lock and Tilt Latch Combination Using One Lock for Two Tilt Latches," each of which were filed on Oct. 9, 2015, and which are a continuation-in-part of U.S. patent application Ser. No. 14/566,908, filed on Dec. 11, 2014, having the title "Integrated Sash Lock and Tilt Latch Combination with Improved Wind-Force-Resistance Capability," which is a continuation-in-part of U.S. patent application Ser. No. 14/278,226, filed on May 15, 2014, having the title "Integrated Sash Lock and Tilt Latch Combination with Improved Interconnection Capability Therebetween," which is a continuation-in-part of U.S. patent application Ser. No. 14/198,986, filed on Mar. 6, 2014, having the title "Integrated Sash Lock and Tilt Latch with Screwless Installation and Removal from Meeting Rail," with the disclosures of each being incorporated herein by reference.

FIELD OF THE INVENTION

The present invention relates to improvements in locks and tilt latches for slidable sash windows, and more particularly to improvements to an integral sash lock/tilt latch combination that furthermore includes a window vent stop capability.

BACKGROUND OF THE INVENTION

Single hung and double hung sliding sash windows are commonly used today in the construction of residential and commercial buildings. Sash locks are typically mounted to the meeting rail of the bottom sash window to lock the sash or sashes, by preventing the lower sash (or both the lower and upper sashes for a double hung window), from being opened through sliding movement relative to the master window frame. Also, in order to assist in the cleaning of the exterior of these sliding sash windows, it is common for window manufacturers to incorporate a tilt latch device thereon that permits one end of the sliding sash window to be released from the track of the master window frame. This allows the sash window to be pivoted into the room, for easy access to the exterior surface of the glazing that is normally exposed to the exterior environment of the building.

The present invention seeks to provide improvements to such window hardware in the form of an integrated sash lock and tilt latch fastener for single hung or double hung windows.

OBJECTS OF THE INVENTION

It is an object of the invention to provide a sash lock to prevent relative sliding movement of one or both sliding sash windows that are slidable within a master window frame.

It is another object of the invention to provide a tilt latch to permit pivoting of a sliding sash window inwardly into the room in which the window is installed.

It is a further object of the invention to provide a combination sash lock and tilt latch that act cooperatively through the use of a single cam.

It is another object of the invention to provide a sash lock and tilt latch that may act cooperatively to furthermore limit the travel of a window to provide a vent opening that is too small to permit egress of a small child therefrom.

It is also an object of the invention to provide a sash lock that may be blindly coupled to a tilt latch device for cooperative interaction and actuation of the latch.

Further objects and advantages of the invention will become apparent from the following description and claims, and from the accompanying drawing figures.

SUMMARY OF THE INVENTION

An integral sash locking and tilt latching fastener for a sliding sash window may include a lock assembly that may be interconnected with a latch assembly.

The lock assembly may be mounted to the top of the meeting rail of the sash window. The lock assembly may include a housing and a cam pivotally mounted to the housing, being configured to pivot out from a cavity in the housing to releasably engage a keeper on the master window frame (or on a second sliding sash window) in a "lock" position, to lock the sash window (or windows) and prevent it from sliding and/or tilting. The lock assembly also includes a lever arm that may be pivotally mounted within the lock housing, and which may be configured for a portion thereof to extend beyond the mounting surface of the housing, and into the hollow of the meeting rail. The cam may have a graspable shaft portion that may protrude upwardly, out from an orifice in the sash lock housing, to permit actuation of the device (cam rotation) by a user. Alternatively, the device may have a separate handle member secured to the cam, where the handle may facilitate easy rotation and counter-rotation of the cam.

The latch assembly may be received through an opening on a side of the sash member. The latch assembly may include a housing, biasing means, and a latch member slidably disposed within the housing. The latch member is configured to receive the lever arm of the lock assembly, when positioned within the hollow meeting rail, for coupling therebetween. The housing, latch member, and biasing means are configured for the biasing means to normally bias the latch member, so that a portion of one end (i.e., a portion of its "tongue") may protrude out from the housing, and out of the sash window frame.

With the cam releasably secured in the "lock" position (e.g., using a detent mechanism), the cam may prevent sliding of the sash window through its engagement with the keeper, the latch member is also in its fully extended position which would prevent tilting of the sash window. The sash window may be redundantly locked with respect to any sliding motion within the master window frame by a stop member, which may be secured in the track of the master window frame within which the sash member slides. A first step of the stop member may protrude a first distance into the track, and may thereat block sliding movement of the tongue of the latch member that is biased to protrude therein, to provide a secondary lock feature with respect to sliding of the window away from its closed position.

When actuation of the shaft/handle member causes the cam to rotate (e.g., 135 degrees from the lock position), it may move the cam from the extended lock position into a first retracted cam position—a position where the cam is disengaged from the keeper on the master window frame, and would no longer prevent the sash window from sliding. Rotation of the cam into the first retracted cam position may cause a portion thereof to contact a follower portion of the lever arm and thereby drive the lever arm to also rotate, which rotation may act to oppose the biasing of the latch member to actuate it a discrete amount, through the interconnection therebetween, to move the latch member into a corresponding first retracted latch member position. With the latch member in the first retracted latch member position, the end of its tongue may be positioned clear of the first step of the stop member, so that the sash window may slide away from its closed position. However, a second step on the stop member may protrude a second distance, being further into the track of the master frame, and may be positioned at a discrete height above the first step, which may nonetheless still block sliding movement of the latch member.

This may provide a vent stop feature that permits sliding of the sash window from its closed position but only up to small elevated position that may form an opening small enough to prevent accidental egress by a small child or ingress by an intruder, but which nonetheless provides ventilation. With the latch member in its first retracted position, a portion of its tongue remains engaged within the track of the master window frame, and thereat still serves to prevent tilting of the sash member out from the master window frame. Note that the detent mechanism may releasably secure the cam at the first retracted cam position, thereby also releasably securing the latch member at the first retracted latch member position, due to the interconnection therebetween.

When continued actuation of the shaft/handle member causes the cam to further rotate a discrete amount (e.g., an additional 25 degrees—being 160 degrees from the cam's lock position), to move from the first retracted position to a second retracted position, the cam may further drive the lever arm to correspondingly rotate a discrete amount, and thus move the latch member into a second retracted latch member position. With the latch member in the second retracted latch member position, the end of the tongue is then positioned clear of the second step of the stop member, so that the sliding movement of the sash window is no longer limited, and it may now slide anywhere between a fully closed position and a fully open position. However, the tongue nonetheless still remains engaged within the track of the master window frame, and thus still serves to prevent tilting of the sash member out from the master window frame.

When continued actuation of the shaft/handle member causes the cam to further rotate another discrete amount (e.g., an additional 20 degrees—being 180 degrees from the cam's lock position), to move from the second retracted position to a third retracted position, the cam further drive the lever arm to correspondingly rotate a discrete amount, and move the latch member into a third retracted latch member position. With the latch member in the third retracted latch member position, the end of the tongue is then disengaged from the track of the master window frame, and the sash window is free to be tilted out of the master window frame. Note that the detent mechanism may also releasably secure the cam at the second and third retracted cam position, thereby also releasably securing the latch member at the third retracted latch member position.

Both a left-hand and right-hand version of the above described integral sash locking and tilt latching fastener and corresponding stepped stop may be mounted on a sliding sash window and master frame. Alternatively, only the left-hand or the right hand arrangement may be used to secure the window as described. The following discussion proceeds with a discussion of one version of the fastener, with the understanding that a mirror image may also be formed and used on the window.

BRIEF DESCRIPTION OF THE DRAWINGS

FIG. 77 is a third perspective view of the latch member shown in FIG. 75.

FIG. 78 is a fourth perspective view of the latch member shown in FIG. 75.

FIG. 79 is a first side view of the latch member of FIG. 75.

FIG. 80 is a top view of the latch member of FIG. 75.

FIG. 81 is a bottom view of the latch member of FIG. 75.

FIG. 82 is a second side view of the latch member of FIG. 75.

FIG. 83 is an end view of the latch member of FIG. 75.

FIG. 118 is a cross-section cut normal to the sash window frame engaged with the master window frame, as seen in FIG. 117.

FIG. 119 is a cross-section showing the side of the sash window frame engaged with the master window frame, as seen in FIG. 117.

FIG. 120 is the cross-section of FIG. 118, shown as a view with the stepped stop of FIG. 103 mounted within the track of the master window frame.

FIG. 121 is the cross-section of FIG. 119, shown as a view with the stepped stop of FIG. 103 mounted within the track of the master window frame, and shown with the cam of the sash lock in the extended locked position, and the latch member in the corresponding extended position, to engage a first step of the stop and redundantly lock the window in the window closed position.

FIG. 122 is a bottom view of the sash lock with the cam and shaft/handle member shown in the locked position, as seen in FIG. 121.

FIG. 123 is a perspective view of the arrangement shown in FIG. 121, with the cam of the sash lock in the extended locked position, and the latch member in the corresponding extended position, to engage a first step of the stop and redundantly lock the window in the window closed position.

FIG. 124 is the cross-section of FIG. 121, but shown with the cam and shaft/handle member of the sash lock in the first retracted position, and with the latch member moved into the corresponding retracted position, to disengage from the first step of the stop and unlock the window, to permit sliding movement of the window away from the window closed position.

FIG. 125A is the bottom view of the sash lock shown in FIG. 122, but with arrows indicating a force applied to the shaft/handle member that may cause the indicated rotation of the cam, to move the cam into the first retracted position shown in FIG. 124.

FIG. 125B is a bottom view of the sash lock with the cam and shaft/handle member in the first retracted position, as seen in FIG. 124, showing engagement of a rounded protrusion on the cam with the follower portion of the lever arm.

FIG. 126 is a perspective view of the arrangement shown in FIG. 124, with the cam of the sash lock in the first retracted position, and the latch member in the corresponding retracted position.

FIG. 127 is the cross-section of FIG. 124, with the cam and shaft/handle member of the sash lock still in the first retracted position, and with the latch member still in the corresponding first retracted latch position, but is shown after the window has been slid open into an open-limited position in which the tongue of the latch member engages a second step on the stop.

FIG. 128 is a perspective view of the arrangement shown in FIG. 127.

Figure 127:
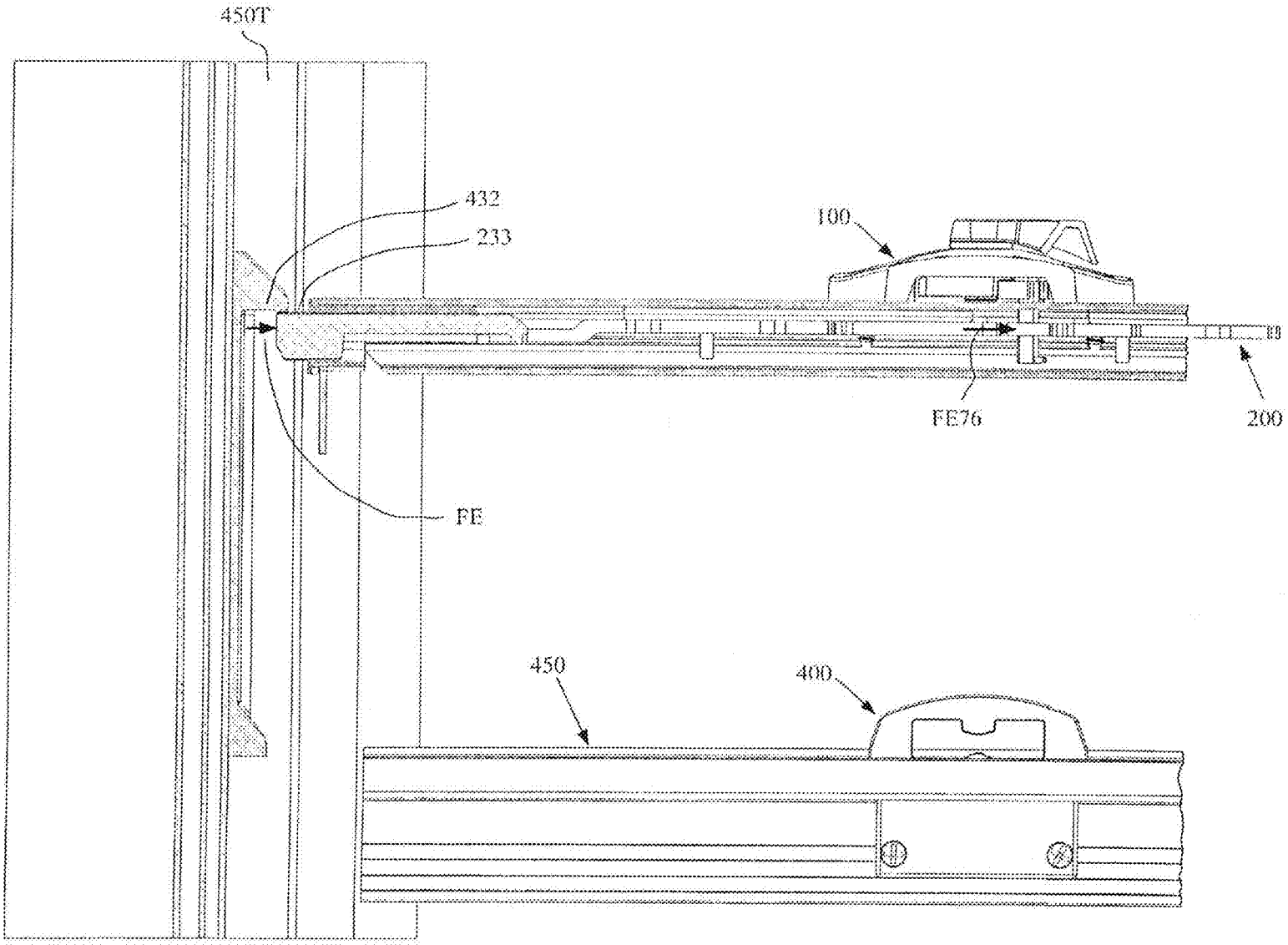
Figure 129:
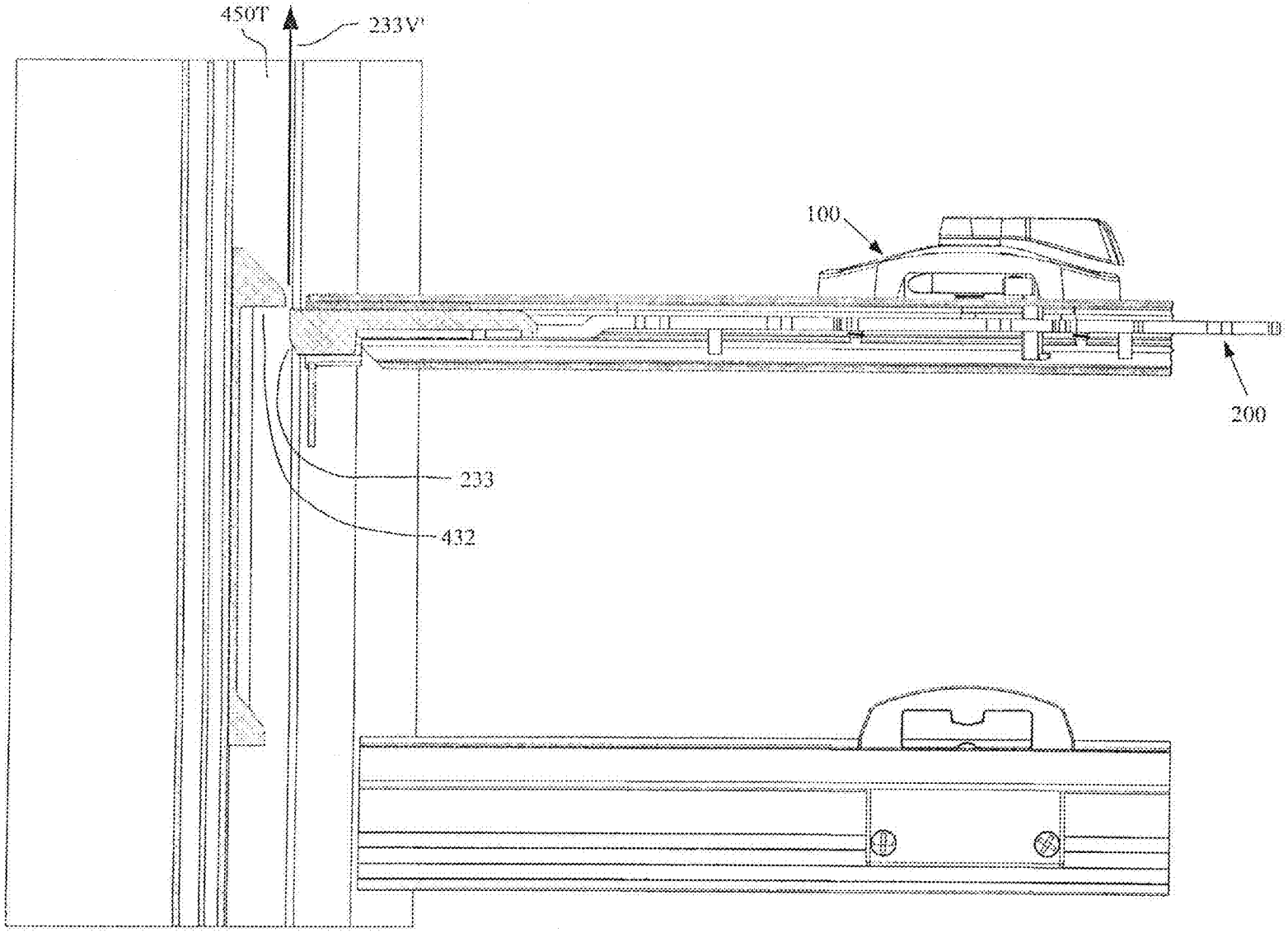

FIG. 129 is the cross-section of FIG. 127, but shown with the cam and shaft/handle member of the sash lock in the second retracted position, and with the latch member moved into the corresponding second retracted latch position, to disengage from the second step of the stop, to permit sliding movement of the window beyond the open-limited position, but which still engages the master frame to prevent tilting of the window therefrom.

Figures 124, 125A, 125B:
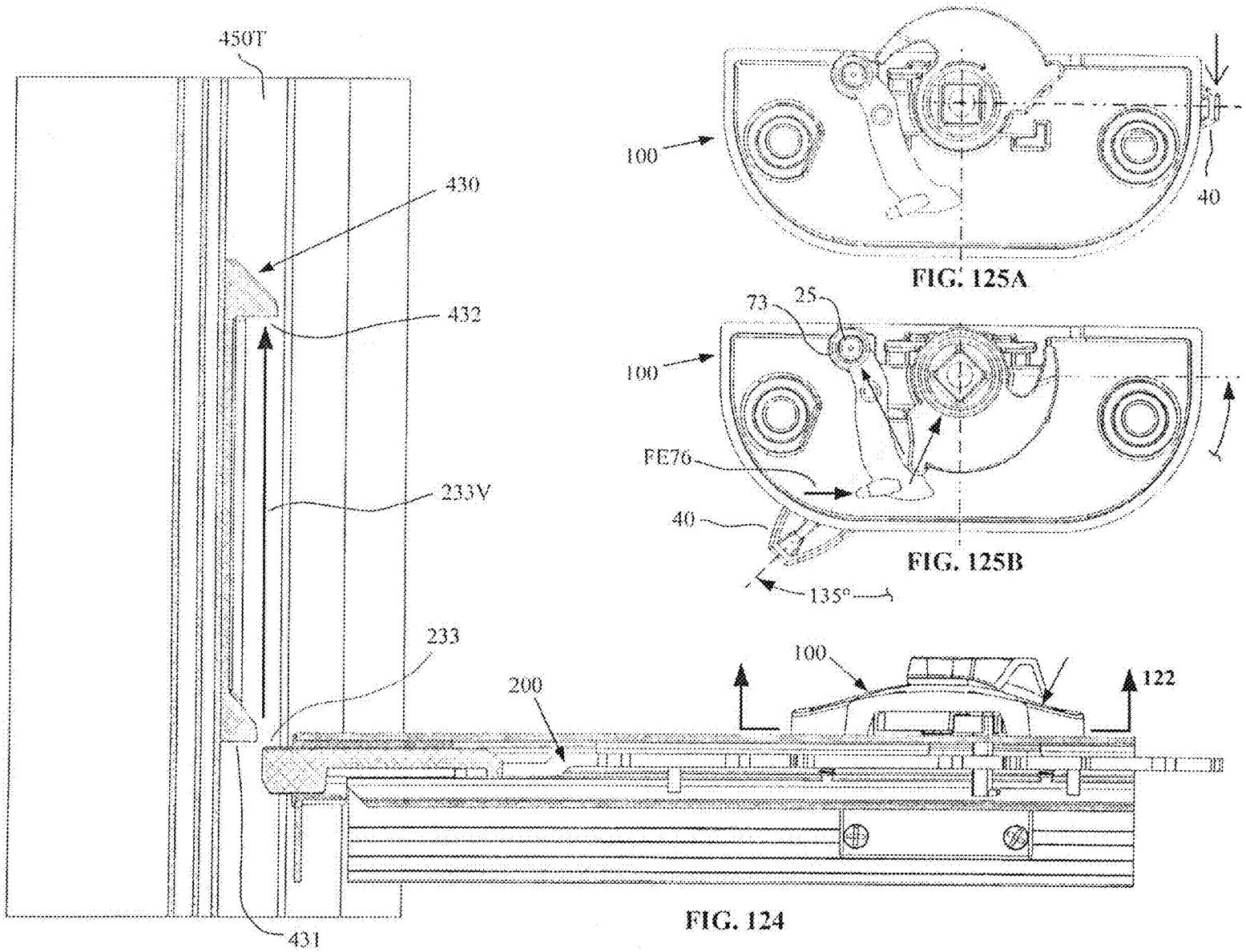
Figure 130B:
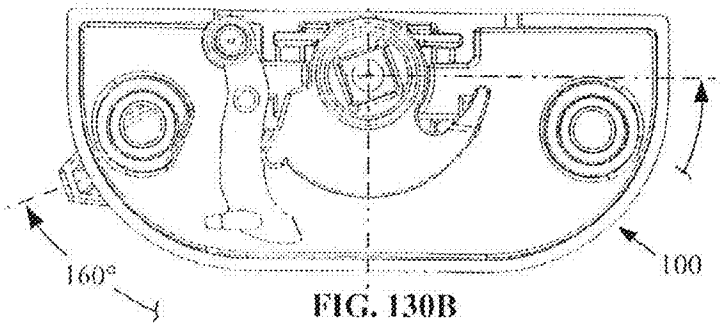
Figure 130A:
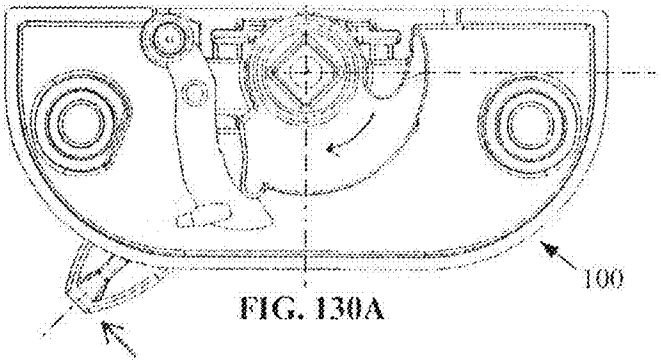

FIG. 130A is the bottom view of the sash lock shown in FIG. 125B, but with arrows indicating a force applied to the shaft/handle member that may cause the indicated rotation of the cam, to move the cam into the second retracted position shown in FIG. 129.

FIG. 130B is a bottom view of the sash lock with the cam and shaft/handle member in the second retracted position, as seen in FIG. 129, showing engagement of the rounded protrusion on the cam at a different location of the follower portion of the arm.

Figure 131B:
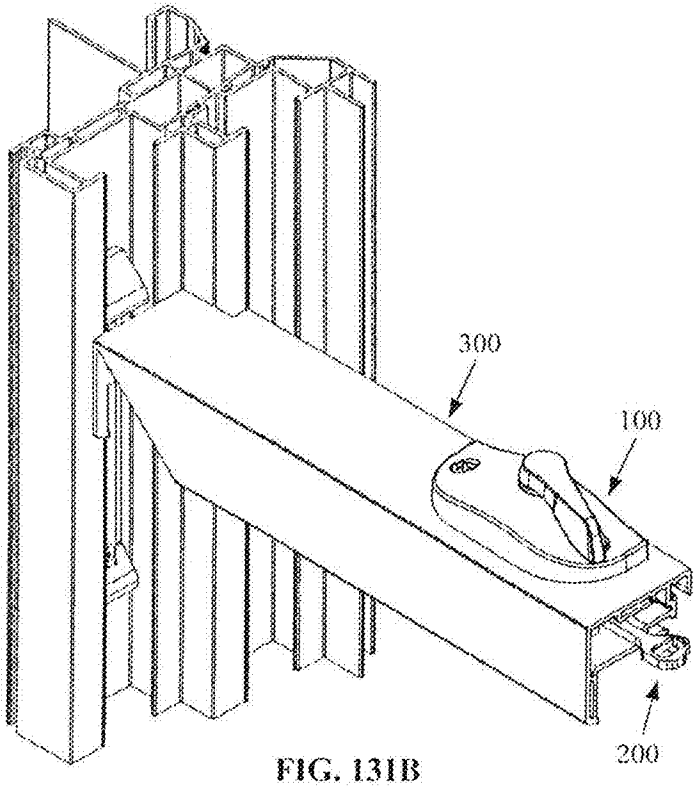
Figure 131A:
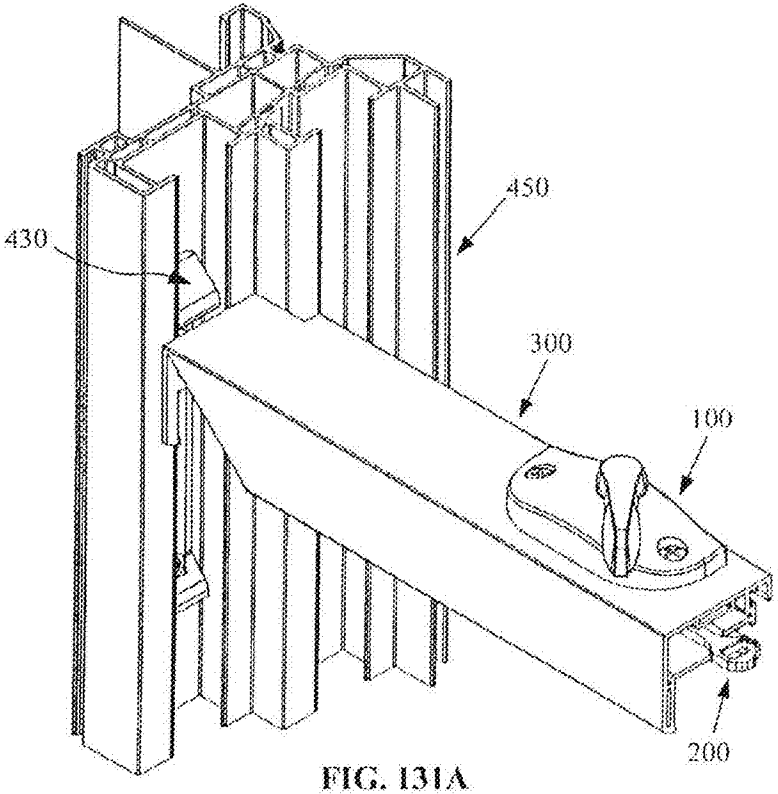

FIG. 131A is a perspective view of the arrangement of FIG. 130A, with the shaft/handle member shown rotated 135 degrees from the locked position to be at the first retracted position.

FIG. 131B is a perspective view of the arrangement of FIG. 130A, with the shaft/handle member shown rotated 160 degrees from the locked position to be at the second retracted position.

Figure 132:
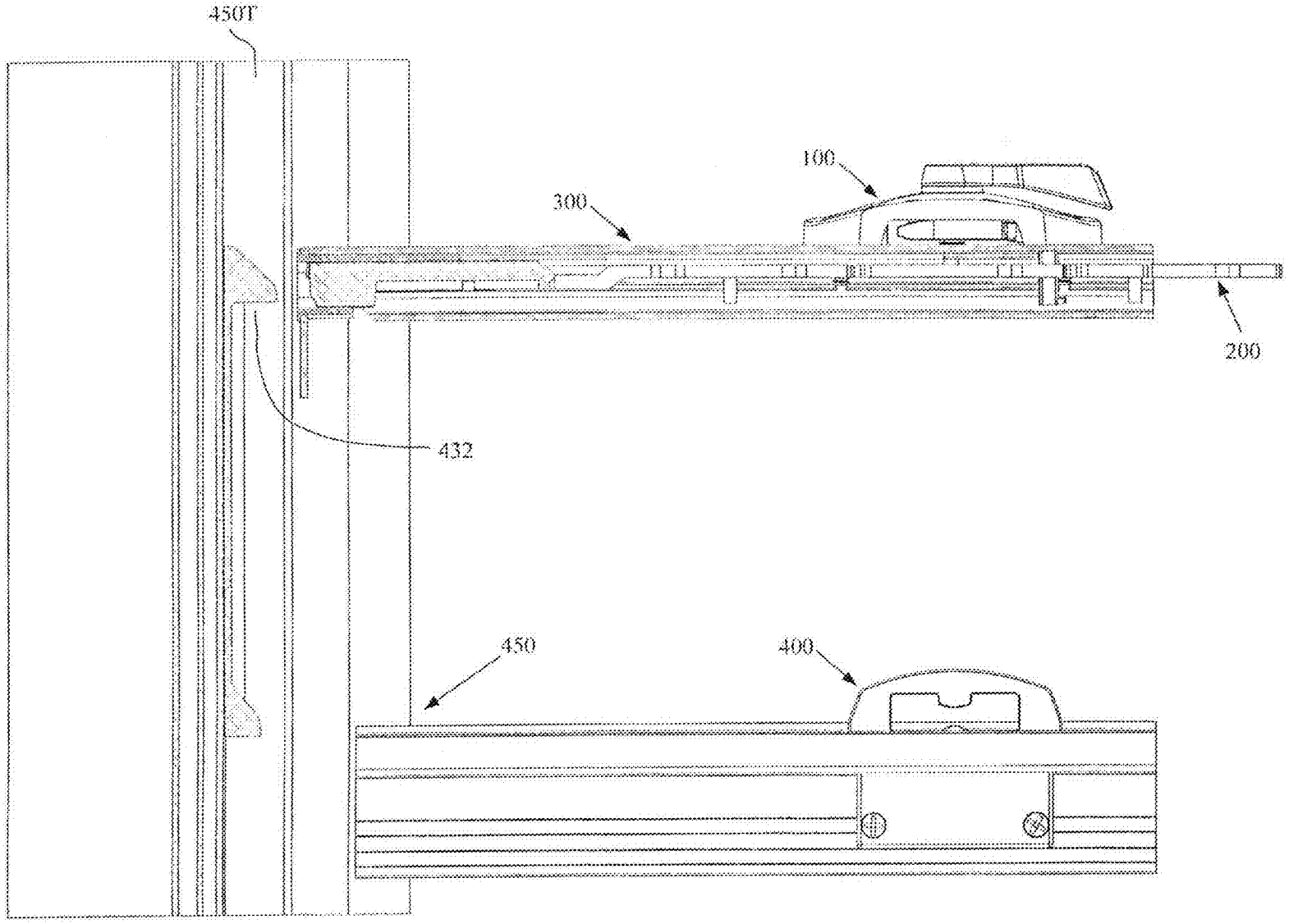

FIG. 132 is the cross-section of FIG. 129, but shown with the cam and shaft/handle member of the sash lock in the third retracted position, and with the latch member moved into the corresponding third retracted latch position, to be disengaged from the master frame, to permit tilting of the window therefrom.

Figure 133B:
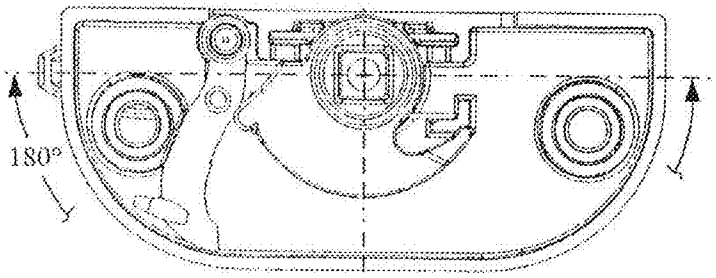
Figure 133A:
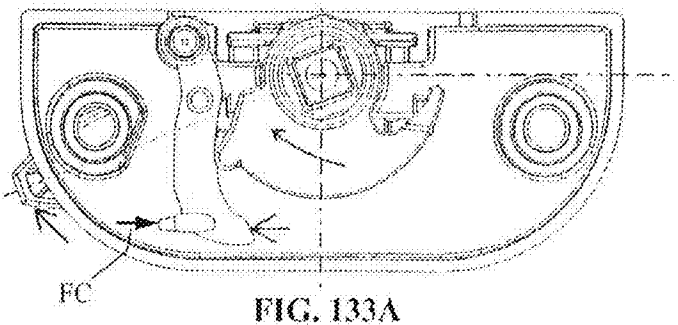

FIG. 133A is the bottom view of the sash lock shown in FIG. 130B, but with arrows indicating a force applied to the shaft/handle member that may cause the indicated rotation of the cam, to move the cam into the third retracted position shown in FIG. 132.

FIG. 133B is a bottom view of the sash lock with the cam and shaft/handle member in the third retracted position, as seen in FIG. 132, showing engagement of the rounded protrusion on the cam at a different location of the follower portion of the lever arm.

Figure 134B:
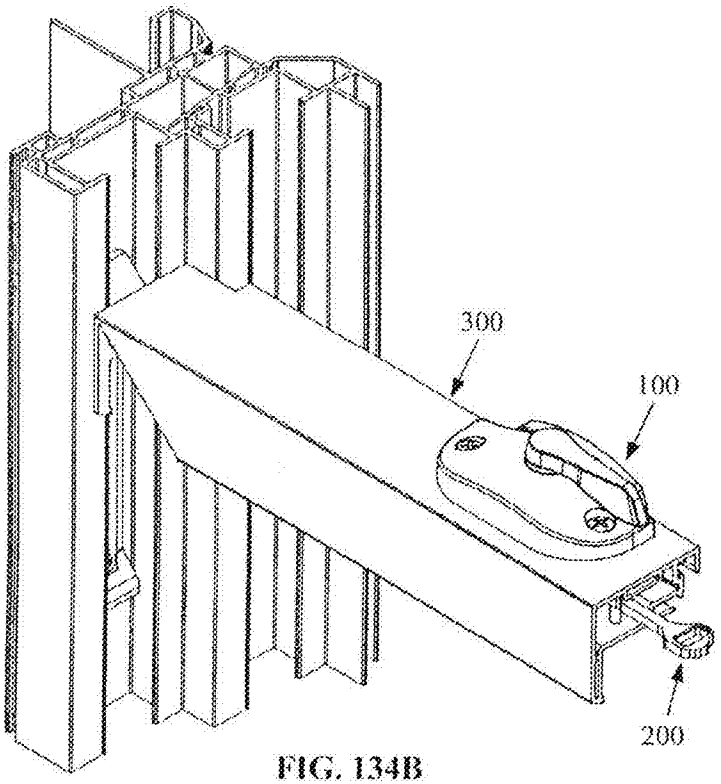
Figure 134A:
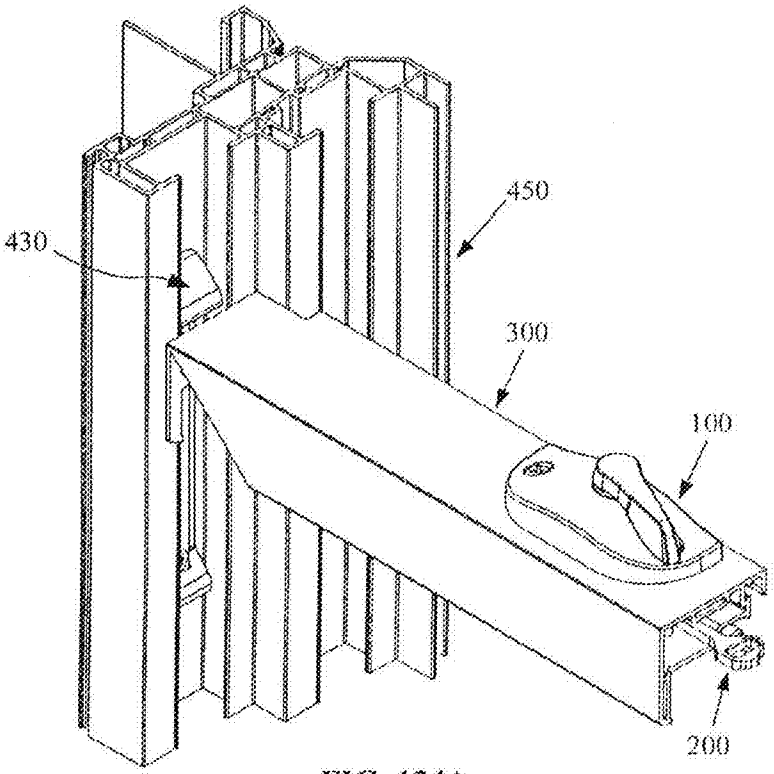

FIG. 134A is a perspective view of the arrangement of FIG. 133A, with the shaft/handle member shown rotated 160 degrees from the locked position to be at the second retracted position.

FIG. 134B is a perspective view of the arrangement of FIG. 133B, with the shaft/handle member shown rotated 180 degrees from the locked position to be at the third retracted position.

Figure 135:
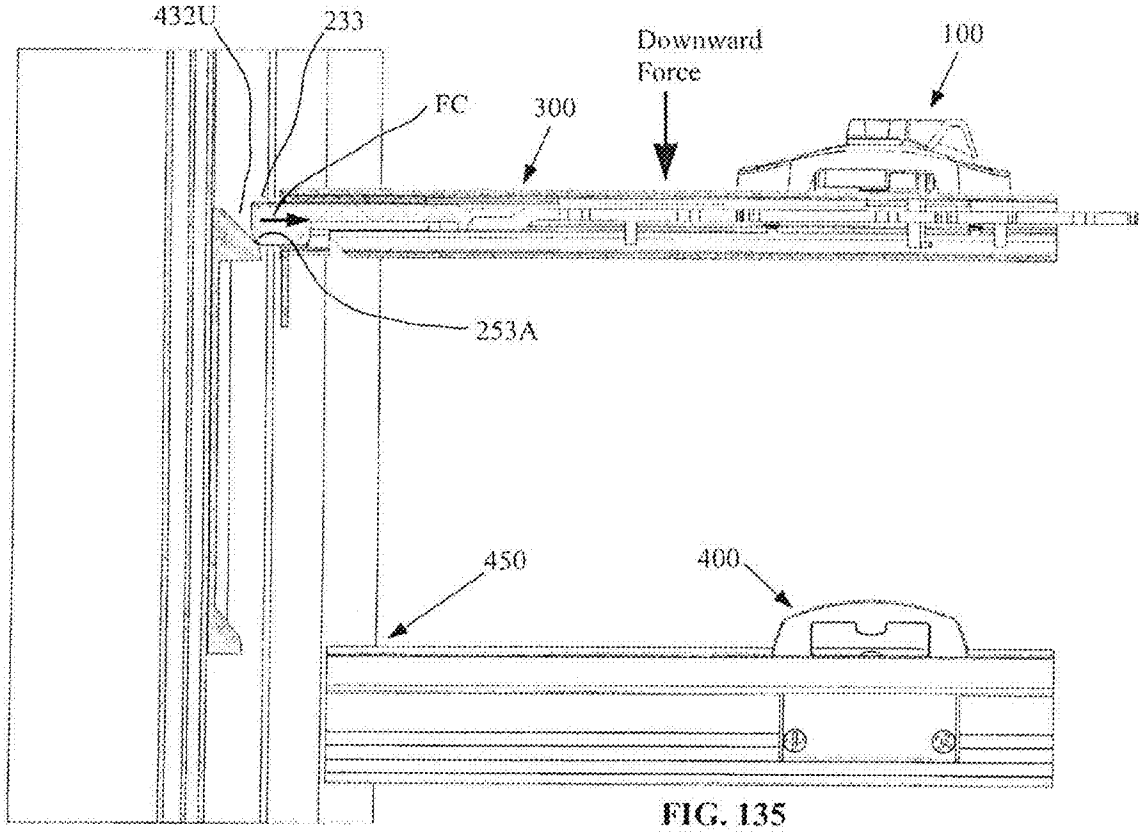

FIG. 135 is the cross-section of FIG. 129, but after the window had been opened beyond the window-limited position of FIG. 127, and with the cam and shaft/handle member moved back into the first retracted position, with the latch member moved back into its corresponding first retracted latch position, and with the angled bottom of the latch member contacting the angled top of the stop.

Figure 136:
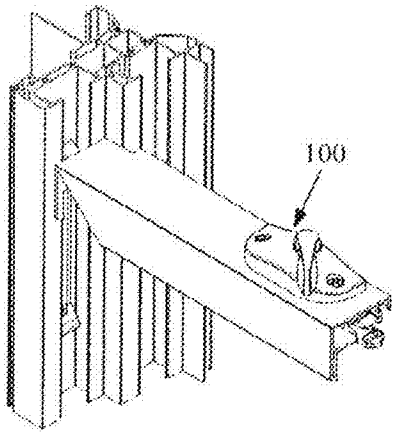

FIG. 136 is a perspective view of the arrangement shown in FIG. 135.

Figure 137:
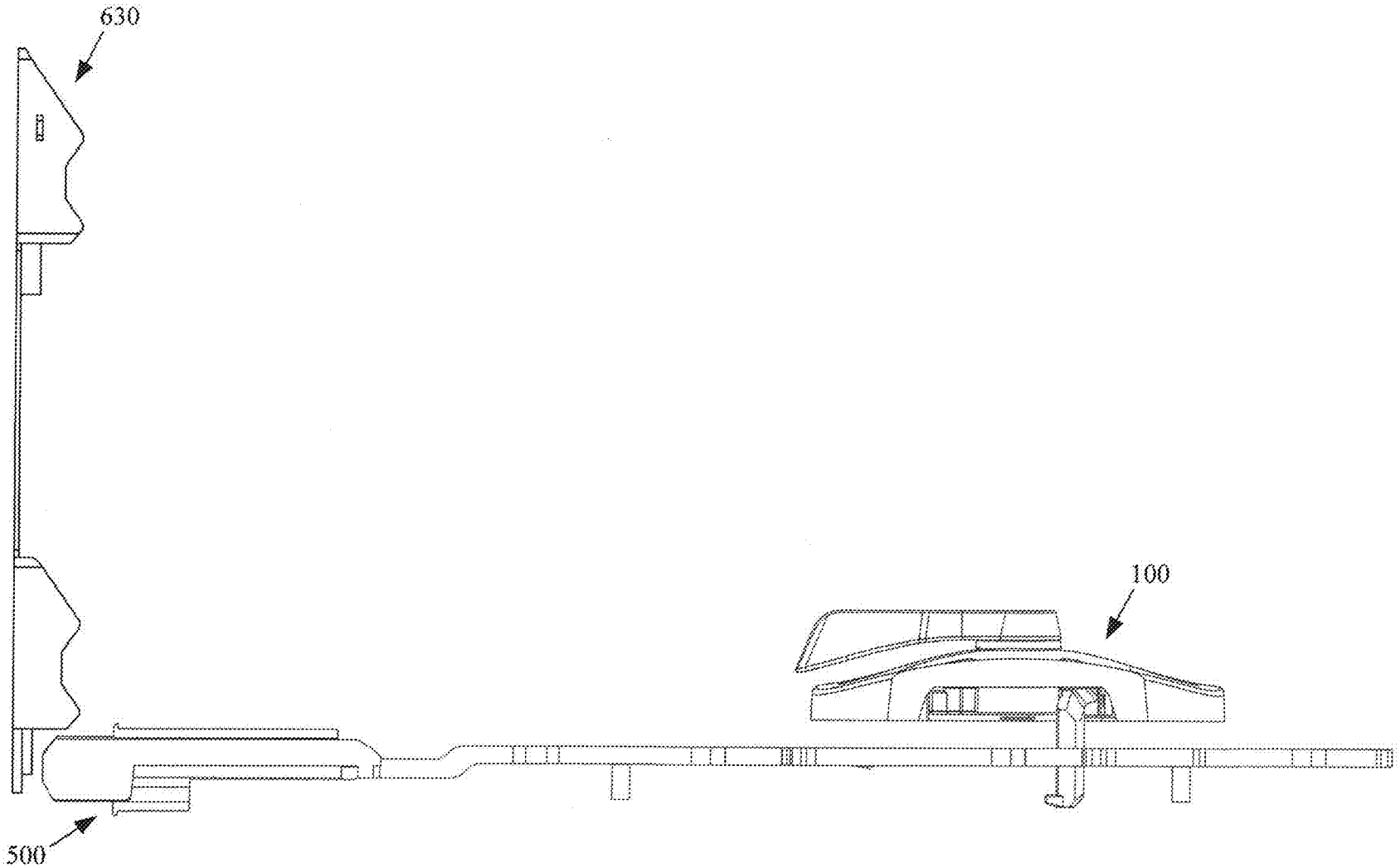

FIG. 137 is a side view of a second embodiment of a sash fastener for a slidable sash member, and includes a sash lock assembly, a tilt latch assembly, and a stop member with dual stop features.

Figure 137A:
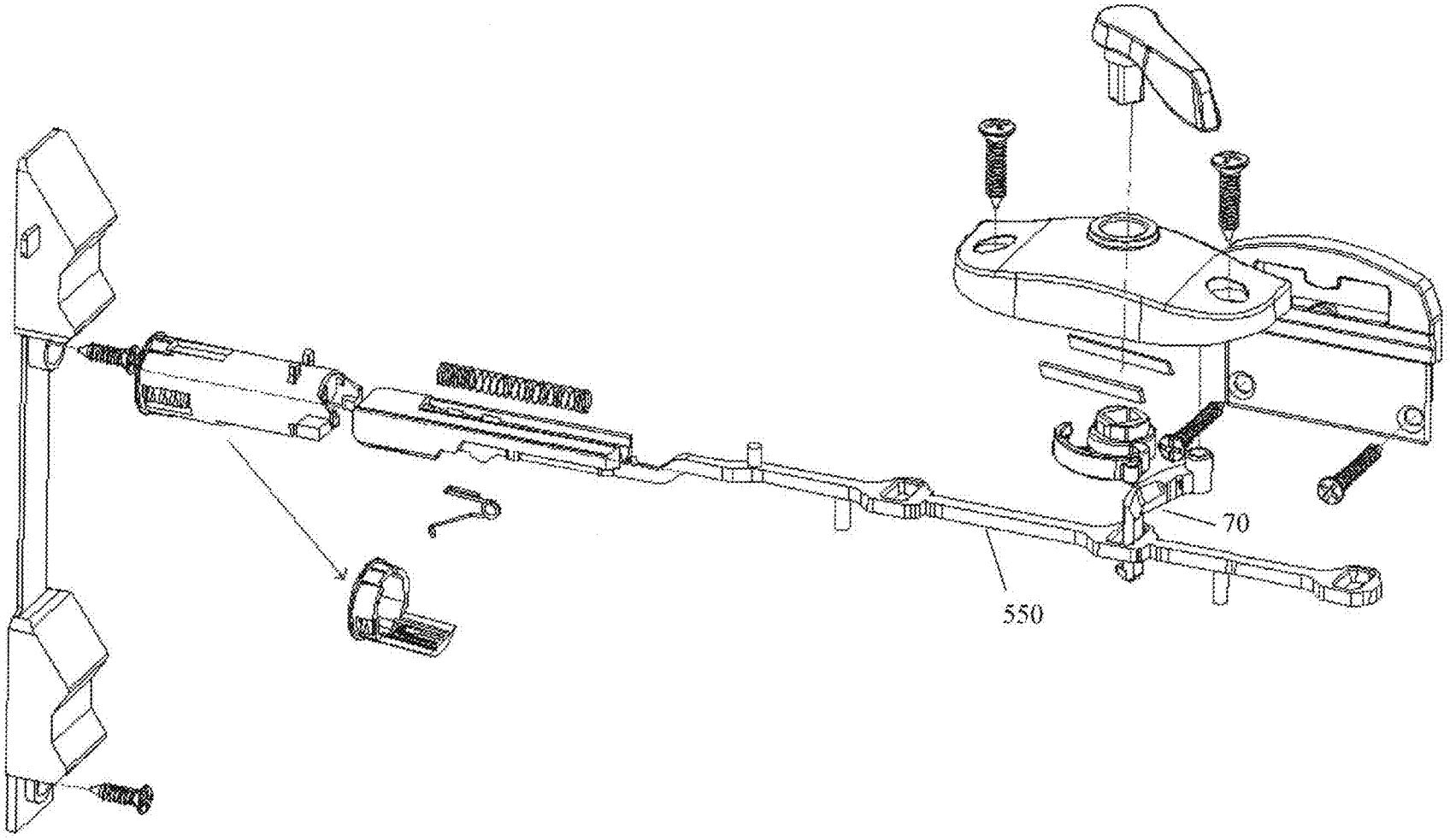

FIG. 137A is an exploded view of the component parts of the sash lock assembly and tilt latch assembly shown in FIG. 137, as well as the stop member, the keeper that is to be mounted to the master window frame, and mounting fasteners.

Figure 138A:
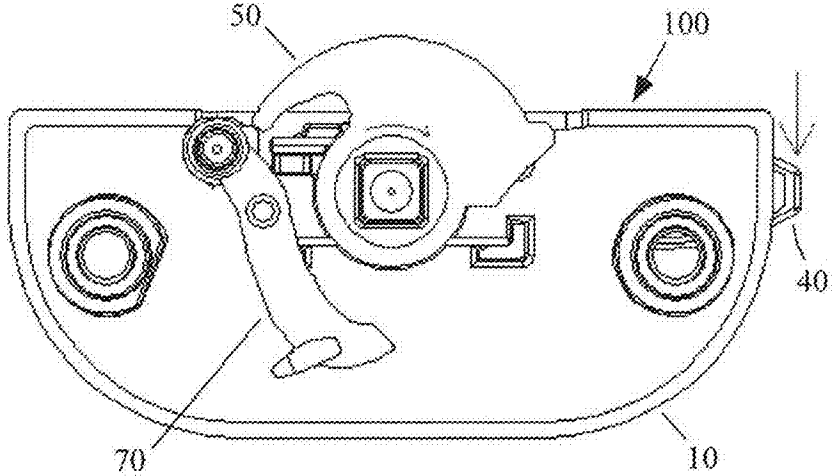

FIG. 138A is the bottom view of the sash lock assembly shown enlarged and with the cam/handle in the extended (locking) position (i.e., shaft/handle at zero degrees of rotation).

Figure 138B:
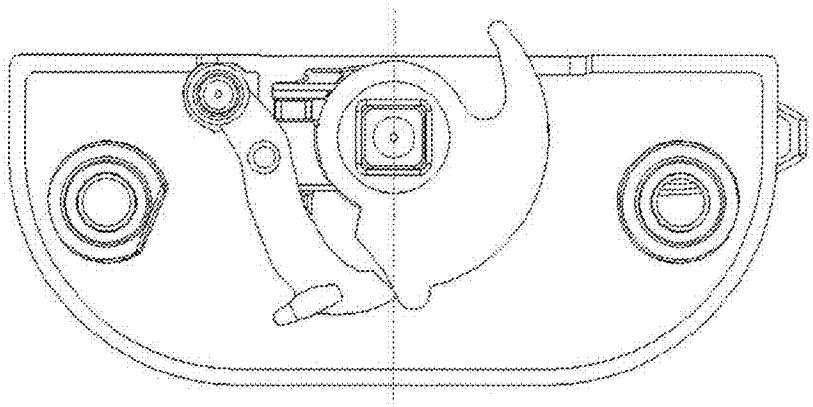

FIG. 138B is the bottom view of FIG. 138A, but is shown with the cam/handle having been rotated just sufficiently for a shaped surface of the cam to initially contact a shaped surface of the lever arm, which may in one embodiment me be roughly at 123 degrees of rotation.

Figure 138C:
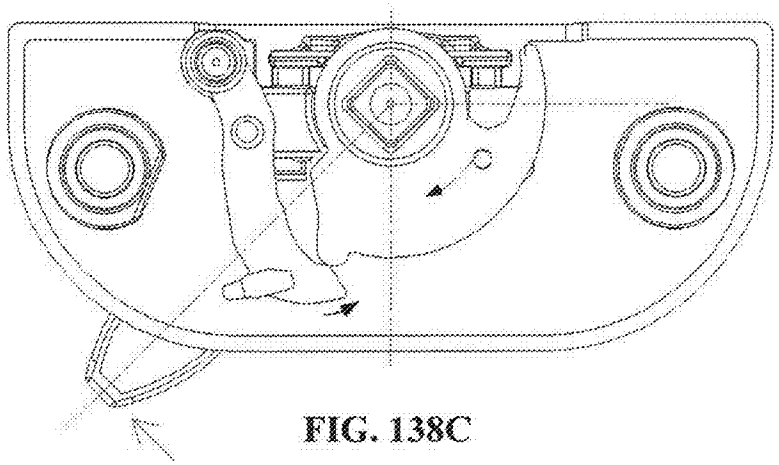

FIG. 138C is the bottom view of FIG. 138B, but is shown with the cam/handle having been rotated an additional amount, which in one embodiment may be roughly an additional 7 degrees of rotation (i.e. a total of 130 degrees of cam/handle rotation from the position of FIG. 138A), with the protrusion on the cam having correspondingly driven the follower portion of the lever arm for the lever arm to rotate a small amount from its unrestrained (biased) position in FIG. 138B.

Figure 138D:
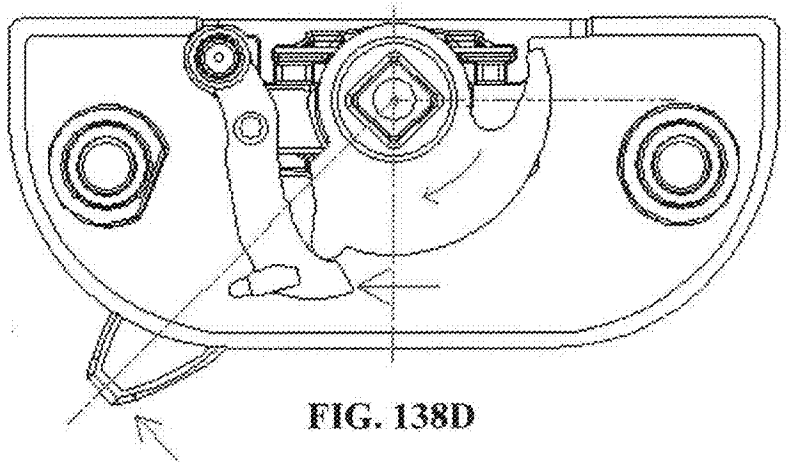

FIG. 138D is the bottom view of FIG. 138C, but is shown with the cam/handle having been rotated an additional amount, which in one embodiment may be roughly an additional 5 degrees (i.e. a total of 135 degrees from the position of FIG. 138A), to occupy a first retracted unlock position, and being releasably retained thereat using a spring detent, with the lever arm having counter-rotated a small amount for the radiused portion of its follower surface to rest upon the protrusion on the cam.

Figure 138E:
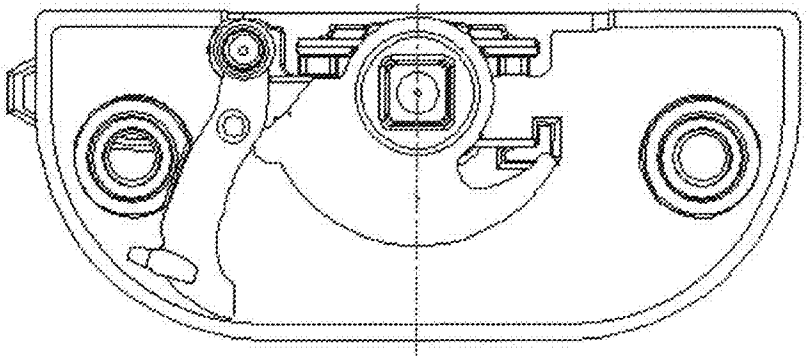

FIG. 138E is the bottom view of FIG. 138D, but is shown with the cam having been rotated roughly an additional 45 degrees (i.e. a total of 180 degrees from the position of FIG. 138A), to occupy a second retracted position, with the protrusion on the cam having correspondingly driven the follower surface of the lever arm, for the lever arm to drive the latch member into a fully retracted position to permit tilting of the sash window.

Figure 139A:
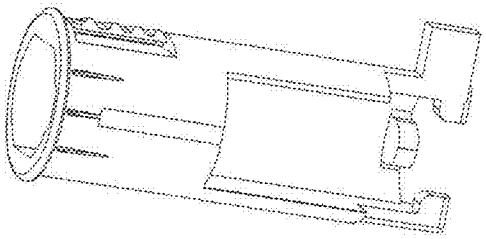

FIG. 139A is a first perspective view of a housing used to house the component parts of the latch assembly of FIG. 137.

Figure 139B:
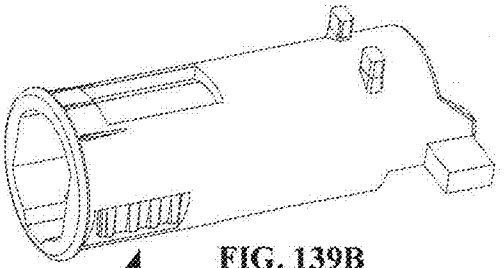

FIG. 139B is a second perspective view of the housing shown in FIG. 139A.

Figure 139C:
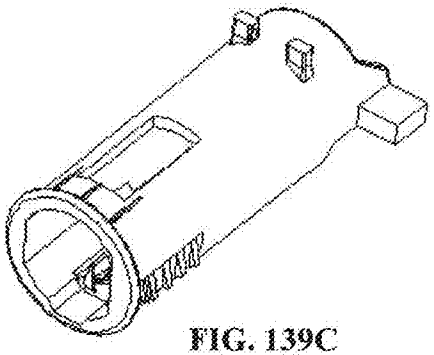

FIG. 139C is a third perspective view of the housing shown in FIG. 139A.

Figure 140:
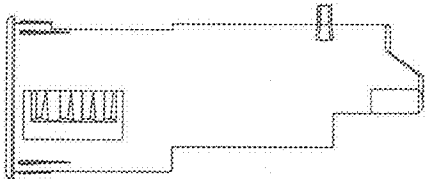

FIG. 140 is a first side view of the latch housing of FIG. 139A.

Figure 141:
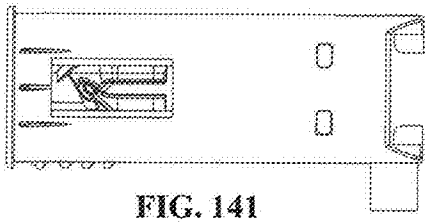

FIG. 141 is a top view of the latch housing of FIG. 139A.

Figure 141A:
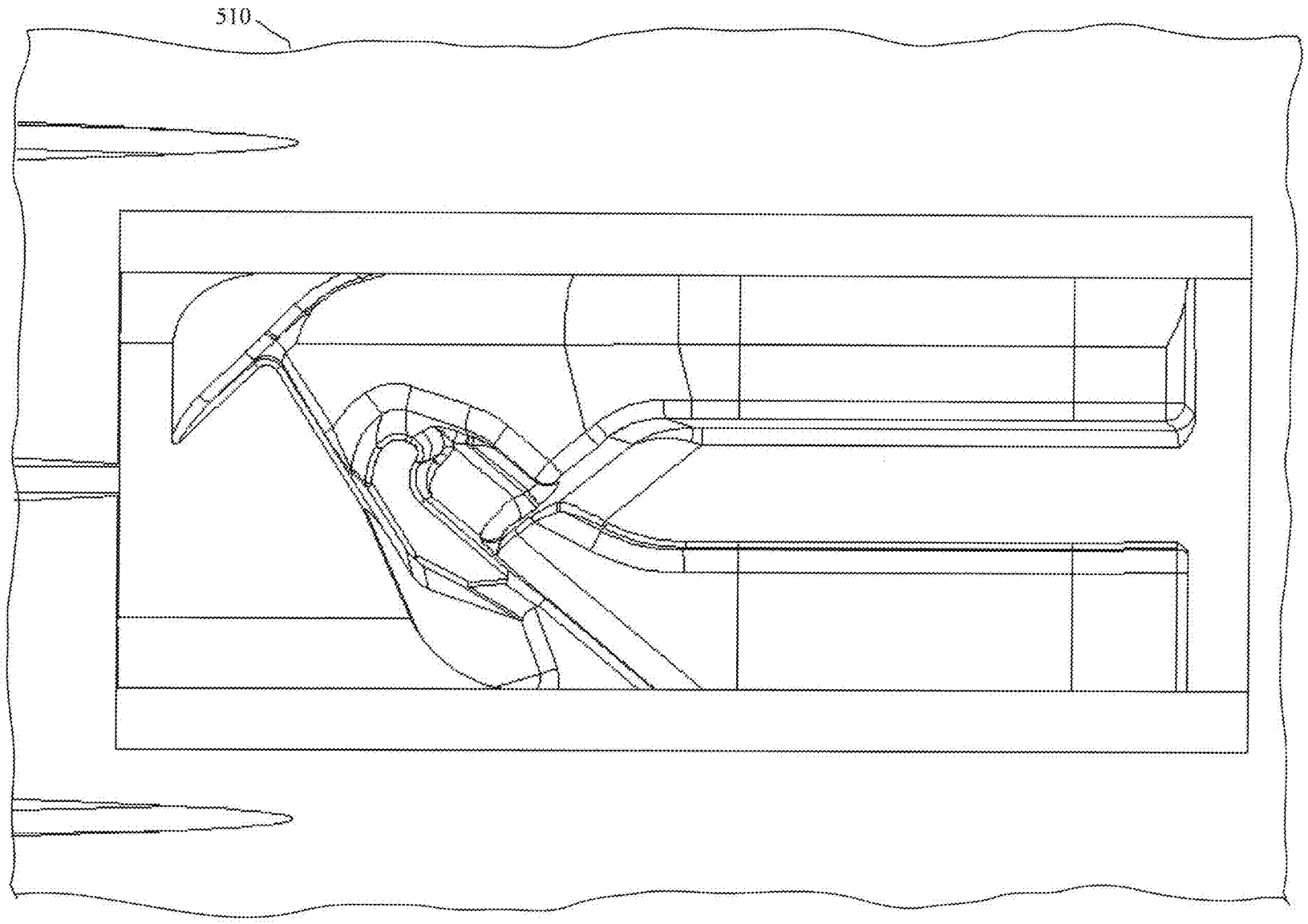

FIG. 141A is an detail view of an exposed interior portion of the latch housing, as shown in FIG. 141, to show an enlarged depiction of the contoured track formed therein.

Figure 142:
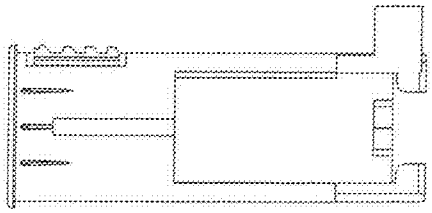

FIG. 142 is a bottom view of the latch housing of FIG. 139A.

Figure 143:
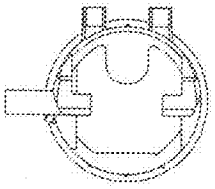

FIG. 143 is a first end view of the latch housing of FIG. 139A.

Figure 144:
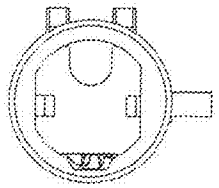

FIG. 144 is a second end view of the latch housing of FIG. 139A.

Figure 145:
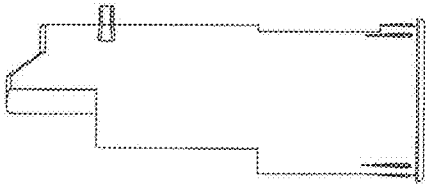

FIG. 145 is a second side view of the latch housing of FIG. 139A.

Figure 146:
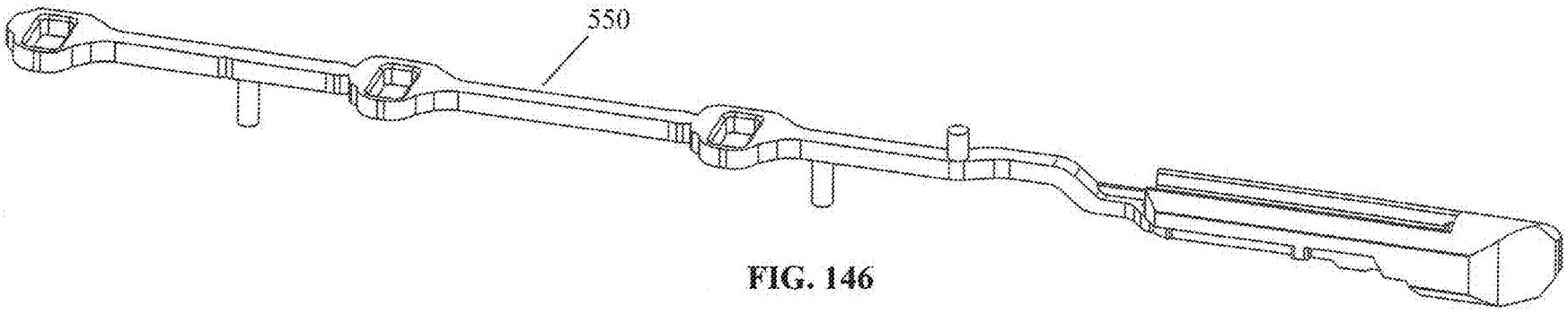

FIG. 146 is a first perspective view of a latch member used in the latch assembly of FIG. 137.

Figure 147:
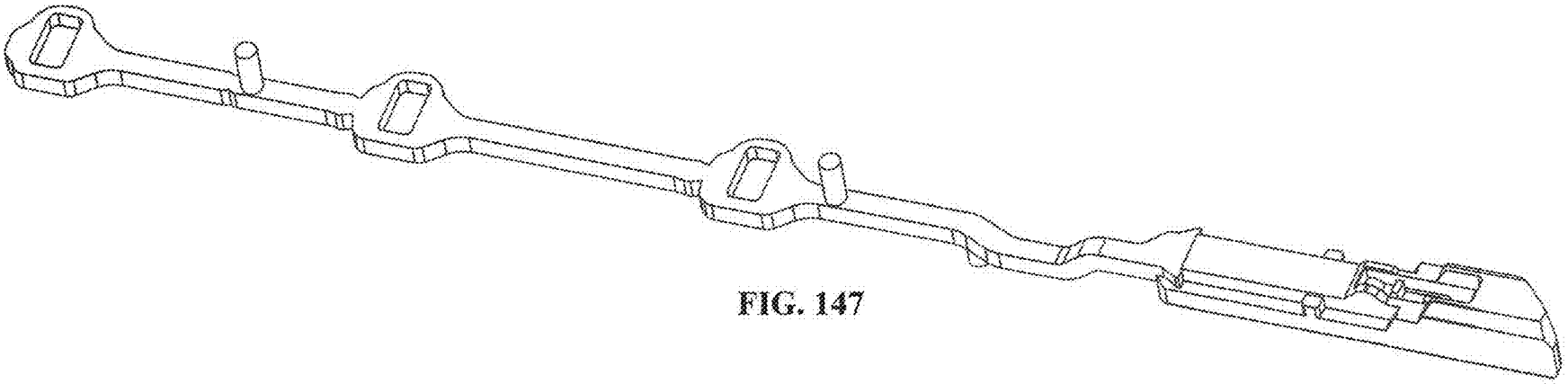

FIG. 147 is a second perspective view of the latch member shown in FIG. 146.

Figure 148:
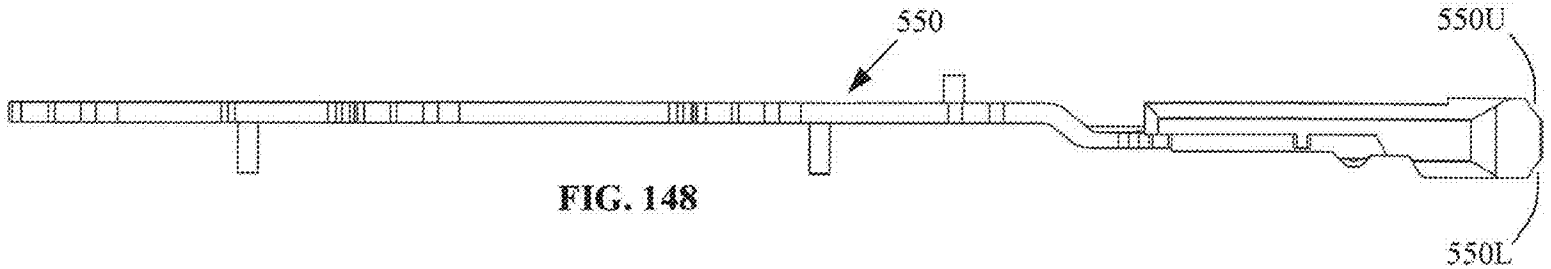

FIG. 148 is a first side view of the latch member of FIG. 146.

Figure 149:
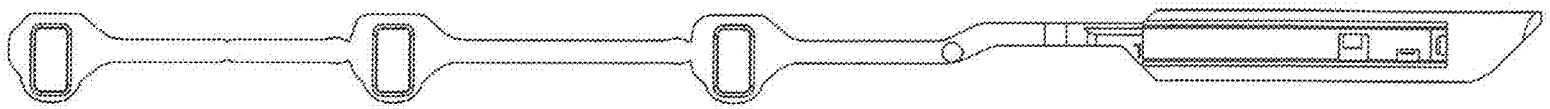

FIG. 149 is a top view of the latch member of FIG. 146.

Figure 150:
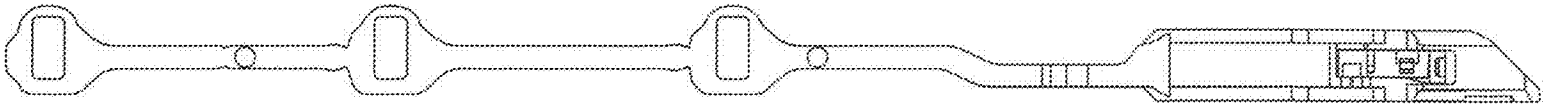

FIG. 150 is a bottom view of the latch member of FIG. 146.

Figure 150A:
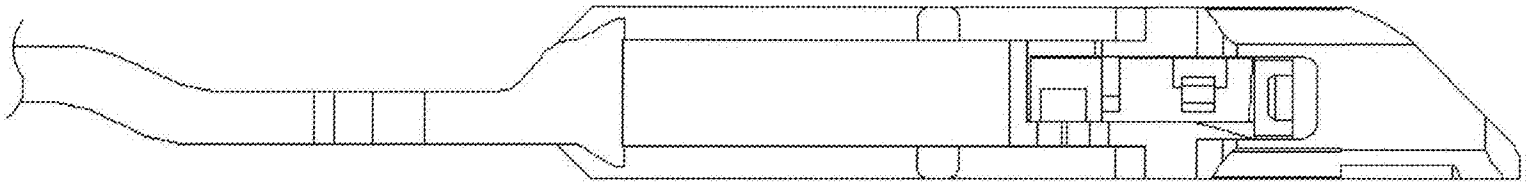

FIG. 150A is an enlarged detail view of one end of the latch member, as shown in FIG. 150.

Figure 151:
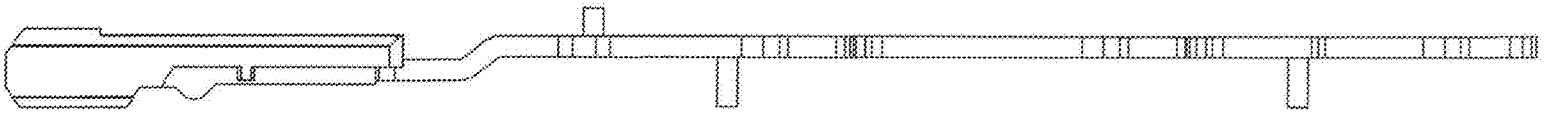

FIG. 151 is a second side view of the latch member of FIG. 146.

Figure 152:
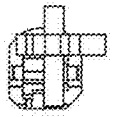

FIG. 152 is an end view of the latch member of FIG. 146.

Figure 153:
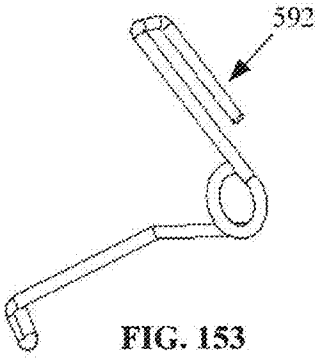

FIG. 153 is a perspective view of a flexible follower member of the latch assembly of FIG. 137.

Figure 154A:
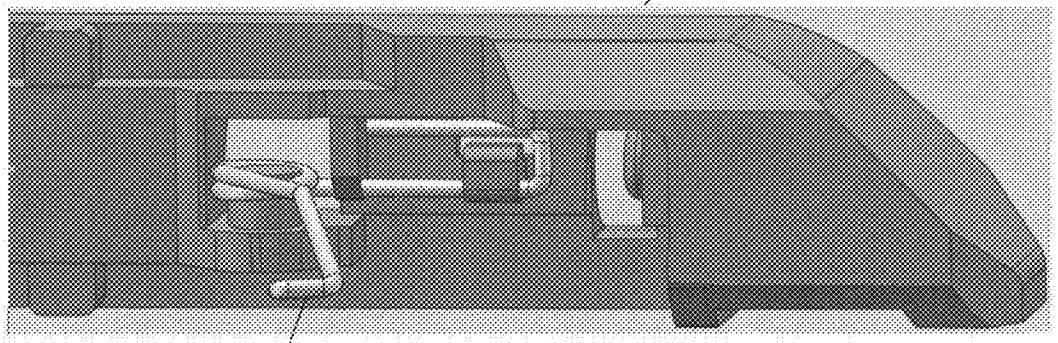
Figure 154:
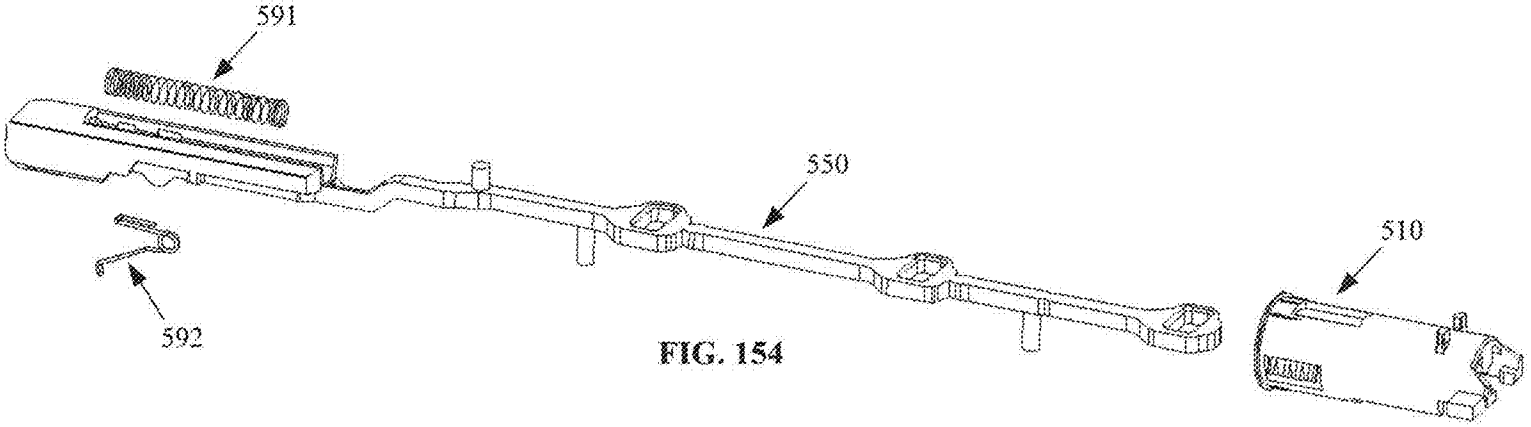

FIG. 154 is an exploded view of the parts of the latch assembly of FIG. 137, which includes the latch member of FIG. 146, the latch housing of FIG. 139A, and a helical spring used for biasing the latch member with respect to the latch housing.

FIG. 154A is a perspective view showing the flexible follower member of FIG. 153, after being installed into the end of the latch member.

Figure 155:
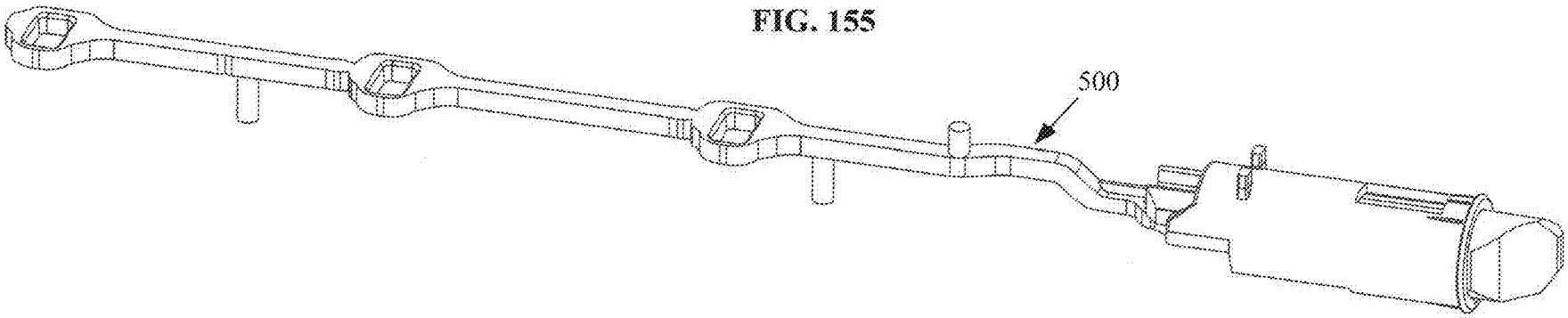

FIG. 155 is a perspective showing the latch member, the helical spring, the flexible follower member member, and the latch housing after being assembled together to form the latch assembly of FIG. 137, with the latch member shown biased into its extended position.

Figure 156:
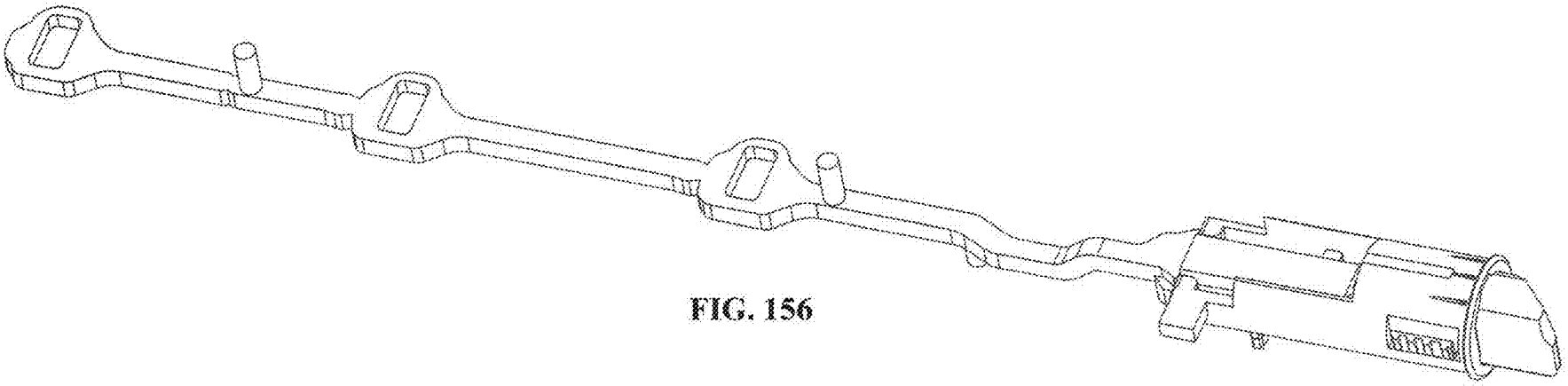

FIG. 156 is a second perspective view of the latch assembly of FIG. 137.

Figure 157:
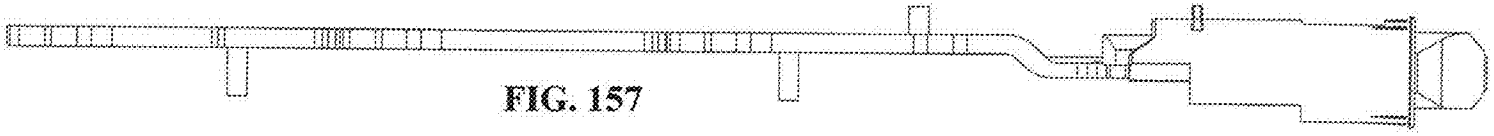

FIG. 157 is a first side view of the latch assembly of FIG. 137.

Figure 158:
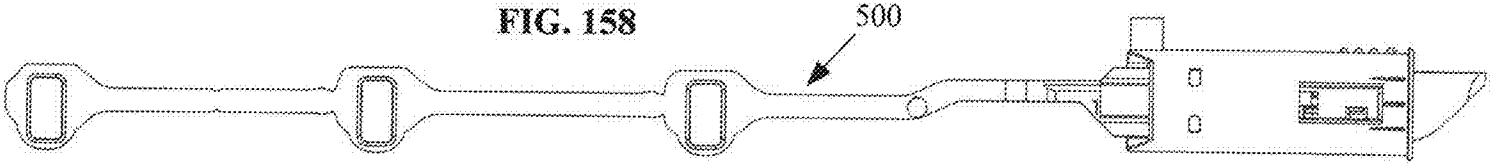

FIG. 158 is a top view of the latch assembly of FIG. 137.

Figure 159:
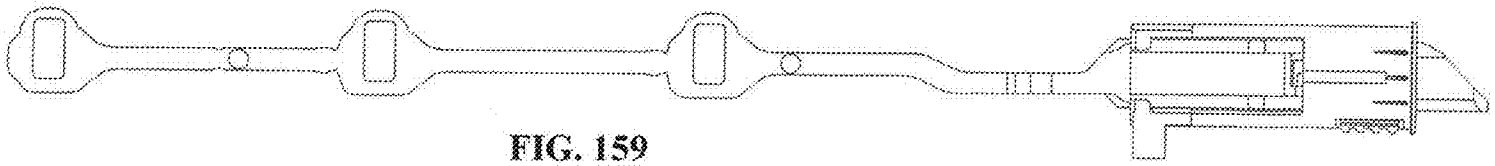

FIG. 159 is a bottom view of the latch assembly of FIG. 137.

Figure 160:
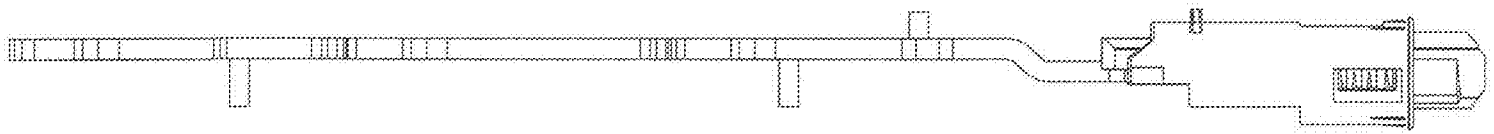

FIG. 160 is a second side view of the latch assembly shown in FIG. 137.

Figure 161:
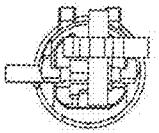

FIG. 161 is an end view of the latch member of FIG. 137.

Figure 162:
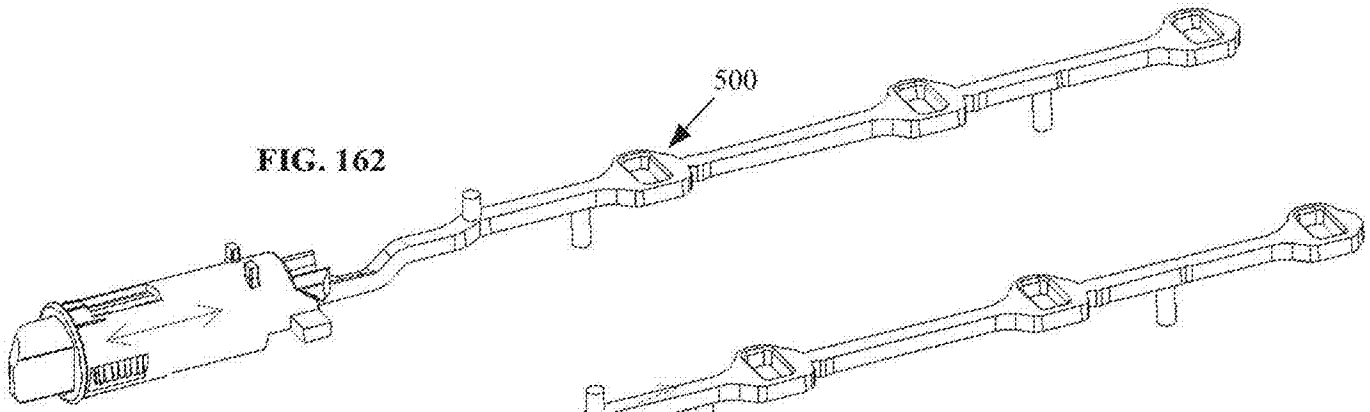

FIG. 162 is a perspective view of the latch assembly of FIG. 137, with the latch member shown biased into its extended position.

Figure 163:
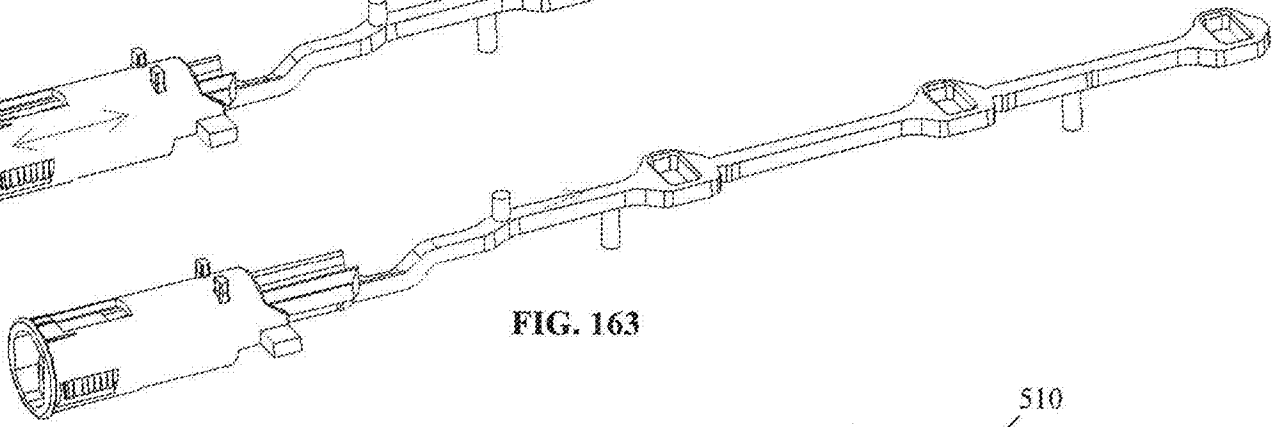

FIG. 163 is the perspective view of FIG. 162 but with the latch member shown in a fully retracted position.

Figure 164:
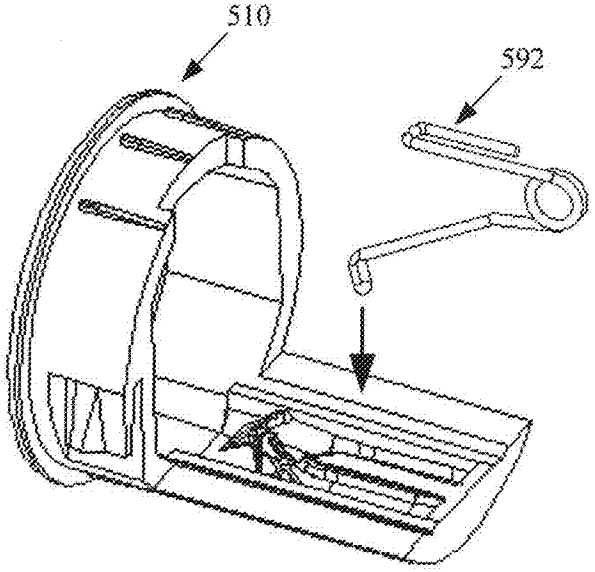

FIG. 164 is an exploded view illustrating the tip portion of the flexible follower member of FIG. 153 that is configured to engage the contoured track of the latch housing shown in detail in FIG. 141A, within the latch assembly of FIG. 163, which contoured track may act as a cam surface with respect to the flexible follower member.

FIG. 165 shows the tip portion of the flexible follower member of FIG. 153 engaged with a portion of the contoured track of the latch housing shown in FIG. 141A, and identifies several key points on the track.

FIG. 165A is a schematic illustration representing the portion of the track of FIG. 165 between point A and point B.

FIG. 165B is a schematic illustration representing the portion of the track of FIG. 165 between point B and point C.

FIG. 165C is a schematic illustration representing the portion of the track of FIG. 165 between point C and point D.

FIG. 165D is a schematic illustration representing the portion of the track of FIG. 165 between point D and point A.

FIG. 165E is a schematic illustration representing the portion of the track of FIG. 165 between point A and point B.

FIG. 166 is a first perspective view of the dual stepped stop with selective contoured surfaces formed thereon that is configured to be used in conjunction with the latch assembly of FIG. 137.

FIG. 167 is a second perspective view of the stepped stop of FIG. 166.

FIG. 168 is a third perspective view of the stepped stop of FIG. 166.

FIG. 169 is a rear view of the stepped stop of FIG. 166.

FIG. 170 is a first side view of the stepped stop of FIG. 166.

FIG. 171 is a second side view of the stepped stop of FIG. 166.

FIG. 172 is an end view of the stepped stop of FIG. 166.

Figure 173:
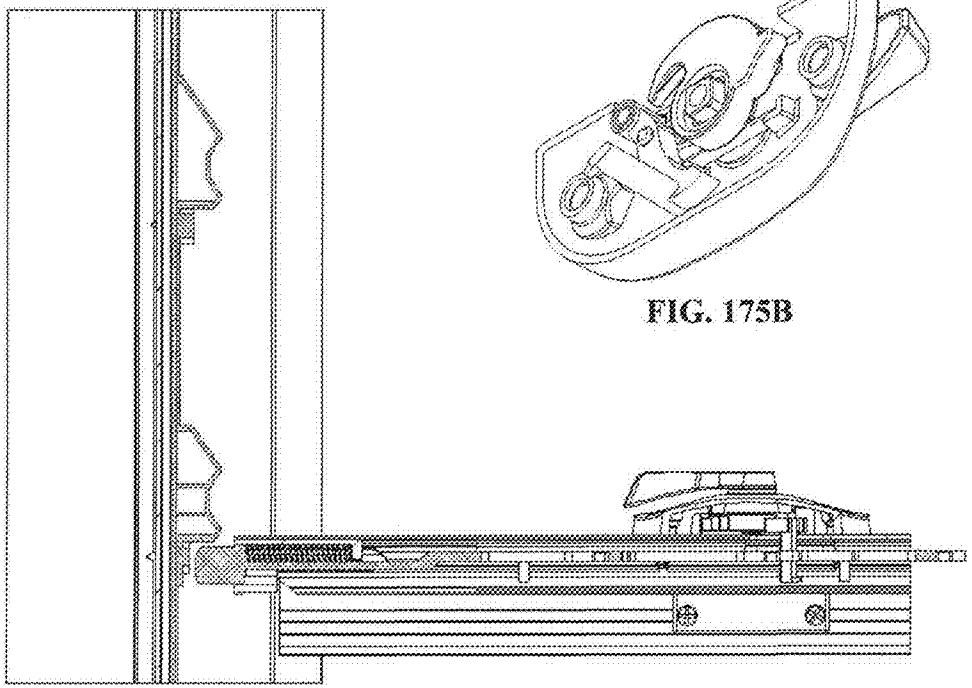

FIG. 173 is a cross-section through the sash window, the master window frame, the sash lock assembly, the tilt latch assembly, and the stepped stop of FIG. 166, and is shown with the cam of the sash lock assembly in the extended locked position, and the latch member in the corresponding extended position, to engage a first step of the stop and redundantly lock the window in the window closed position.

Figure 174:
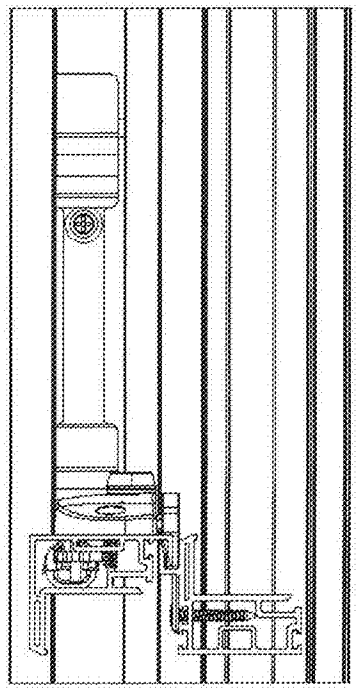

FIG. 174 is the cross-sectional view taken through the sash window, and also showing the stepped stop of FIG. 166 mounted within the track of the master window frame.

Figure 175A:
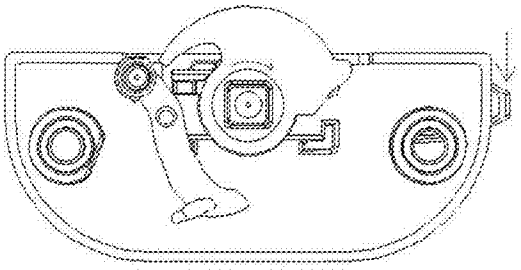

FIG. 175A is a bottom view of the sash lock assembly with the cam and shaft/handle member shown in the locked position, as seen in FIG. 174.

Figure 175B:
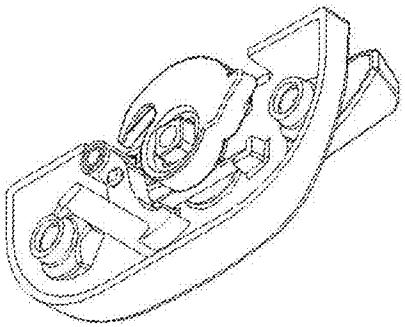

FIG. 175B is a perspective view of the sash lock assembly of FIG. 175A.

Figure 176:
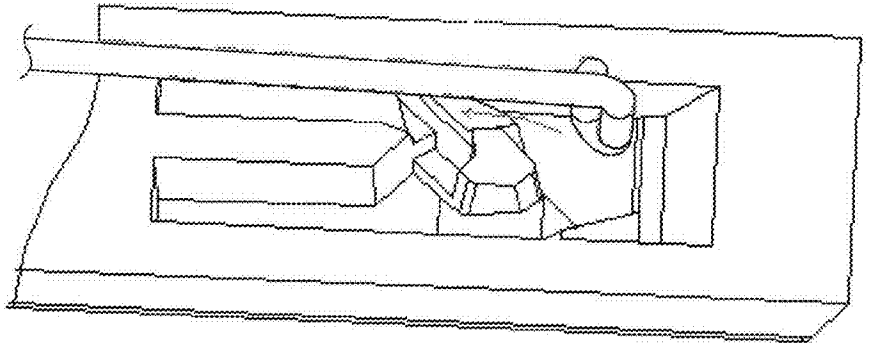

FIG. 176 shows a starting point of the tip portion of the flexible follower member of FIG. 153 on the contoured track of the latch housing shown in detail in FIG. 141A.

Figure 177:
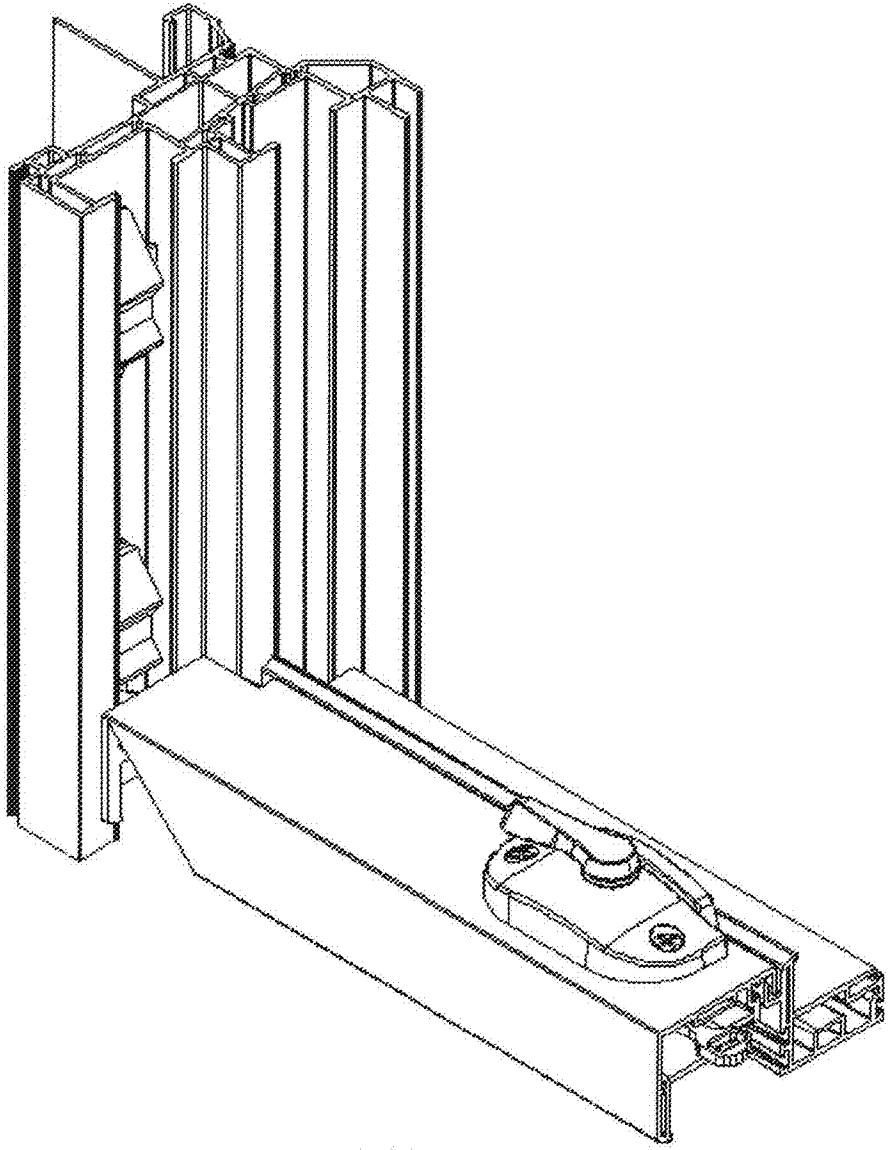

FIG. 177 is a perspective view of the arrangement shown in FIG. 173.

Figure 178:
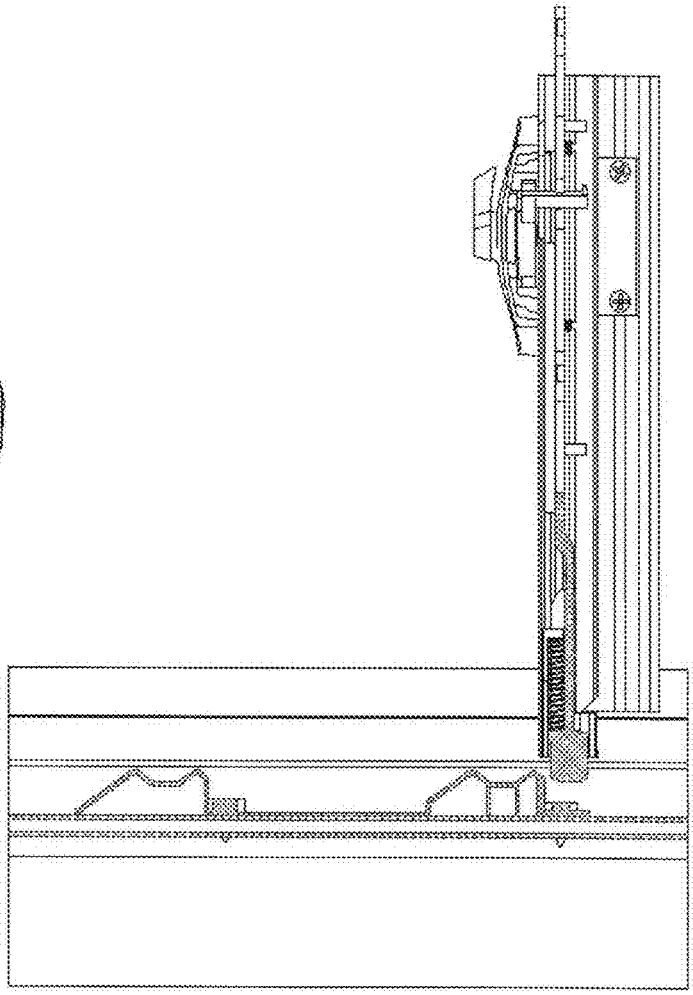

FIG. 178 is the cross-section of FIG. 173, but shown with the cam and shaft/handle member of the sash lock in the first retracted position (cam unlocked from the keeper), and with the latch member moved into a corresponding partially retracted position, which permits sliding movement of the window away from the window closed position to result in further retraction/movement of the latch member as it passes over various portions of the contoured surface of the first step of the dual stepped stop.

Figure 179:
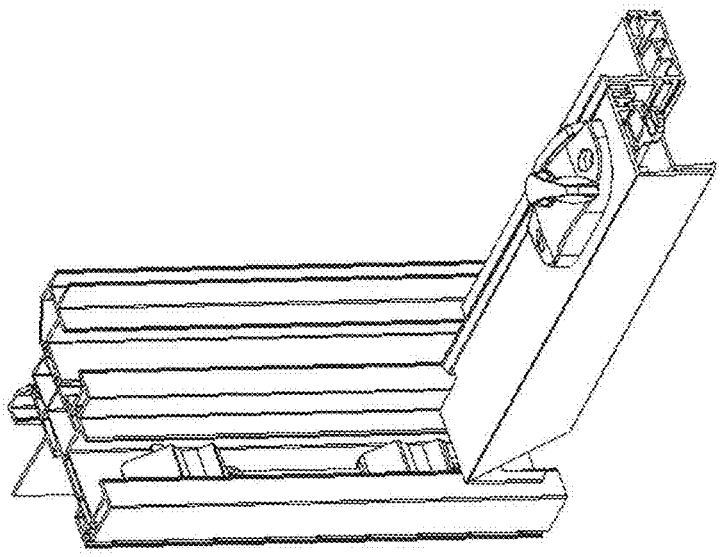

FIG. 179 is a perspective view of the arrangement shown in FIG. 178.

Figure 180:
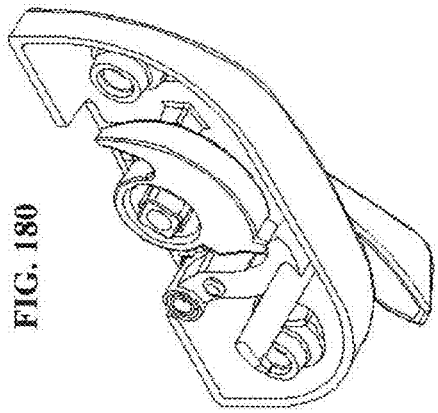

FIG. 180 is a perspective view of the sash lock assembly of FIG. 178.

Figure 181:
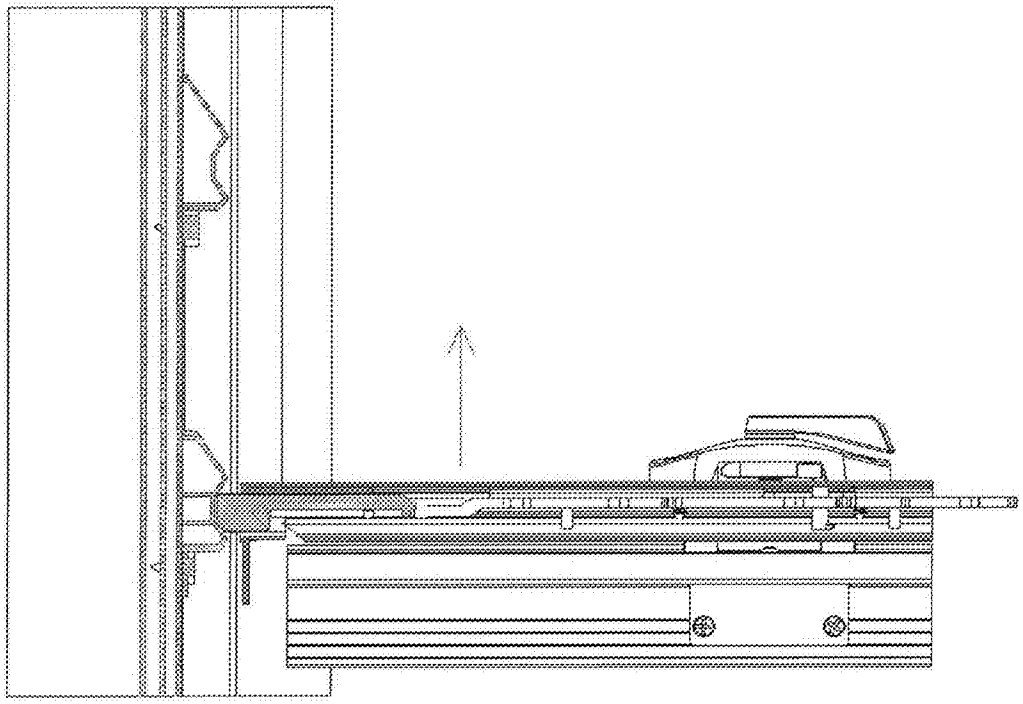

FIG. 181 is the cross-section of FIG. 178, but is shown with the sash window having been elevated slightly, for the latch member to contact another portion of the contoured surface of the first step of the dual stepped stop.

Figure 182:
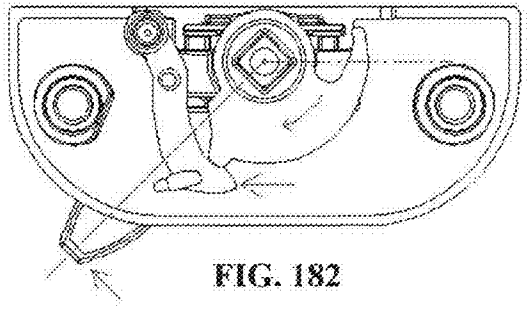

FIG. 182 is a bottom view of the sash lock assembly of FIG. 181.

Figure 183:
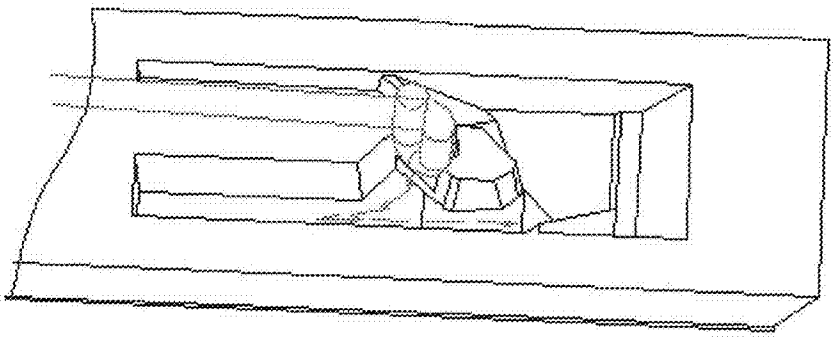

FIG. 183 shows the position of the tip portion of the flexible follower member on the contoured track that corresponds to the latch member position of FIG. 181.

Figure 184:
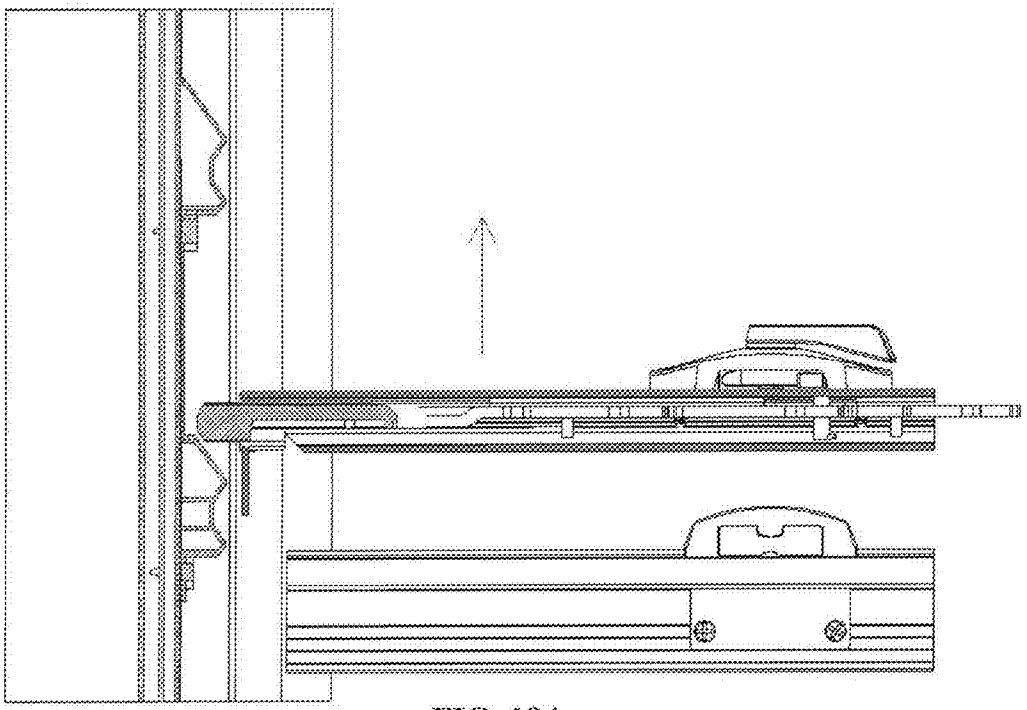

FIG. 184 is the cross-section of FIG. 181, but is shown with the sash window having been elevated further, for the latch member to move above the contoured surfaces of the first step of the dual stepped stop, and be distal therefrom.

Figure 185:
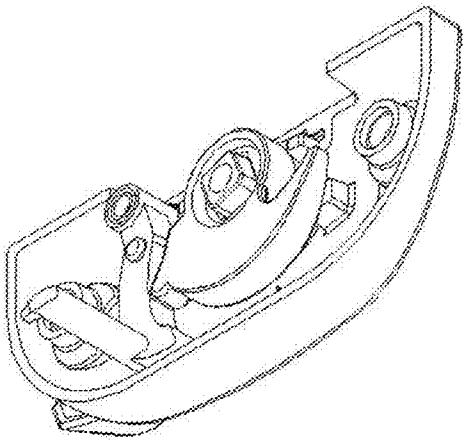

FIG. 185 is a perspective view of the sash lock assembly of FIG. 184.

Figure 186:
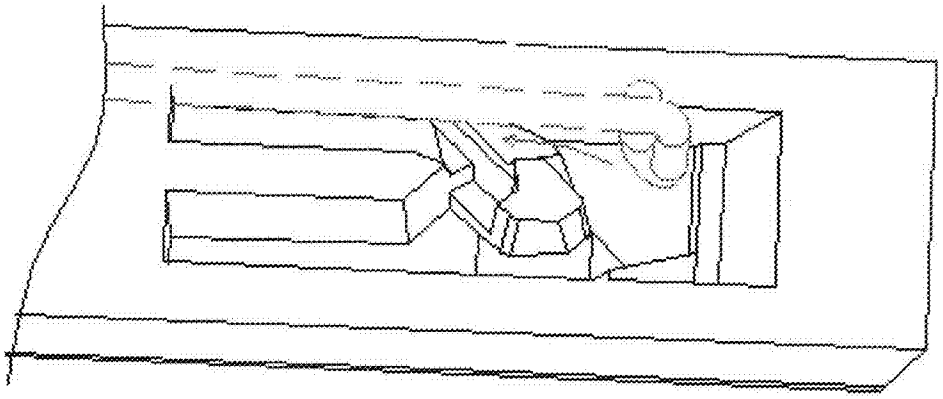

FIG. 186 shows the position of the tip portion of the flexible follower member on the contoured track that corresponds to the latch member position of FIG. 184.

Figure 187:
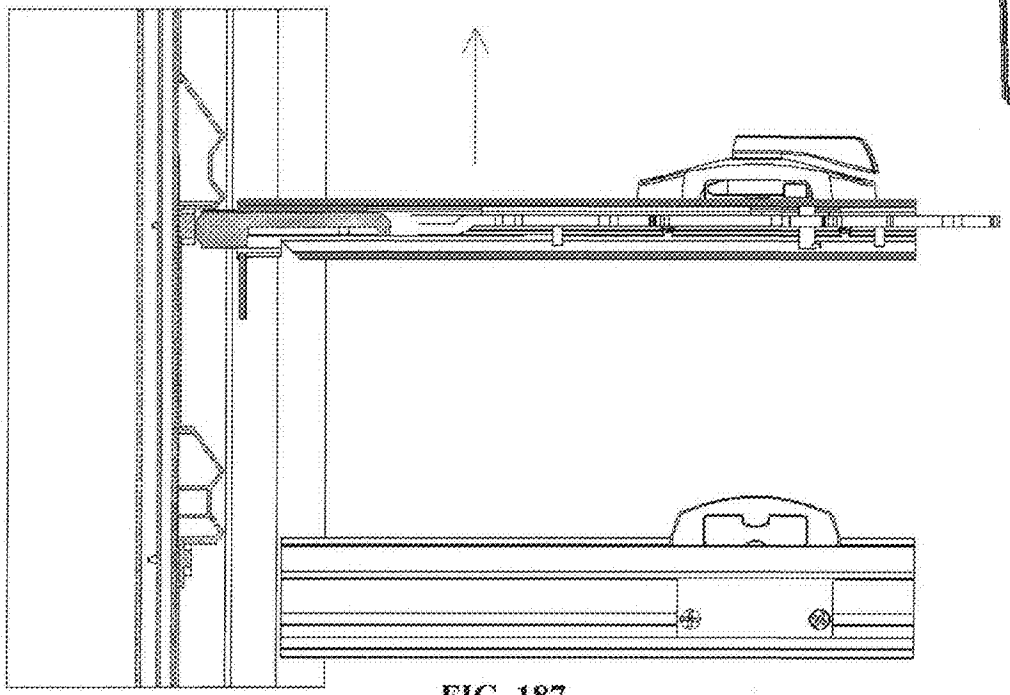

FIG. 187 is the cross-section of FIG. 184, but is shown with the sash window having been elevated further, and being shown with the fully extended latch member contacting the second step of the dual stepped stop, to act as a vent stop to releasably prevent further elevating of the window.

Figure 188:
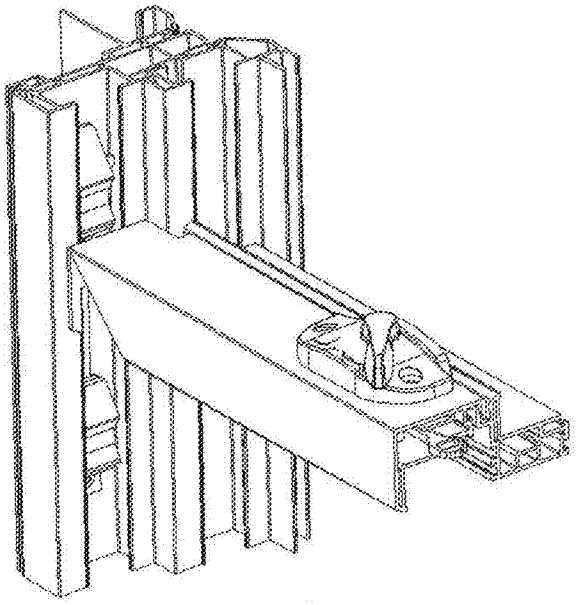

FIG. 188 is a perspective view of the arrangement shown in FIG. 187.

Figure 189:
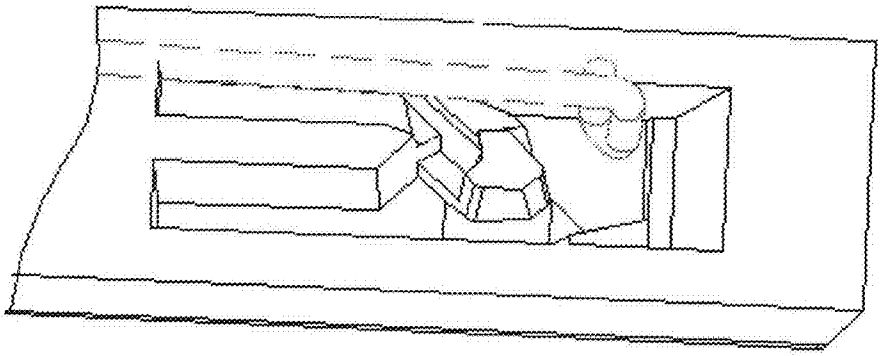

FIG. 189 shows the position of the tip portion of the flexible follower member on the contoured track that corresponds to the latch member position of FIG. 187.

Figure 190:
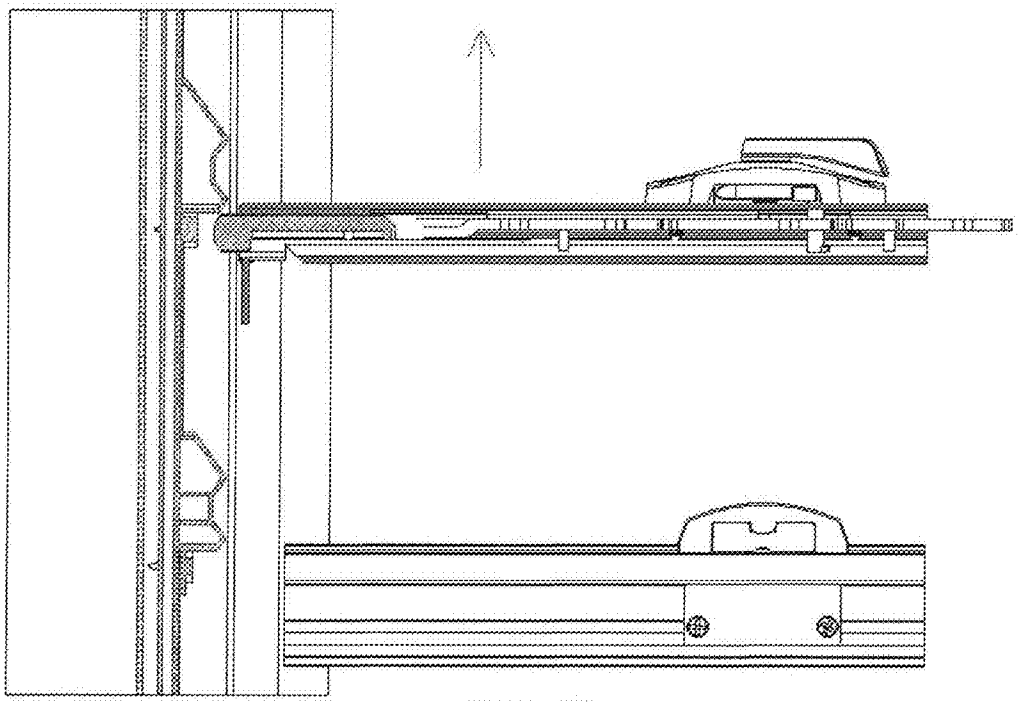

FIG. 190 is the cross-section of FIG. 187, but shown with the cam and shaft/handle member of the sash lock having been rotated for the latch member to again move into a partially retracted position, which permits further upward sliding movement of the window, and to result in further retraction/movement of the latch member as it passes over various portions of the contoured surface of the second step of the dual stepped stop.

Figure 191:
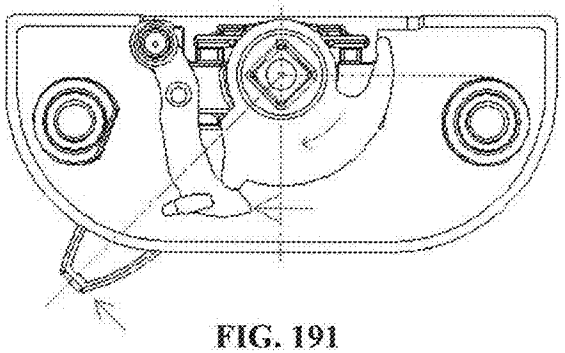

FIG. 191 is a bottom view of the sash lock assembly of FIG. 190.

Figure 192:
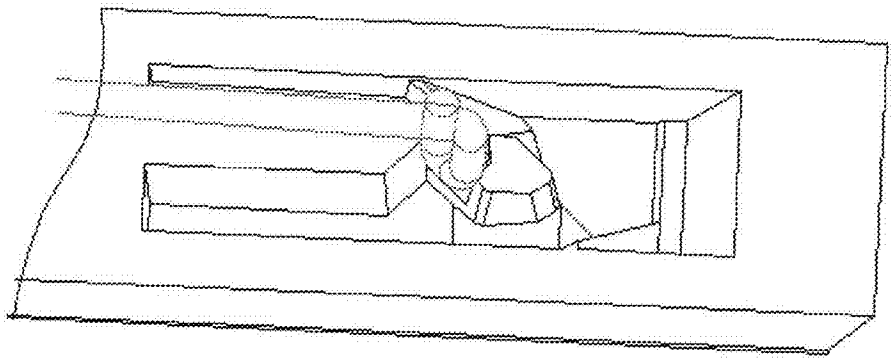

FIG. 192 shows the position of the tip portion of the flexible follower member on the contoured track that corresponds to the latch member position of FIG. 190.

Figure 193:
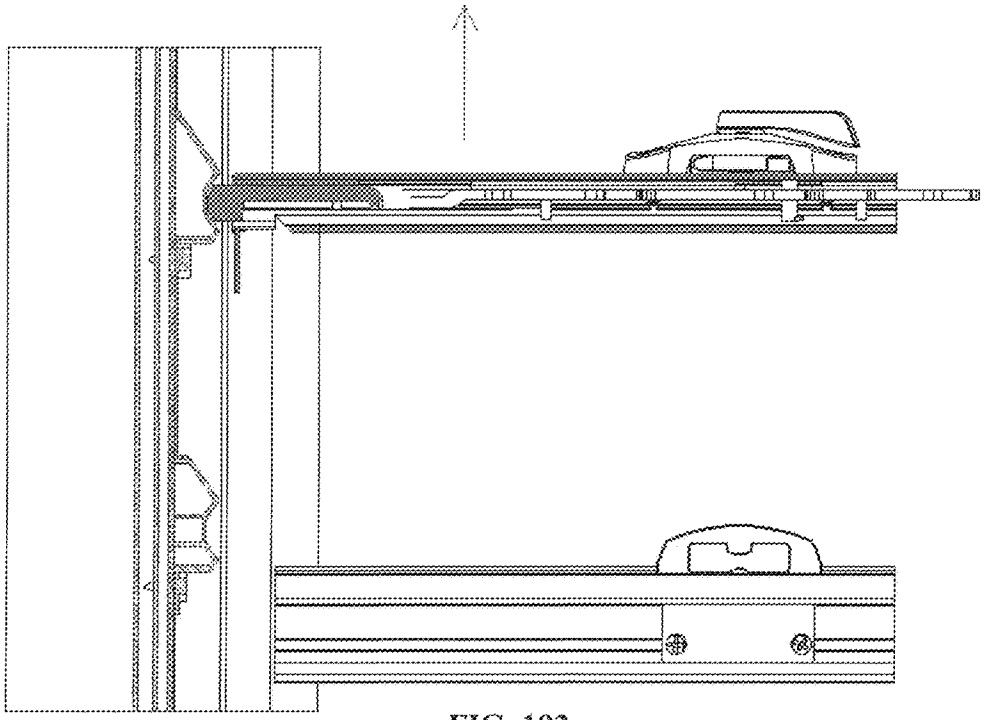

FIG. 193 is the cross-section of FIG. 190, but is shown with the sash window having been further elevated slightly, for the latch member to contact another portion of the contoured surface of the second step of the dual stepped stop.

Figure 194:
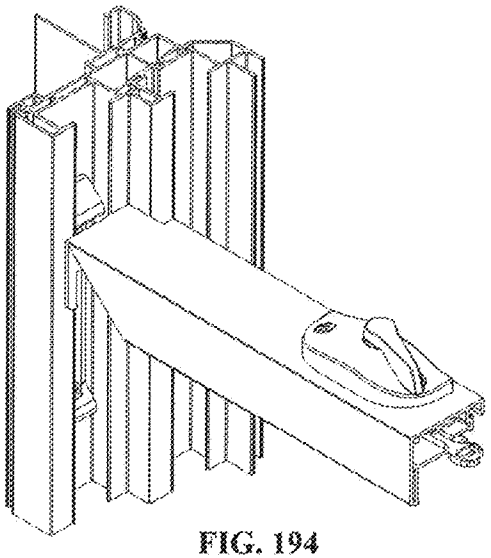

FIG. 194 is a perspective view of the arrangement shown in FIG. 193.

Figure 195:
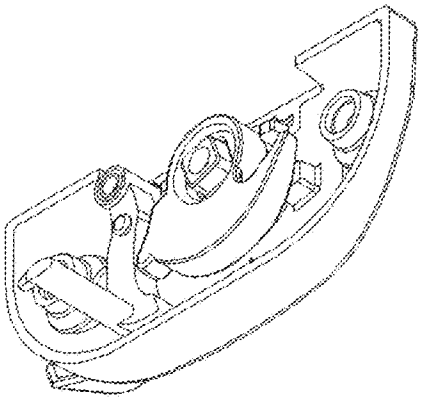

FIG. 195 is a perspective view of the sash lock assembly of FIG. 193.

Figure 196:
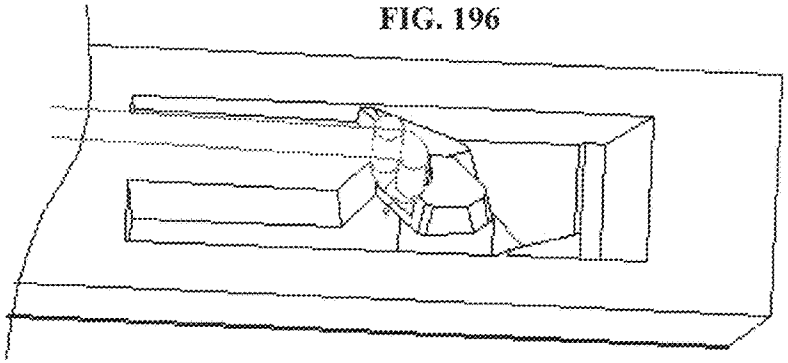

FIG. 196 shows the position of the tip portion of the flexible follower member on the contoured track that corresponds to the latch member position of FIG. 193.

Figures 197, 198:
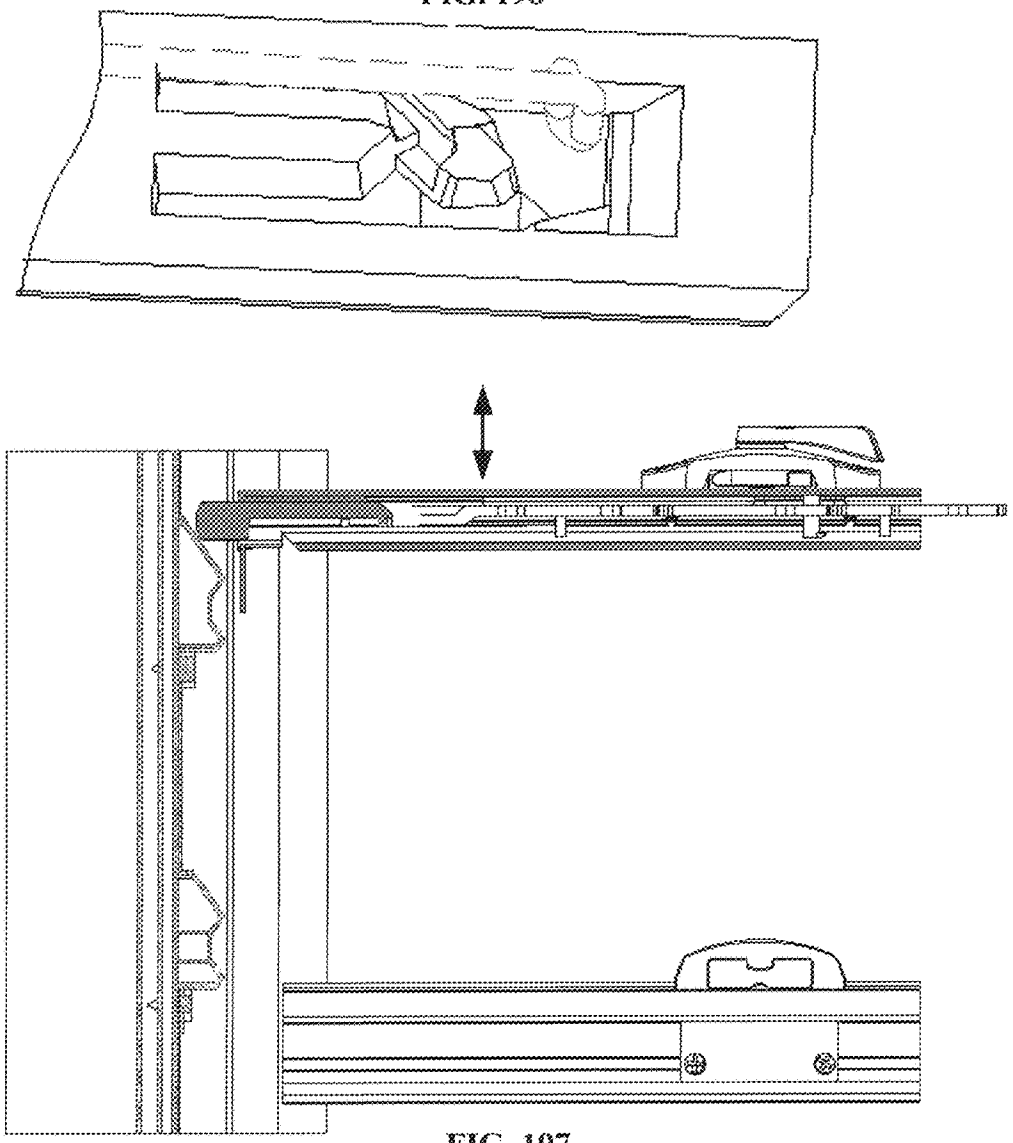

FIG. 197 is the cross-section of FIG. 193, but is shown with the sash window having been elevated further, for the latch member to move above the contoured surfaces of the second step of the dual stepped stop, and be distal therefrom, permitting uninhibited movement of the sash window into a fully open window position.

FIG. 198 shows the position of the tip portion of the flexible follower member on the contoured track that corresponds to the latch member position of FIG. 197.

Figure 199:
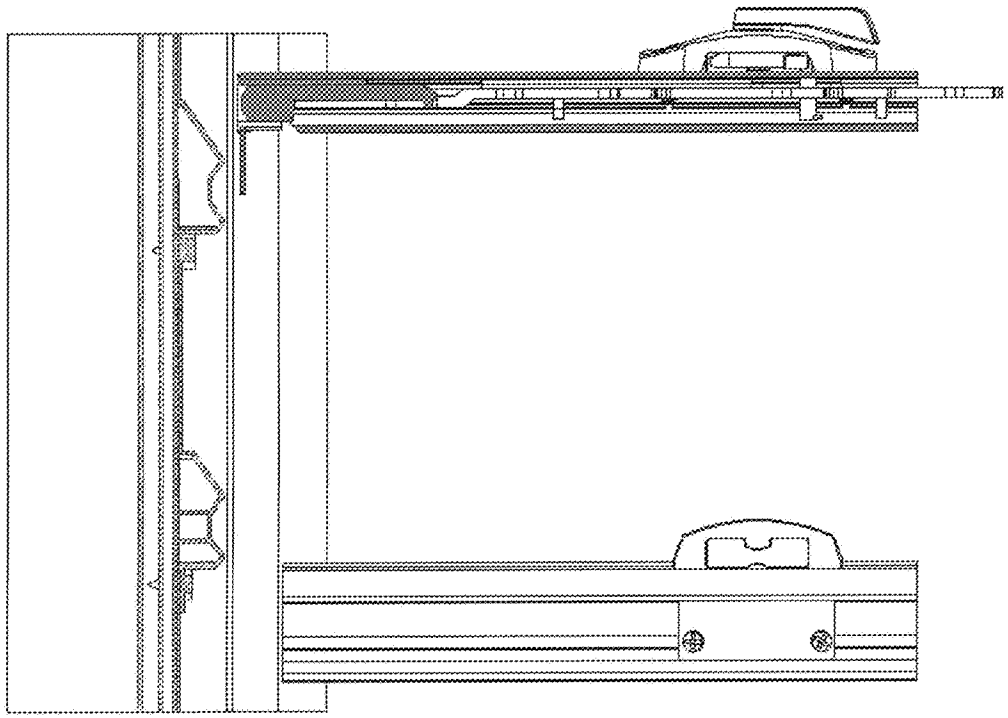

FIG. 199 is the cross-section of FIG. 199, but is shown with the cam and shaft/handle member of the sash lock having been rotated into the 180 degree position of FIG. 138D, for the latch member to fully retract within the latch housing, which permits tilting of the sash window out of the master window frame.

Figure 200:
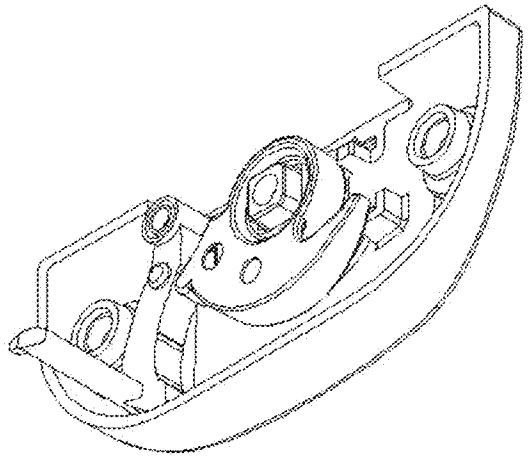

FIG. 200 is a perspective view of the sash lock assembly of FIG. 199.

Figure 201:
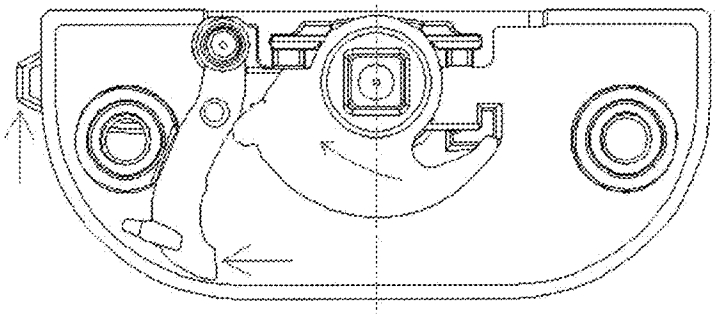

FIG. 201 is a bottom view of the sash lock assembly of FIG. 199.

Figure 202:
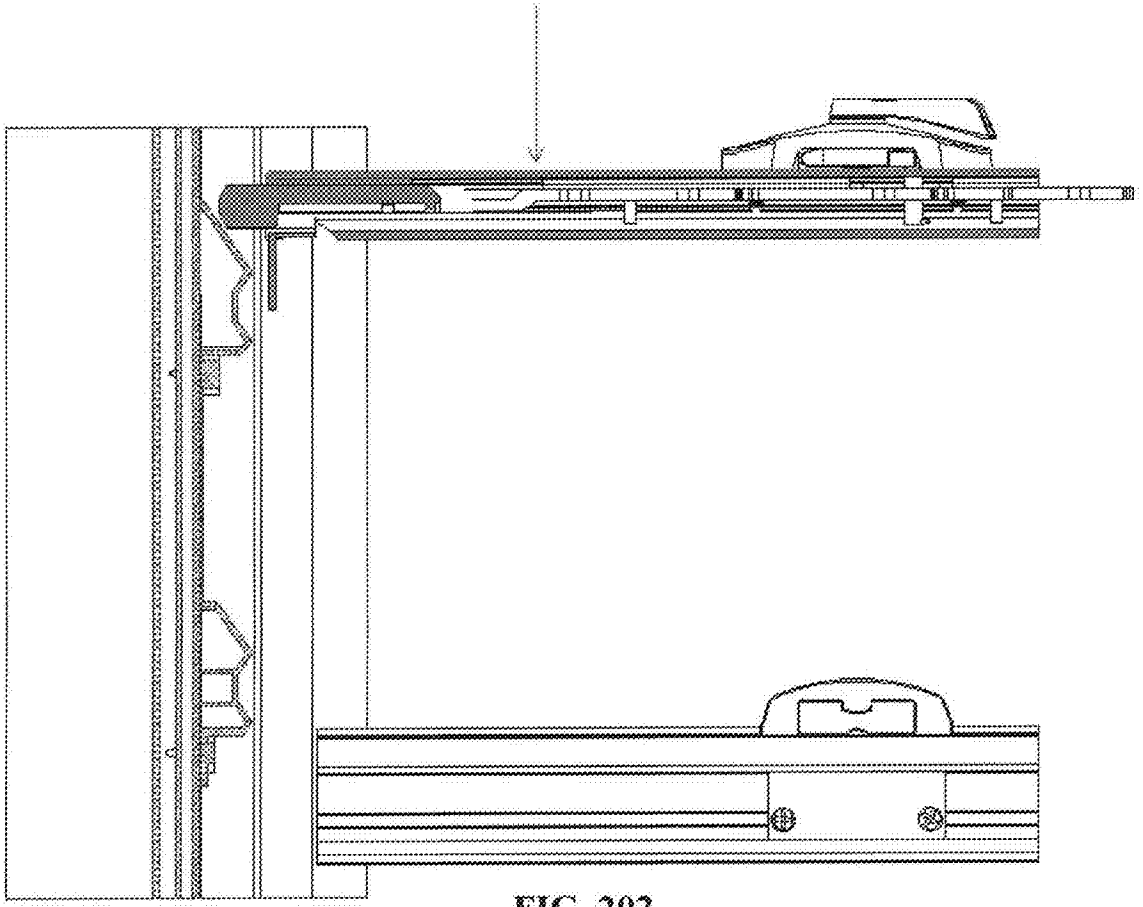

FIG. 202 is the same as the cross-section of FIG. 197, but is shown with a downward pointing arrow indicating the sash window may be freely slid down toward the window closed position.

Figure 203:
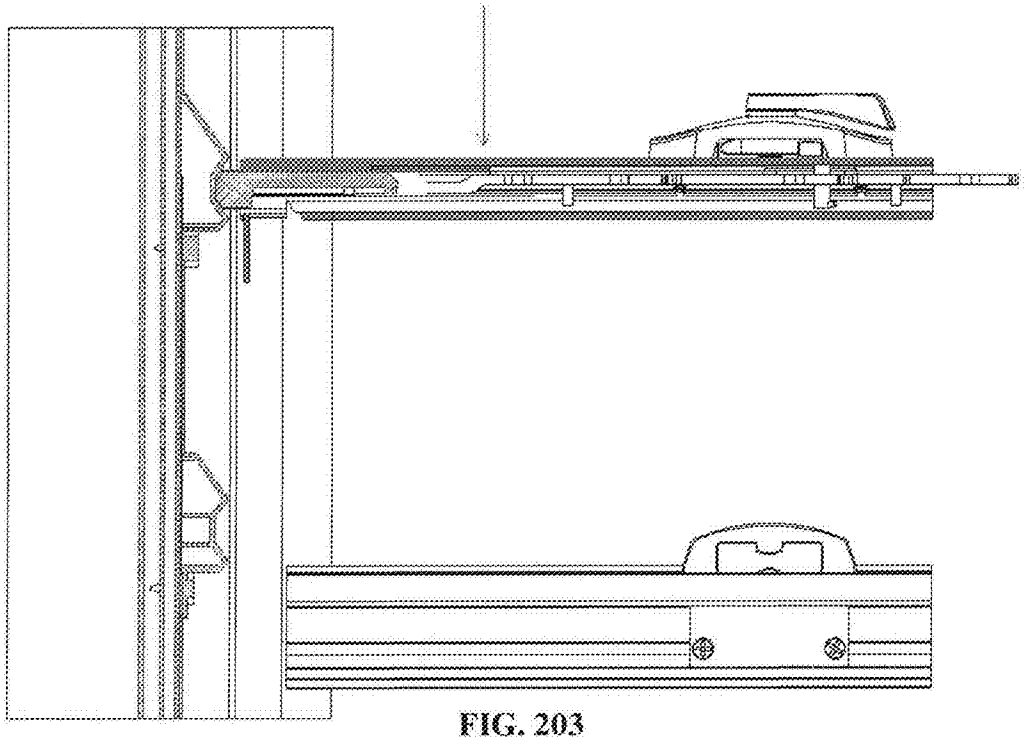

FIG. 203 is the same as the cross-section of FIG. 193, but is shown with a downward pointing arrow indicating the sash window may be freely slid down even further toward the window closed position.

Figure 204:
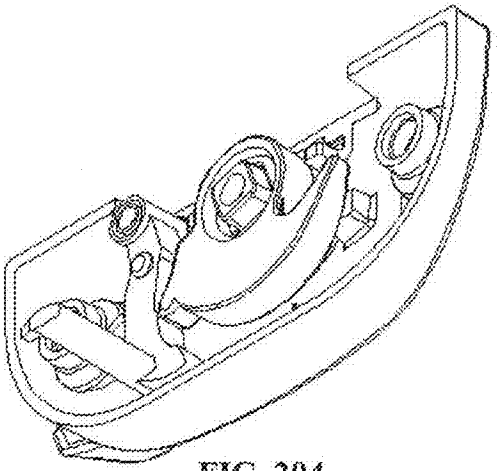

FIG. 204 is a perspective view of the sash lock assembly of FIG. 203.

Figure 205:
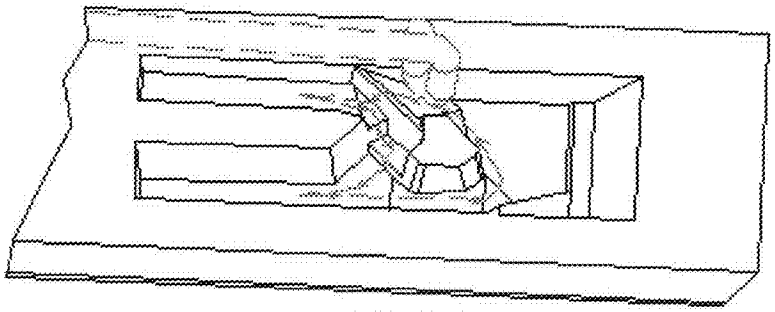

FIG. 205 shows the position of the tip portion of the flexible follower member on the contoured track that corresponds to the latch member position of FIG. 204.

Figure 206:
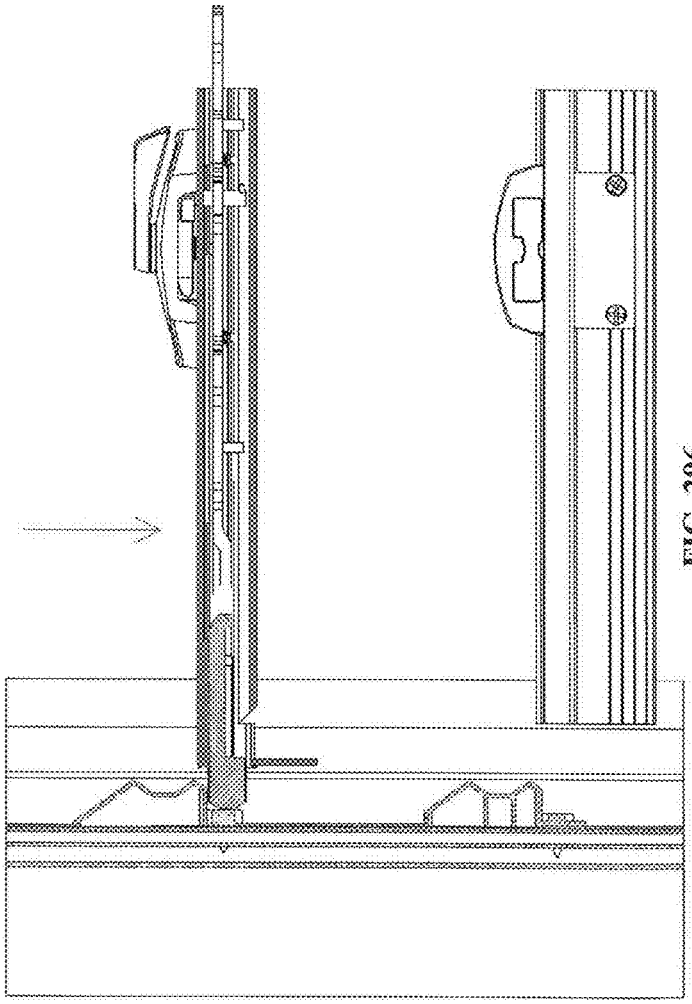

FIG. 206 is the same as the cross-section of FIG. 187, where upward movement of the sash window is inhibited by the position of the tongue of the latch member below the second step of the stop member, but is shown with a downward pointing arrow indicating the sash window may be freely slid down even further toward the window closed position.

Figure 207:
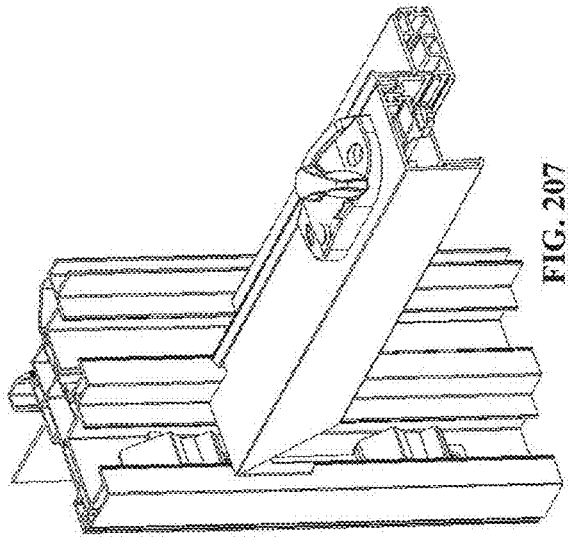

FIG. 207 is a perspective view of the arrangement shown in FIG. 206.

Figure 208:
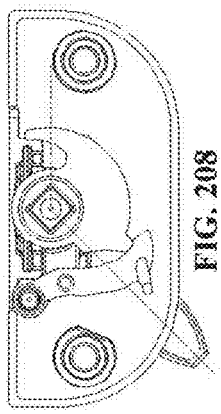

FIG. 208 is a bottom view of the sash lock assembly of FIG. 206.

Figure 209:
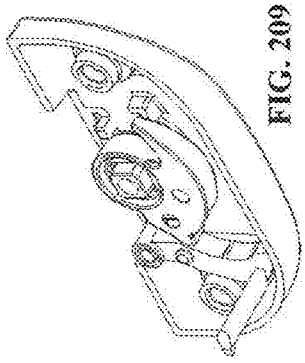

FIG. 209 is a perspective view of the sash lock assembly of FIG. 206.

Figure 210:
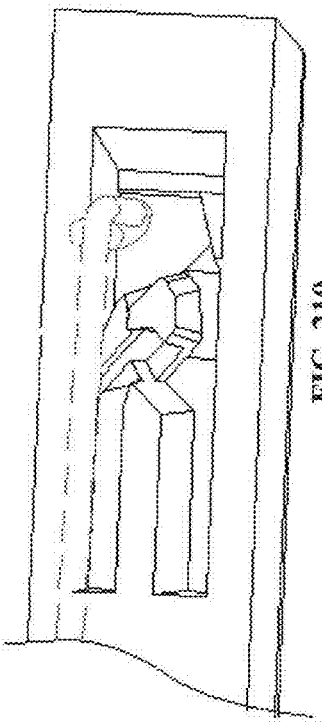

FIG. 210 shows the position of the tip portion of the flexible follower member on the contoured track that corresponds to the latch member position of FIG. 206.

Figure 211:
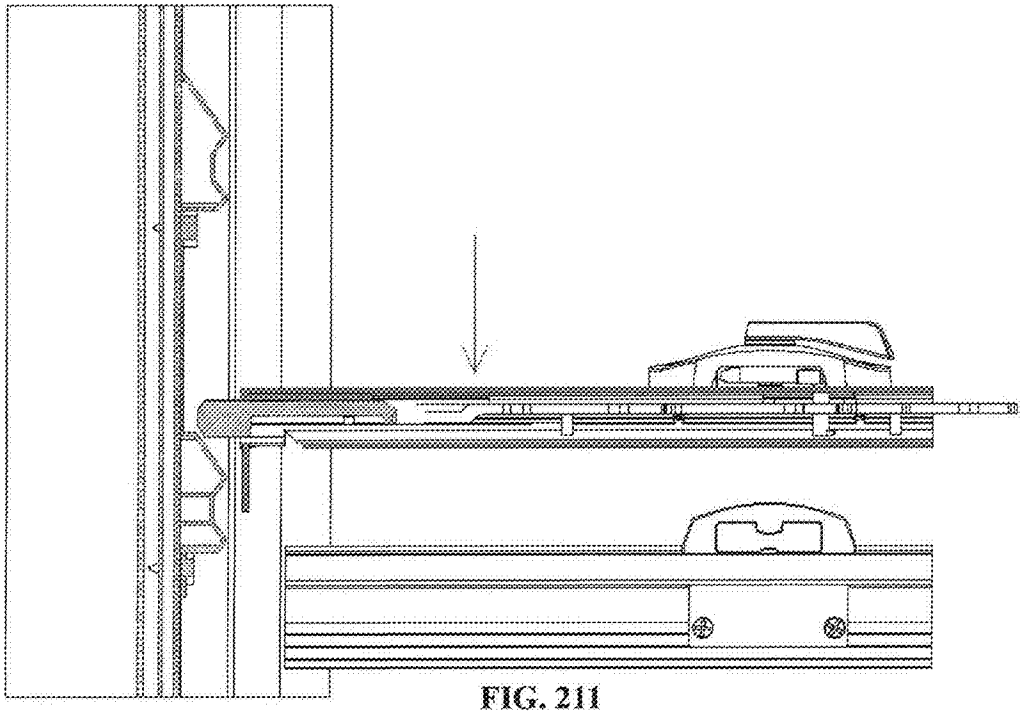

FIG. 211 is the same as the cross-section of FIG. 184, but is shown with a downward pointing arrow indicating the sash window may be freely slid down even further toward the window closed position.

Figure 212:
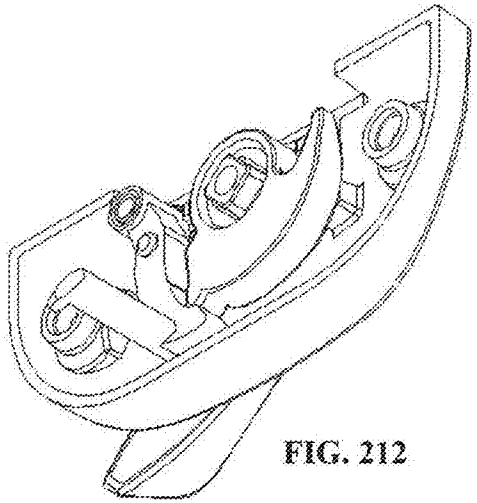

FIG. 212 is a perspective view of the sash lock assembly of FIG. 211.

Figure 213:
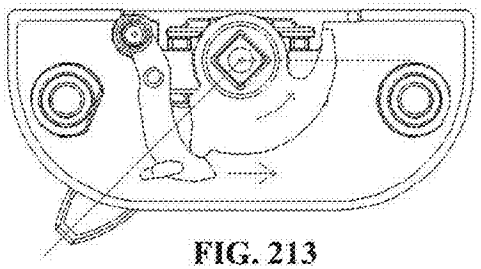

FIG. 213 is a bottom view of the sash lock assembly of FIG. 211.

Figure 214:
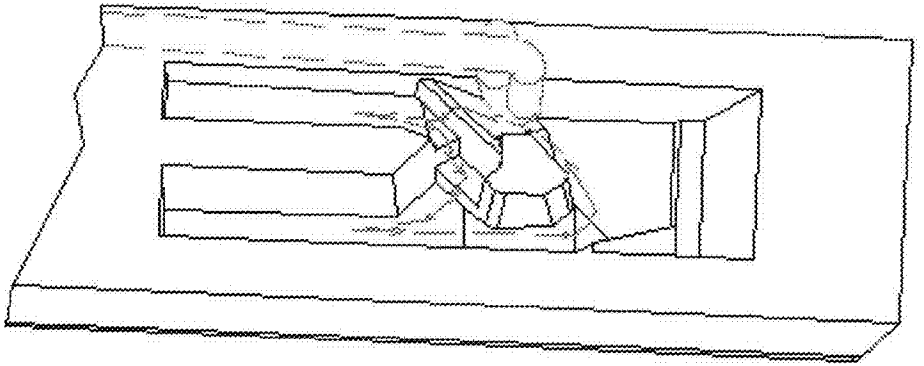

FIG. 214 shows the position of the tip portion of the flexible follower member on the contoured track that corresponds to the latch member position of FIG. 211.

Figure 216:
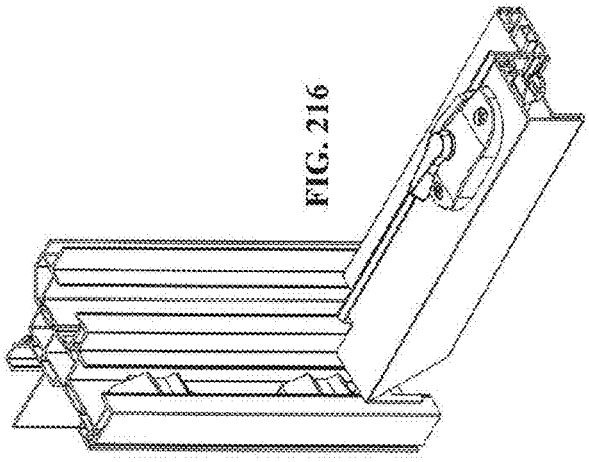
Figure 215:
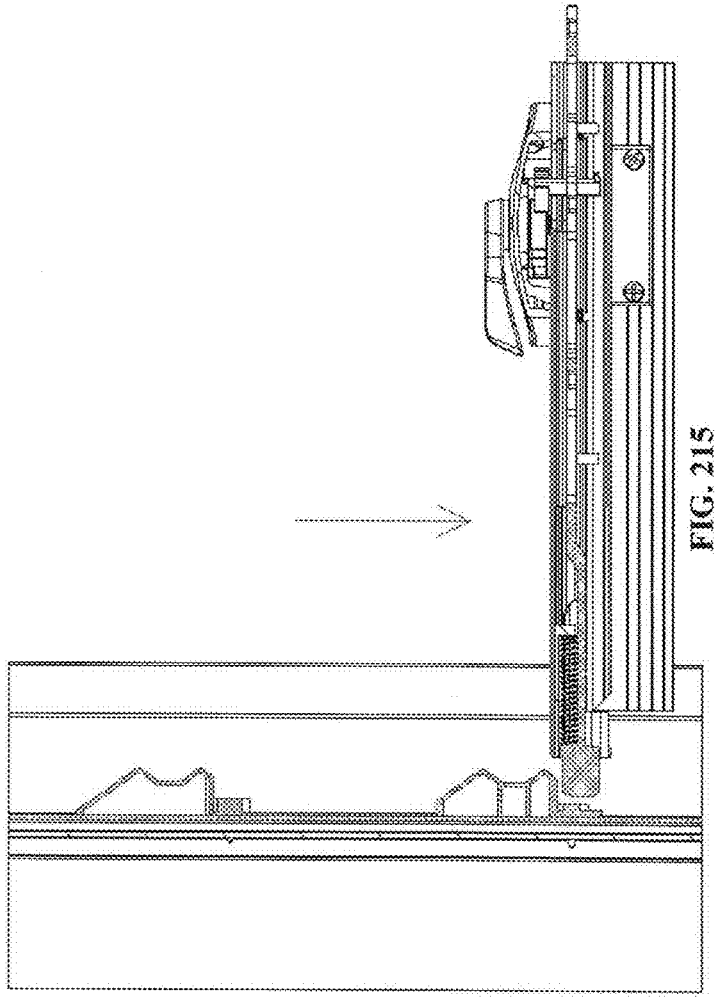

FIG. 215 is the same as the cross-section of FIG. 173 after the sash window had been moved down from an elevated position, as indicated by the downward pointing arrow, and with the cam and shaft/handle member of the sash lock having been rotated into the zero degree position, for the cam to again be in the extended locked position, and the latch member to again be in the corresponding extended position, to engage a first step of the stop and redundantly lock the window in the window closed position FIG. 216 is a perspective view of the arrangement of FIG. 215.

Figure 217:
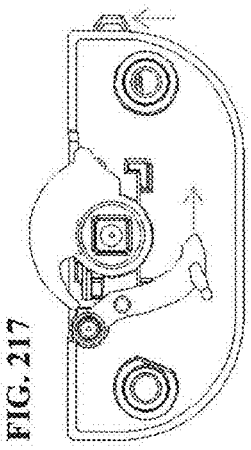

FIG. 217 is a bottom view of the sash lock assembly of FIG. 215.

Figure 218:
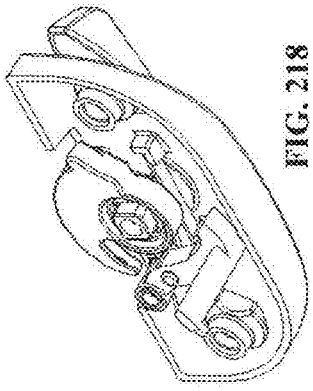

FIG. 218 is a perspective view of the sash lock assembly of FIG. 215.

Figure 219:
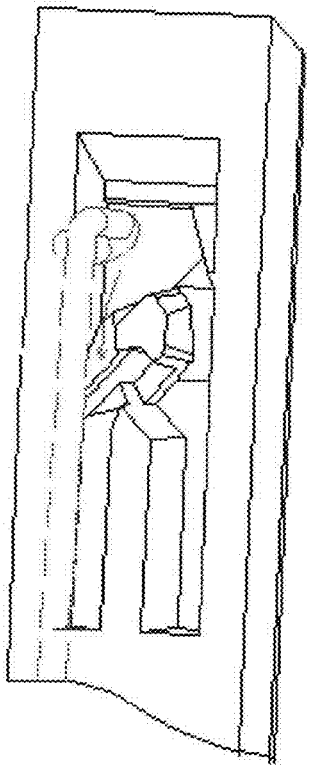

FIG. 219 shows the position of the tip portion of the flexible follower member on the contoured track that corresponds to the latch member position of FIG. 215.

FIG. 220A is the bottom view of the sash lock assembly, as shown in FIG. 138A, and which shows the cam/handle in the extended lock position, and the lever arm biased into its rest position by the latch member of the latch assembly.

FIG. 220B is a side view showing the tongue portion of the latch member of the latch assembly in the extended position that corresponds to the cam/handle position of FIG. 220A, with the tongue portion located below the bottom stop surface of the lower protrusion of the stepped stop member, to redundantly lock the sash window when in the closed window position of FIG. 173.

FIG. 220C shows contact of the tip of the flexible follower member of the latch assembly with the contoured track of the latch housing, which contact position corresponds to the latch member position of FIG. 220B.

FIG. 221A is the bottom view of FIG. 220A, but is shown with the cam/handle having been rotated roughly 130 degrees into an intermediate position, to drive movement of the lever arm into a corresponding intermediate position.

FIG. 221B is the side view of FIG. 220B, showing the tongue portion of the latch member of the latch assembly having been retracted part-way towards its fully retracted position, to correspond with the cam/handle position of FIG. 221A, with the tongue portion located clear of the bottom stop surface of the lower protrusion of the stepped stop member, but still engaged within the track of the master window frame.

FIG. 221C shows contact of the tip of the flexible follower member of the latch assembly with the contoured track of the latch housing, which contact position corresponds to the latch member position of FIG. 221B.

FIG. 222A is the bottom view of FIG. 221A, but is shown with the cam/handle having been rotated a total of 135 degrees into a retracted unlock position, to permit corresponding movement of the lever arm into a cocked trigger position.

FIG. 222B is the side view of FIG. 221B, showing the tongue portion of the latch member of the latch assembly having extended slightly to occupy a partially extended trigger (cocked) position, which position corresponds with the cam/handle position of FIG. 222A, with the upper curved/angled surface of the tongue portion being located adjacent to the bottom stop surface of the lower protrusion of the stepped stop member.

FIG. 222C shows engagement of the tip of the flexible follower member of the latch assembly within a nested portion of the contoured track of the latch housing, which contact position corresponds to the latch member position of FIG. 222B.

FIG. 223A is the bottom view of FIG. 222A, shown with the cam/handle still occupying the retracted unlock position (i.e., rotated a total of 135 degrees), but showing the lever arm having been rotated slightly away from contact with the cam, as a result of movement imparted to the tongue of the latch member through its contact with the bottom stop surface of the lower protrusion of the stepped stop member, as the sash window has begun to be slid open.

FIG. 223B is the side view of FIG. 222B, showing the tongue portion of the latch member of the latch assembly retracting as a result of the upper curved/angled surface of the tongue portion following the angled/curved bottom stop surface of the lower protrusion of the stepped stop member.

FIG. 223C shows contact of the tip of the flexible follower member with the contoured track of the latch housing of the latch assembly, just after having been triggered to exit the nested portion of the track, which exit position corresponds to the latch member position of FIG. 223B.

FIG. 224A is the bottom view of FIG. 223A, shown with the cam/handle still occupying the retracted unlock position (i.e., rotated a total of 135 degrees), but showing the lever arm having been rotated further away from contact with the cam, as a result of additional movement imparted to the tongue of the latch member through its continued contact with the bottom stop surface of the lower protrusion of the stepped stop member, as the sash window is opened further.

FIG. 224B is the side view of FIG. 223B, showing the tongue portion of the latch member of the latch assembly having been driven to retract to its furthest-most retracted position as a result of its contact with the most distal location of the bottom stop surface of the lower protrusion of the stepped stop member.

FIG. 224C shows contact of the tip of the flexible follower member of the latch assembly with the contoured track of the latch housing, which contact position corresponds to the latch member position of FIG. 224B.

FIG. 225A is the bottom view of FIG. 224A, shown with the cam/handle still occupying the retracted unlock position (i.e., rotated a total of 135 degrees), but showing the lever arm having counter-rotated slightly back towards its contact position with the cam, as a result the tongue portion of the latch member extending into contact with a recessed surface of the lower protrusion of the stepped stop member, as the sash window continues to be opened further.

FIG. 225B is the side view of FIG. 224B, showing the tongue portion of the latch member of the latch assembly having extended into contact with the recessed surface of the lower protrusion of the stepped stop member.

FIG. 225C shows contact of the tip of the flexible follower member of the latch assembly with the contoured track of the latch housing, which contact position corresponds to the latch member position of FIG. 225B.

FIG. 226A is the bottom view of FIG. 225A, shown with the cam/handle still occupying the retracted unlock position (i.e., rotated a total of 135 degrees), but showing the lever arm having again been rotated further away from contact with the cam, as a result of additional movement imparted to the tongue of the latch member through its contact with an upper portion of the recessed surface of the lower protrusion of the stepped stop member, as the sash window is opened further.

FIG. 226B is the side view of FIG. 225B, showing the tongue portion of the latch member of the latch assembly having again been driven to retract to its furthest-most retraction position as a result of its contact with the upper portion of the recessed surface of the lower protrusion of the stepped stop member.

FIG. 226C shows contact of the tip of the flexible follower member of the latch assembly with the contoured track of the latch housing, which contact position corresponds to the latch member position of FIG. 226B.

FIG. 227A is the bottom view of FIG. 226A, but is shown after the cam/handle has been driven from the retracted unlock position to only be rotated a total of roughly 123 degrees from its lock position, as a result of the lever arm having again been driven by the latch member, which results from the latch member being biased into its fully extended position once the sash window is opened sufficiently for the tongue portion of the latch member to be clear of (above) the lower protrusion of the stepped stop member.

FIG. 227B is the side view of FIG. 226B, showing the tongue portion of the latch member of the latch assembly having been biased into its fully extended position after the window is opened sufficiently for the tongue portion of the latch member to be clear of (above) the lower protrusion of the stepped stop member.

FIG. 227C shows contact of the tip of the flexible follower member of the latch assembly with the contoured track of the latch housing, which contact position corresponds to the latch member position of FIG. 227B, and which shows that the tip has finished one complete circuit around the track, which has steps and surfaces that are configured to selectively direct the tip unidirectionally around the track.

FIG. 228A is the bottom view of FIG. 227A, with the cam/handle positioning being unchanged as a result of the sash window being opened further.

FIG. 228B is the side view of FIG. 227B, showing the tongue portion of the latch member of the latch assembly still in its fully extended position, but being positioned immediately below the upper protrusion, which limits further opening of the window and acts as a vent stop.

FIG. 228C shows contact of the tip of the flexible follower member of the latch assembly with the contoured track of the latch housing, which contact position corresponds to the latch member position of FIG. 228B.

FIG. 229A is the bottom view of FIG. 227A, but is shown after the cam/handle has been rotated by hand to be at the 130 degree intermediate position also shown within FIG. 221A, to similarly drive movement of the lever arm into the corresponding intermediate position.

FIG. 229B is the side view of FIG. 228B, showing the tongue portion of the latch member of the latch assembly having been retracted part-way towards its fully retracted position, to correspond with the cam/handle position of FIG. 229A, with the tongue portion located clear of the bottom stop surface of the lower protrusion of the stepped stop member, but still engaged within the track of the master window frame.

FIG. 229C shows contact of the tip of the flexible follower member of the latch assembly with the contoured track of the latch housing, which contact position corresponds to the latch member position of FIG. 229B.

FIG. 230A is the bottom view of FIG. 229A, but is shown after the cam/handle has been further rotated by hand to again be back in the retracted unlock position (i.e., a total of 135 degrees of rotation), to again permit corresponding movement of the lever arm into a cocked trigger position.

FIG. 230B is the side view of FIG. 229B, showing the tongue portion of the latch member of the latch assembly having extended slightly to occupy a partially extended trigger (cocked) position, which position corresponds with the cam/handle position of FIG. 230A, with the upper curved/angled surface of the tongue portion being located adjacent to the bottom stop surface of the upper protrusion of the stepped stop member.

FIG. 230C shows engagement of the tip of the flexible follower member of the latch assembly within a nested portion of the contoured track of the latch housing, which contact position corresponds to the latch member position of FIG. 230B.

FIG. 231A is the bottom view of FIG. 230A, shown with the cam/handle still occupying the retracted unlock position (i.e., rotated a total of 135 degrees), but showing the lever arm having been rotated slightly away from contact with the cam, as a result of movement imparted to the tongue of the latch member through its contact with the bottom stop surface of the upper protrusion of the stepped stop member, as the sash window is opened further.

FIG. 231B is the side view of FIG. 230B, showing the tongue portion of the latch member of the latch assembly retracting as a result of the upper curved/angled surface of the tongue portion following the angled/curved bottom stop surface of the upper protrusion of the stepped stop member.

FIG. 231C shows contact of the tip of the flexible follower member with the contoured track of the latch housing of the latch assembly, just after having been triggered to exit the nested portion of the track, which exit position corresponds to the latch member position of FIG. 231B.

FIG. 232A is the bottom view of FIG. 231A, shown with the cam/handle still occupying the retracted unlock position (i.e., rotated a total of 135 degrees), but showing the lever arm having been rotated further away from contact with the cam, as a result of additional movement imparted to the tongue of the latch member through its continued contact with the bottom stop surface of the upper protrusion of the stepped stop member, as the sash window is opened further.

FIG. 232B is the side view of FIG. 231B, showing the tongue portion of the latch member of the latch assembly having been driven to retract to its furthest-most retraction position as a result of its contact with the most distal location of the bottom stop surface of the upper protrusion of the stepped stop member.

FIG. 232C shows contact of the tip of the flexible follower member of the latch assembly with the contoured track of the latch housing, which contact position corresponds to the latch member position of FIG. 232B.

FIG. 233A is the bottom view of FIG. 232A, shown with the cam/handle still occupying the retracted unlock position (i.e., rotated a total of 135 degrees), but showing the lever arm having counter-rotated slightly back towards its contact position with the cam, as a result the tongue portion of the latch member extending into contact with a recessed surface of the upper protrusion of the stepped stop member, as the sash window continues to be opened further.

FIG. 233B is the side view of FIG. 232B, showing the tongue portion of the latch member of the latch assembly having extended into contact with the recessed surface of the upper protrusion of the stepped stop member.

FIG. 233C shows contact of the tip of the flexible follower member of the latch assembly with the contoured track of the latch housing, which contact position corresponds to the latch member position of FIG. 233B.

FIG. 234A is the bottom view of FIG. 233A, shown with the cam/handle still occupying the retracted unlock position (i.e., rotated a total of 135 degrees), but showing the lever arm having again been rotated further away from contact with the cam, as a result of additional movement imparted to the tongue of the latch member through its contact with an upper portion of the recessed surface of the upper protrusion of the stepped stop member, as the sash window is opened further.

FIG. 234B is the side view of FIG. 233B, showing the tongue portion of the latch member of the latch assembly having again been driven to retract to its furthest-most retraction position as a result of its contact with the upper portion of the recessed surface of the upper protrusion of the stepped stop member.

FIG. 234C shows contact of the tip of the flexible follower member of the latch assembly with the contoured track of the latch housing, which contact position corresponds to the latch member position of FIG. 234B.

FIG. 235A is the bottom view of FIG. 234A, but is shown after the cam/handle has been driven from the retracted unlock position to only be rotated a total of roughly 123 degrees from its lock position, as a result of the lever arm having again been driven by the latch member, which results from the latch member being biased into its fully extended position once the sash window is opened sufficiently for the tongue portion of the latch member to be clear of (above) the upper protrusion of the stepped stop member.

FIG. 235B is the side view of FIG. 234B, showing the tongue portion of the latch member of the latch assembly having been biased into its fully extended position after the window is opened sufficiently for the tongue portion of the latch member to be clear of (above) the upper protrusion of the stepped stop member.

FIG. 235C shows contact of the tip of the flexible follower member of the latch assembly with the contoured track of the latch housing, which contact position corresponds to the latch member position of FIG. 235B, and which shows that the tip has finished another complete circuit around the track.

Figures 236A, 236B, 236C, 237A, 237B, 237C, 238A, 238B, 238C, 239A, 239B, 239C, 240A, 240B, 240C, 241A, 241B, 241C, 242A, 242B, 242C:
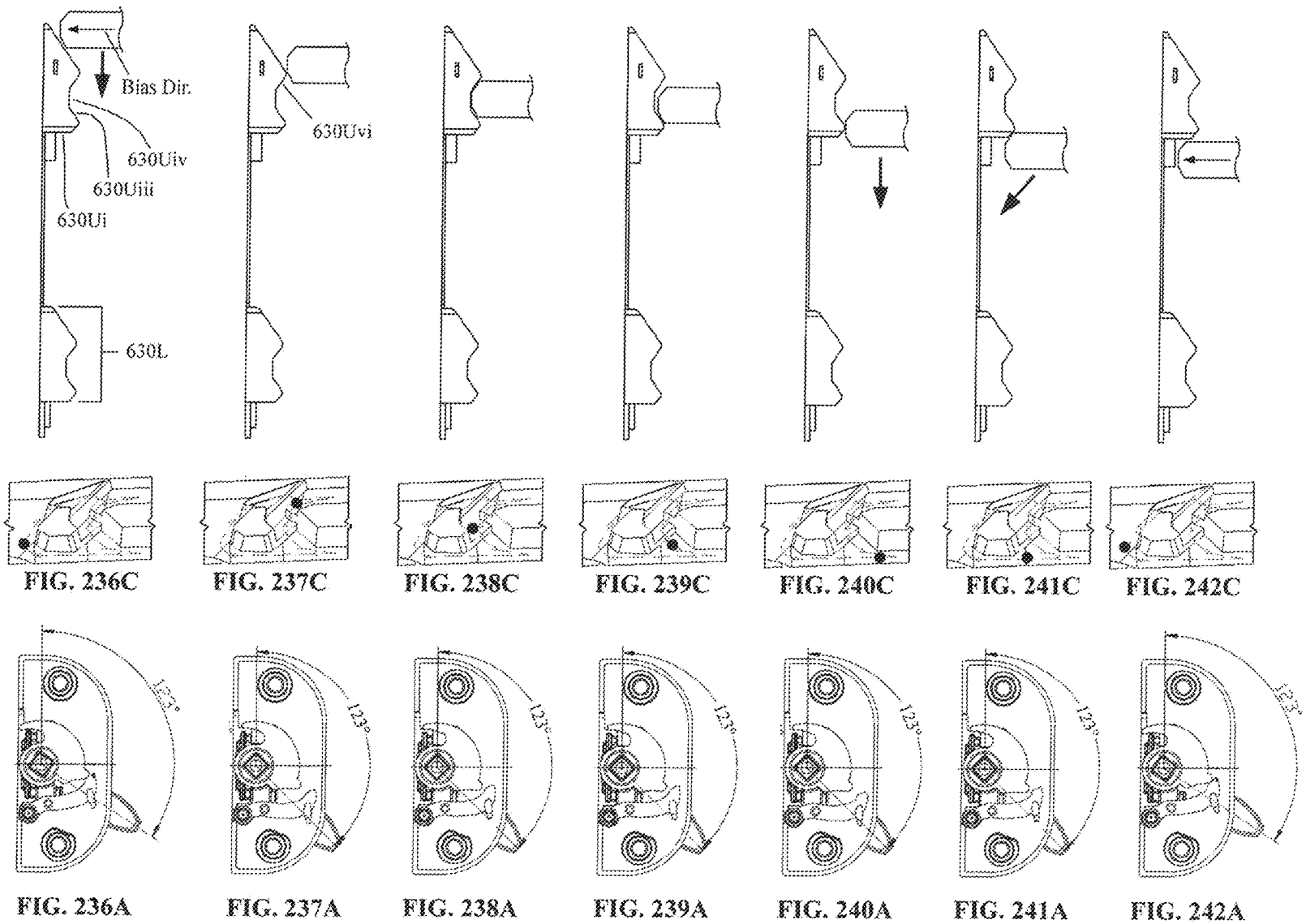

FIG. 236A is the bottom view of FIG. 235A, with the cam/handle still shown to only be rotated a total of roughly 123 degrees from its lock position.

FIG. 236B is the side view of FIG. 235B, but shown with the downward arrow to indicate the start of the window being slid downward towards its closed position, which will cause engagement between the lower curved/angled surface of the tongue portion with the angled/curved top stop surface of the upper protrusion of the stepped stop member.

FIG. 236C is the same as FIG. 235C, and shows contact of the tip of the flexible follower member of the latch assembly with the contoured track of the latch housing, which contact position corresponds to the latch member position of FIG. 236B.

FIG. 237A is the bottom view of FIG. 236A, with the cam/handle still shown to only be rotated a total of roughly 123 degrees from its lock position, but showing the lever arm having again been rotated away from contact with the cam, as a result of movement imparted to the tongue of the latch member to cause it to retract, through its contact with the angled/curved top stop surface of the upper protrusion of the stepped stop member, as the sash window is further moved towards its closed position.

FIG. 237B is the side view of FIG. 236B, showing the tongue portion of the latch member of the latch assembly having again been driven to retract to its furthest-most retraction position as a result of its contact with the upper portion of the recessed surface of the upper protrusion of the stepped stop member.

FIG. 237C shows contact of the tip of the flexible follower member of the latch assembly with the contoured track of the latch housing, which contact position corresponds to the latch member position of FIG. 237B.

FIG. 238A is the bottom view of FIG. 237A, with the cam/handle still shown to only be rotated a total of roughly 123 degrees from its lock position, but showing the lever arm having counter-rotated slightly back towards its contact position with the cam, as a result the tongue portion of the latch member extending into contact with a recessed surface of the upper protrusion of the stepped stop member, as the sash window continues to be moved towards its closed position.

FIG. 238B is the side view of FIG. 237B, showing the tongue portion of the latch member of the latch assembly having extended into contact with the central portion of the recessed surface of the upper protrusion of the stepped stop member.

FIG. 238C shows contact of the tip of the flexible follower member of the latch assembly with the contoured track of the latch housing, with engagement of the tip of the flexible follower member of the latch assembly again within the nested portion of the contoured track of the latch housing, and which contact position corresponds to the latch member position of FIG. 238B.

FIG. 239A is the bottom view of FIG. 238A, with the cam/handle still shown to only be rotated a total of roughly 123 degrees from its lock position, but showing the lever arm having rotated a small amount away from its contact position with the cam, as a result the tongue portion of the latch member moving along a ramp of the recessed surface of the upper protrusion of the stepped stop member, as the sash window continues to be moved towards its closed position.

FIG. 239B is the side view of FIG. 238B, showing the tongue portion of the latch member just beginning to move along a ramp of the recessed surface of the upper protrusion of the stepped stop member, as the sash window continues to be moved towards its closed position.

FIG. 239C shows contact of the tip of the flexible follower member with the contoured track of the latch housing of the latch assembly, just after having been triggered to exit the nested portion of the track, which exit position corresponds to the latch member position of FIG. 239B.

FIG. 240A is the bottom view of FIG. 239A, with the cam/handle still shown to only be rotated a total of roughly 123 degrees from its lock position, but showing the lever arm having rotated further away from its contact position with the cam, as a result the tongue portion of the latch member moving to the furthest-most portion of the ramp of the recessed surface of the upper protrusion of the stepped stop member, as the sash window continues to be moved towards its closed position.

FIG. 240B is the side view of FIG. 229B, showing the tongue portion of the latch member of the latch assembly having been driven to retract to its furthest-most retracted position, as a result of its contact with the most distal location of the ramp of the bottom ramp of the upper protrusion of the stepped stop member.

FIG. 240C shows contact of the tip of the flexible follower member of the latch assembly with the contoured track of the latch housing, which contact position corresponds to the latch member position of FIG. 240B.

FIG. 241A is the bottom view of FIG. 240A, with the cam/handle still shown to only be rotated a total of roughly 123 degrees from its lock position, but showing the lever arm having rotated closer to its contact position with the cam, as a result the lower curved/angled surface of the tongue portion following the angled/curved bottom stop surface of the upper protrusion of the stepped stop member, as the sash window continues to be moved towards its closed position.

FIG. 241B is the side view of FIG. 240B, showing the tongue portion of the latch member of the latch assembly extending as a result of the lower curved/angled surface of the tongue portion following the angled/curved bottom stop surface of the upper protrusion of the stepped stop member.

FIG. 241C shows contact of the tip of the flexible follower member of the latch assembly with the contoured track of the latch housing, which contact position corresponds to the latch member position of FIG. 241B.

FIG. 242A is the bottom view of FIG. 241A, with the cam/handle still shown to only be rotated a total of roughly 123 degrees from its lock position, but showing the lever arm having rotated to again be in contact with the cam, as a result the upper curved/angled surface of the tongue portion moving clear of the bottom stop surface of the upper protrusion of the stepped stop member for the latch member to be biased into its fully extended position, as the sash window is moved further toward its closed position.

FIG. 242B is the side view of FIG. 241B, showing the tongue portion of the latch member of the latch assembly biased into in its fully extended position, as a result the upper curved/angled surface of the tongue portion moving clear of the bottom stop surface of the upper protrusion of the stepped stop member for the latch member to be biased into its fully extended position, and be positioned below the bottom stop surface of the upper protrusion of the stepped stop member, which may again serves as a vent stop, as the sash window is moved further toward its closed position.

FIG. 242C shows contact of the tip of the flexible follower member of the latch assembly with the contoured track of the latch housing, which contact position corresponds to the latch member position of FIG. 242B.

DETAILED DESCRIPTION OF THE INVENTION

As used throughout this specification, the word "may" is used in a permissive sense (i.e., meaning having the potential to), rather than the mandatory sense (i.e., meaning must). Similarly, the words "include", "including", and "includes" mean including but not limited to.

The phrases "at least one", "one or more", and "and/or" are open-ended expressions that are both conjunctive and disjunctive in operation. For example, each of the expressions "at least one of A, B and C", "one or more of A, B, and C", and "A, B, and/or C" mean all of the following possible combinations: A alone; or B alone; or C alone; or A and B together; or A and C together; or B and C together; or A, B and C together.

Also, all references (e.g., patents, published patent applications, and non-patent literature) that are cited within this documents are incorporated herein in their entirety by reference.

Furthermore, the described features, advantages, and characteristics of any particular embodiment disclosed herein, may be combined in any suitable manner with any of the other embodiments disclosed herein.

It is further noted that any use herein of relative terms such as "top," "bottom," "upper," "lower," "vertical," and "horizontal" are merely intended to be descriptive for the reader, based on the depiction of those features within the figures for one particular position of the device, and such terms are not intended to limit the orientation with which the device of the present invention may be utilized.

Figure 1:
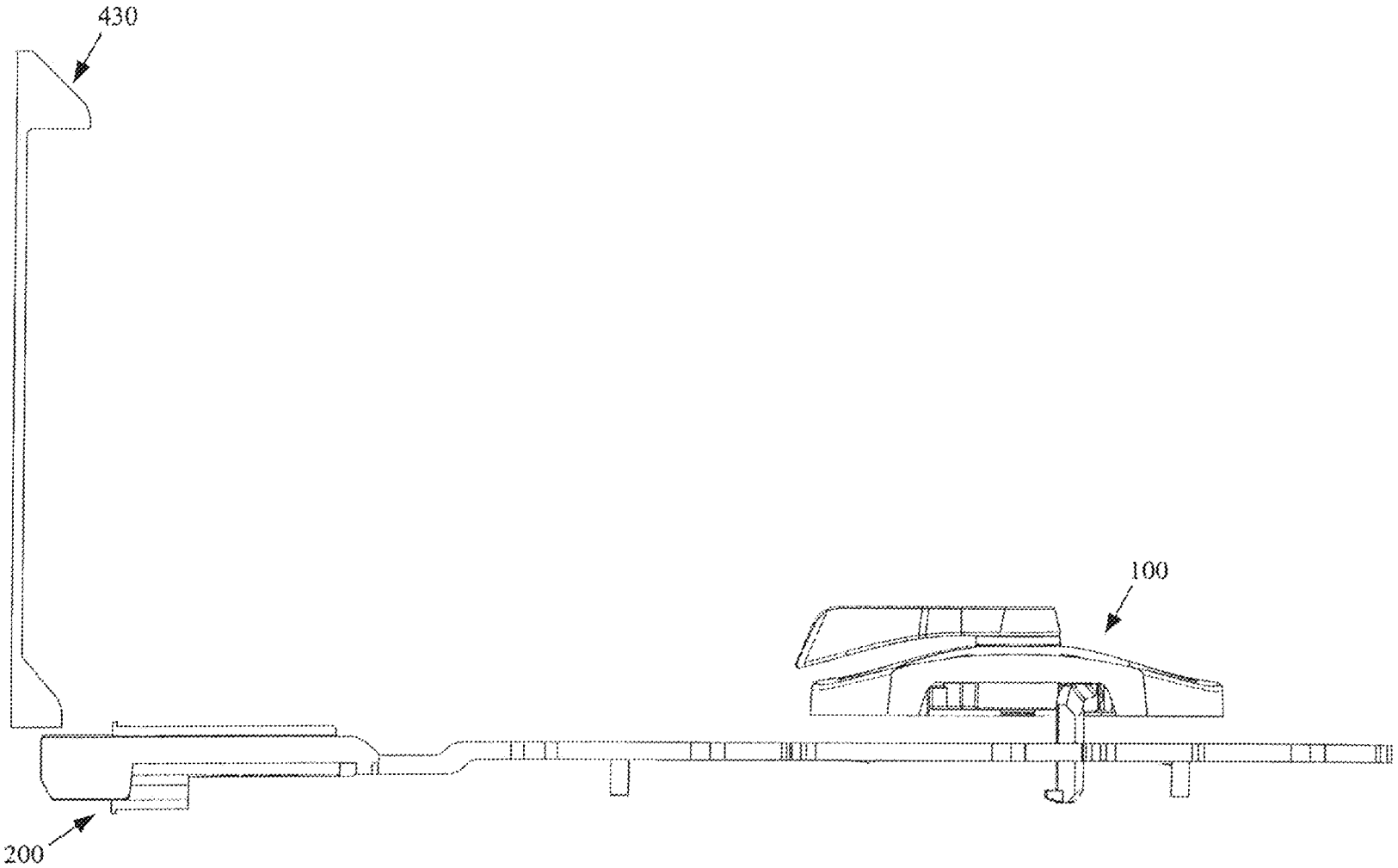
FIG. 1 is a side view of a sash fastener for a slidable sash member, and includes a sash lock assembly, a tilt latch assembly, and a stop member.
Figure 2:
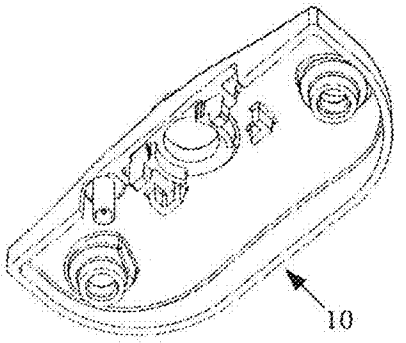
FIG. 2 is a first perspective view showing the interior of a housing that may be used to house the component parts of the sash lock assembly of FIG. 1.
Figure 3:
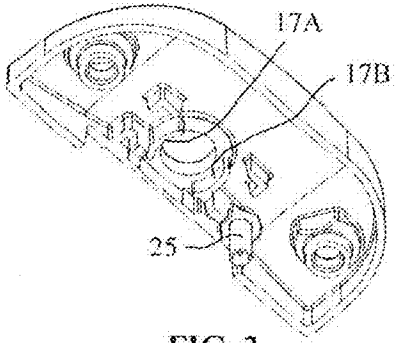
FIG. 3 is a second perspective view showing the interior of the housing of FIG. 2.
Figure 4:
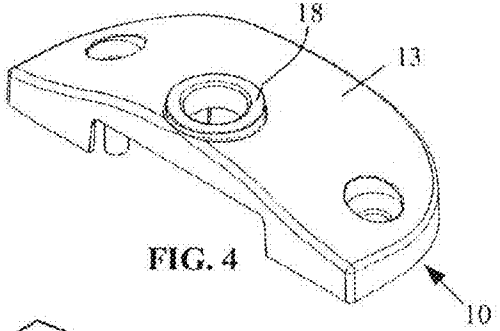
FIG. 4 is a third perspective view showing the front of the exterior of the housing of FIG. 2.
Figure 5:
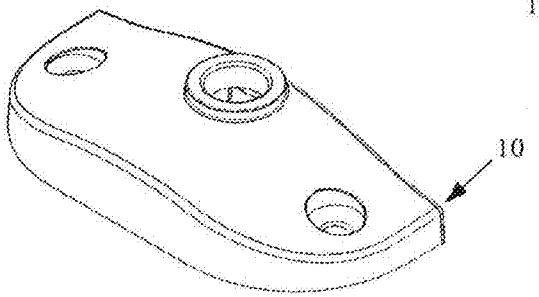
FIG. 5 is a fourth perspective view showing the rear exterior of the housing of FIG. 2.
Figure 7:
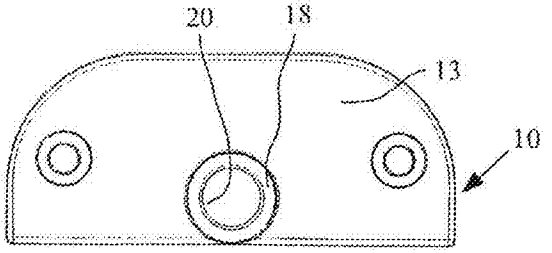
FIG. 7 is a top view of the sash lock housing of FIG. 2.

FIG. 1 shows an embodiment of the Applicant's integrated sash lock/tilt latch fastener, which may be used in conjunction with a sash window that is designed to be slidable and tiltable with respect to a master window frame.

The integrated sash lock/tilt latch fastener of FIG. 1 may include a latch assembly 200, and a sash lock assembly 100, which may be blindly mated to the latch assembly during its installation upon the meeting rail of the sash window. The latch assembly may interact with a stepped stop 430.

Figure 9:
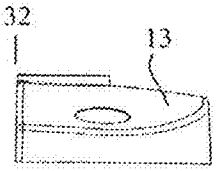
FIG. 9 is a first end view of the sash lock housing of FIG. 2.
Figure 6:
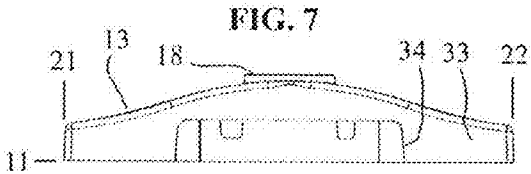
FIG. 6 is a front view of the sash lock housing of FIG. 2.
Figure 10:
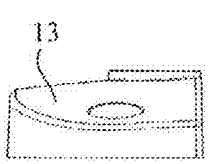
FIG. 10 is a second end view of the sash lock housing of FIG. 2.
Figure 8:
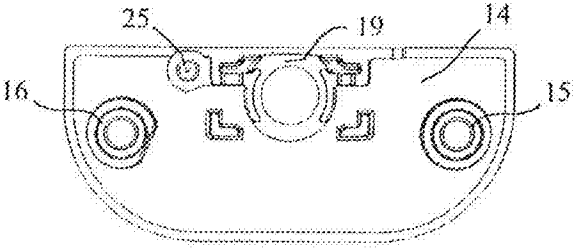
FIG. 8 is a bottom view of the sash lock housing of FIG. 2.
Figure 11:
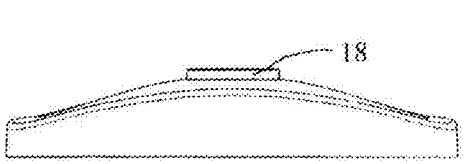
FIG. 11 is a rear view of the sash lock housing of FIG. 2.

Perspective views of the housing 10 of the sash lock assembly 100 are shown in FIGS. 2-5, while corresponding orthogonal views are shown in FIGS. 6-11. The housing 10 is not limited to the shape illustrated within FIGS. 6-11, and could take on many different suitable shapes, including a rectangular shape, an irregular shape, etc. However, the housing 10 may be desirably shaped to have a generally curved outer surface 13, spanning from a first end 21 to second end 22. The curvature of surface 13 may terminate at a generally flat bottom surface 11. The curvature of surface 13 may also transition, as seen in FIG. 9, into a generally flat surface 32, at which a wall 33 may be formed (FIG. 6). The housing 10 may be hollowed out to form an interior surface 14, and the wall 33 may have an opening 34 into the interior cavity of the housing.

Extending outwardly from the interior surface 14 of the housing 10 may be at least one hollow cylindrical protrusion that may be used to secure the sash lock assembly 100 to the sash window. In one embodiment of the housing, two hollow cylindrical protrusions 15 and 16 are used, and each may be configured to respectively receive a screw for mounting of the sash lock 100 to the meeting rail of the sliding sash window.

Extending outwardly from the interior surface 14 of the housing 10 may also be a shaft 25, which may be used for pivotal mounting of a lever arm.

The housing 10 may have a cylindrical boss 18 extending upwardly from the outer surface 13, and may also have a cylindrical boss 19 extending downwardly from the interior surface 14, into the housing cavity. The housing may have a hole 20 through the cylindrical boss 18 and boss 19. The hole 20 may be used for pivotal mounting of a shaft that may extend from a portion of the locking cam, or alternatively, the hole 20 may be used for pivotal mounting of a separate shaft/handle member, to which the locking cam may instead be fixedly secured.

As seen in FIGS. 13-21, a shaft/handle member 40 may have a cylindrical shaft 43, one end of which may have a keyed protrusion 44 extending therefrom, with an orifice therein. The other end of the shaft 43 may have a graspable handle portion 46 that may extend generally orthogonally with respect to the axis of shaft 43. The shaft 43 may be configured to be pivotally received within the hole 20 in the boss 18 of the housing 10. The keyed protrusion 44 may be any suitable cross-sectional shape, and in this example, the keyed protrusion is formed using a rectangular shape.

The locking cam 50, illustrated in FIGS. 22-32, may have a cylindrical hub 53, with a keyed opening 54 that is shaped to match the keyed protrusion 44 of the shaft/handle member 40. Extending laterally away from the hub 53 may be a wall 55, and extending laterally away from the wall 55 may be a curved cam wall 56, which may be used to engage the key of the corresponding keeper, and to draw the sliding sash window in closer proximity to the master window frame (or to the other sash window for a double-hung arrangement). The curved cam wall 56 may have a curved protrusion 56P protruding laterally therefrom, which may be a semi-cylindrical protrusion, with a surface having a radius 56PR. The axis of the semi-cylindrical protrusion 56P may be substantially parallel to the axis of the hub 53.

Protruding away from the hub 53 may be a cylindrical member 57, the axis of which may be generally concentric with the axis of the hub. The cylindrical member 57 may have a first flat 58A formed thereon, and a second flat 58B formed thereon to be clocked 180 degrees away from the first flat 58A. The flats 58A and 58B may co-act with respect to the leaf spring 90 shown in FIG. 12, to operate as a detent mechanism to releasably secure the cam 50 at an extended (locking) position and a third retracted (unlocked) position, which are discussed hereinafter with respect to FIGS. 60 and 63.

Figures 22, 23, 24, 25, 26, 27, 28, 28A, 29, 30, 31, 32:
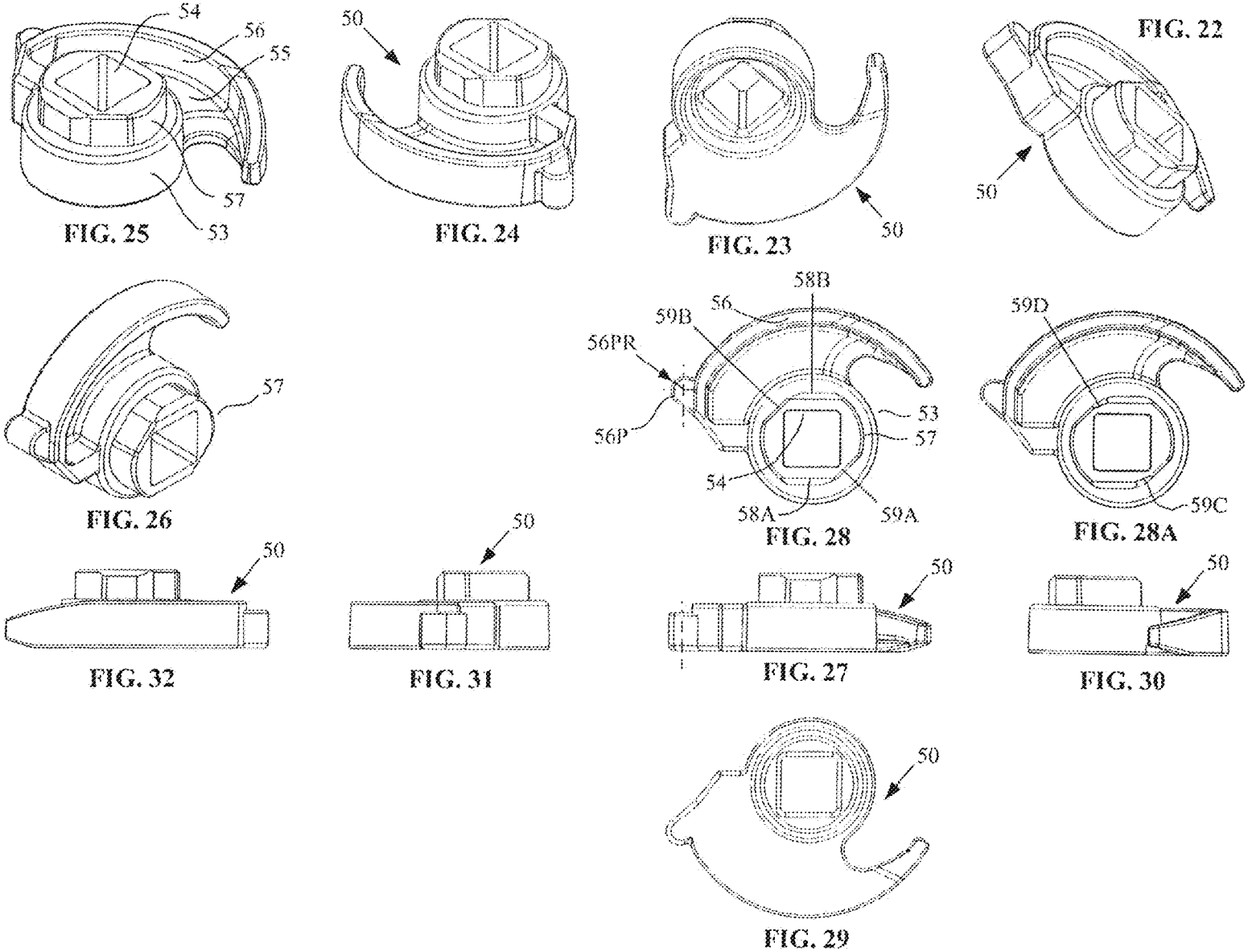
FIG. 22 is a first perspective view of the cam of the sash lock assembly of FIG. 1.
FIG. 23 is a second perspective view of the cam shown in FIG. 22.
FIG. 24 is a third perspective view of the cam shown in FIG. 22.
FIG. 25 is a fourth perspective view of the cam shown in FIG. 22.
FIG. 26 is a fifth perspective view of the cam shown in FIG. 22.
FIG. 27 is a side view of the locking cam of FIG. 22.
FIG. 28 is a top view of the locking cam of FIG. 22.
FIG. 28A is the top view of FIG. 28, but showing an additional pair of flats on the hub to co-act with the leaf spring of FIG. 12 to serve as a detent at an additional location.
FIG. 29 is a bottom view of the locking cam of FIG. 22.
FIG. 30 is a first end view of the locking cam of FIG. 22.
FIG. 31 is a second end view of the locking cam of FIG. 22.
FIG. 32 is a second side view of the locking cam of FIG. 22.
Figures 33, 34, 35, 36, 37, 37A, 38, 39, 40:
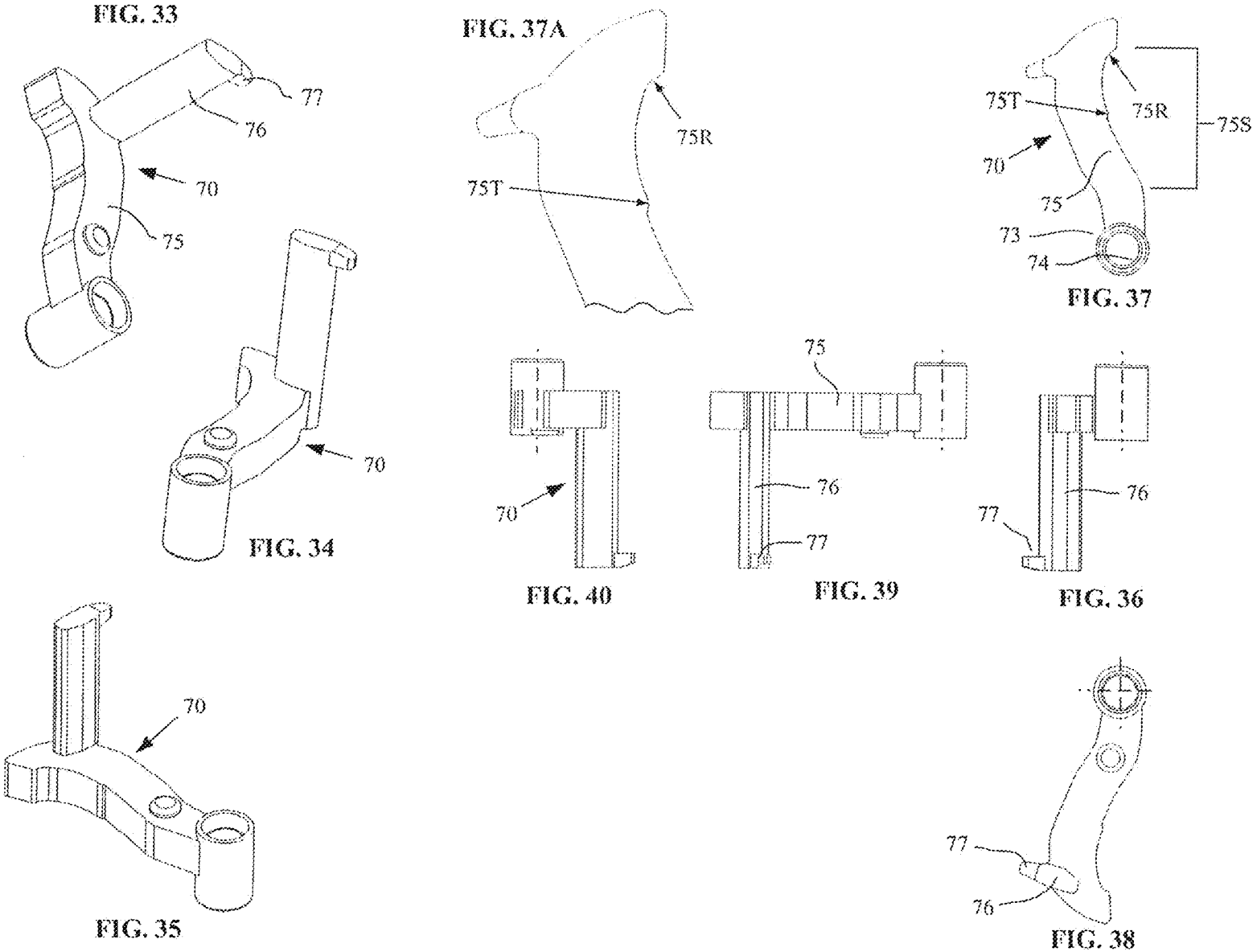
FIG. 33 is a first perspective view of the lever arm of the sash lock assembly of FIG. 1.
FIG. 34 is a second perspective view of the lever arm of FIG. 33.
FIG. 35 is a third perspective view of the lever arm of FIG. 33.
FIG. 36 is a first side view of the lever arm of FIG. 33.
FIG. 37 is a top view of the lever arm of FIG. 33.
FIG. 37A is an enlarged top view of the lever arm of FIG. 33.
FIG. 38 is a bottom view of the lever arm of FIG. 33.
FIG. 39 is a front view of the lever arm of FIG. 33.
FIG. 40 is a second side view of the lever arm of FIG. 33.

The cylindrical member 57A may also have a third flat 59A formed thereon, as seen in FIG. 28, at a position that is clocked roughly 135 degrees from the first flat 58A. The flat 59A may also co-act with respect to the leaf spring 90 to operate as a detent mechanism to releasably secure the cam 50 at another sash unlocked position, termed herein, with respect to the operation of the sash lock and sash window, as a first retracted (unlock) position. For greater stability of the cam in being releasably retained at this unlocked position, a fourth flat 59B may be positioned on the cylindrical member 57 at a position that is clocked roughly 180 degrees from the third flat 59A, which may releasably engage a second leaf spring. Note that the flats could be formed on the cylindrical hub 53, instead of on the protruding cylindrical member 57.

As seen for the alternate embodiment of the cam in FIG. 28A, the cylindrical member 57A may also have a fifth flat 59C formed thereon, at a position that is clocked roughly 160 degrees from the first flat 58A. The flat 59C may also co-act with respect to the leaf spring 90 to operate as a detent mechanism to releasably secure the cam 50 at yet another sash unlocked position, termed herein as a second retracted (unlock) position. A sixth flat 59D may be positioned on the cylindrical member 57 at a position that is clocked roughly 180 degrees from the fifth flat 59C, and which may releasably engage the second leaf spring.

Interaction between the sash lock assembly 100, once installed upon the meeting rail of the sliding sash window, and the latch assembly 200, may be through the use of a lever arm 70 that may be pivotally mounted within the cavity of the housing 10. The lever arm 70 is shown within FIGS. 33-40. Lever arm 70 may include a hub 73, with a mounting hole 74 therein. Extending laterally away from the axis of the hub 73 may be an arm 75, which may have a sculpted surface 75S (a follower portion), and which may include a small radiused step 75T that may serve as a detent. The sculpted surface 75S may include a radiused concave feature 75R, which is discussed hereinafter. The radiused feature 75R may be formed with a radius being substantially equal to, or slightly larger than, the radius 56PR for the protrusion 75P on cam 50, for engagement therebetween. The sculpted surface 75S is shaped to be selectively driven by rotation of the semi-cylindrical protrusion 56P of the locking cam 50, as discussed hereinafter. The arm 75 may transition into a post 76 that may be generally orthogonal to the arm 75, and may be generally parallel to the axis of the hub 73. A protrusion 77 may protrude from the post 76.

Figure 12:
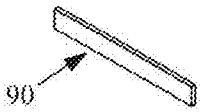
FIG. 12 is a perspective view of a leaf spring used in the sash lock assembly of FIG. 1
Figure 13:
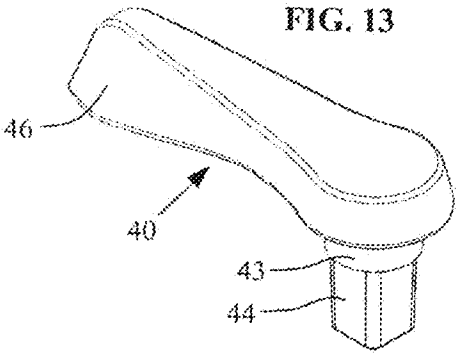
FIG. 13 is a first perspective view of the shaft/handle member of the sash lock assembly of FIG. 1.
Figure 14:
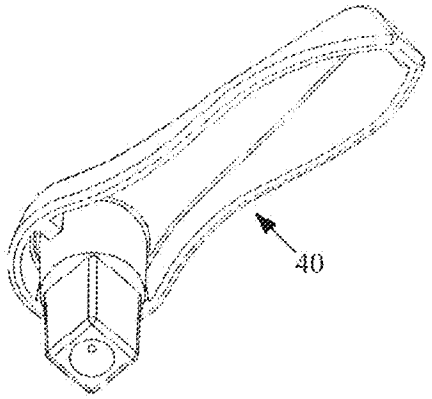
FIG. 14 is a second perspective view of the shaft/handle member shown in FIG. 13.
Figure 15:
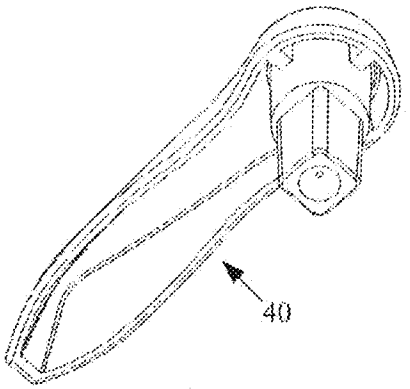
FIG. 15 is a third perspective view of the shaft/handle member shown in FIG. 13.
Figure 17:
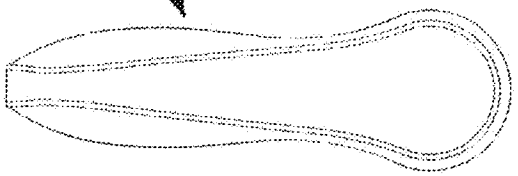
FIG. 17 is a top view of the shaft/handle member of FIG. 13.
Figure 19:
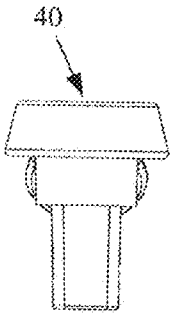
FIG. 19 is a first end view of the shaft/handle member of FIG. 13.
Figure 16:
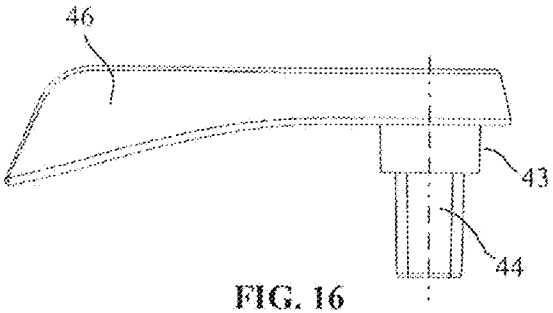
FIG. 16 is a side view of the shaft/handle member of FIG. 13.
Figure 18:
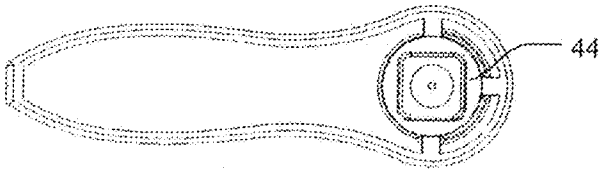
FIG. 18 is a bottom view of the shaft/handle member of FIG. 13.
Figure 20:
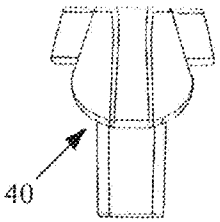
FIG. 20 is a second end view of the shaft/handle member of FIG. 13.
Figure 21:
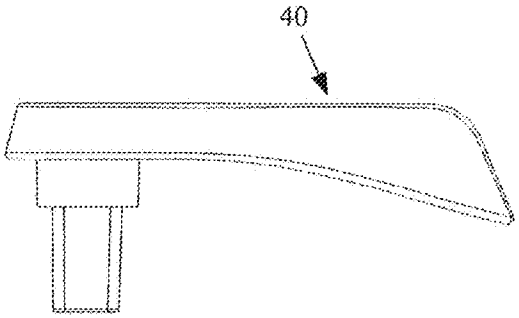
FIG. 21 is a second side view of the shaft/handle member of FIG. 13.
Figure 41:
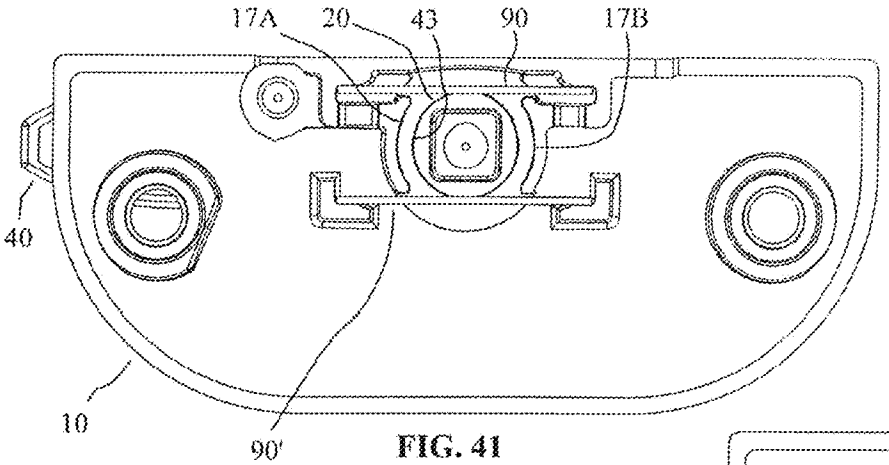
FIG. 41 is a bottom view of the housing of the latch assembly of FIG. 1, shown with two leaf springs and the shaft/handle member installed therein.

Initial assembly of sash lock assembly 100 is shown in FIG. 41. The leaf spring 90, which may be a generally flat elongated flexible member, as seen in FIG. 12, may be installed into the housing interior. The ends of leaf spring 90 may be fixedly received within a pair of corresponding recesses in the housing, using a friction fit, or using adhesive, or mechanical fasteners, etc. As mentioned above, a second leaf spring 90' may be used, and may similarly be secured within the housing cavity, to be at a distance away from the first leaf spring 90 that is roughly the same as the distance between the pair of flats 58A and 58B, which may be roughly the same as the distance between the pair of flats 59A and 59B, and between flats 59C and 59D. The cylindrical shaft 43 of the shaft/handle member 40 may then be pivotally received in hole 20 of housing 10.

Figure 42:
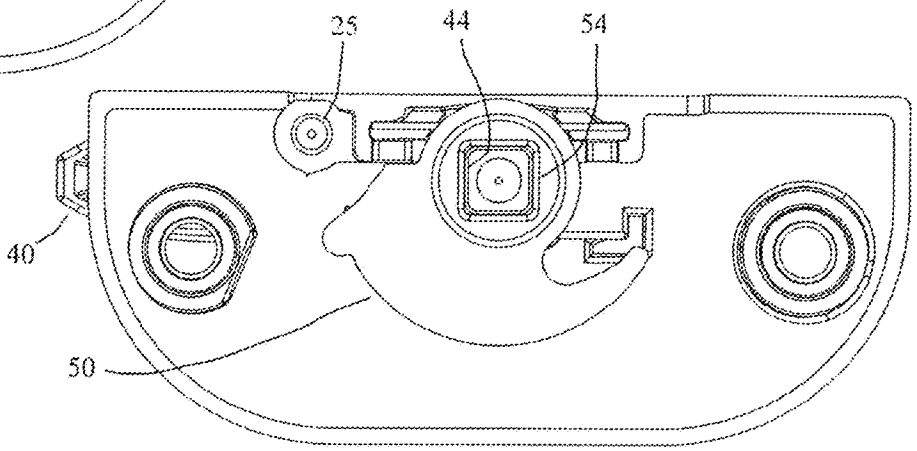
FIG. 42 is the bottom view of FIG. 41, but shown with the cam fixedly secured to the shaft/handle member.

As seen in FIG. 42, the locking cam 50 may then be joined to the shaft/handle member 40, with the keyed protrusion 44 of the shaft member 40 being received within the keyed opening 54 of locking cam 50, and being secured thereat using a friction fit, adhesive, mechanical fasteners, or by being welded thereto, or by using any combination of suitable means of securing two parts together. Note that additional pivotal support for the cam 50 may be provided by the curved housing walls 17A and 17B (FIG. 2A and FIG. 41) supporting the hub 53 of the cam therebetween.

Figure 43:
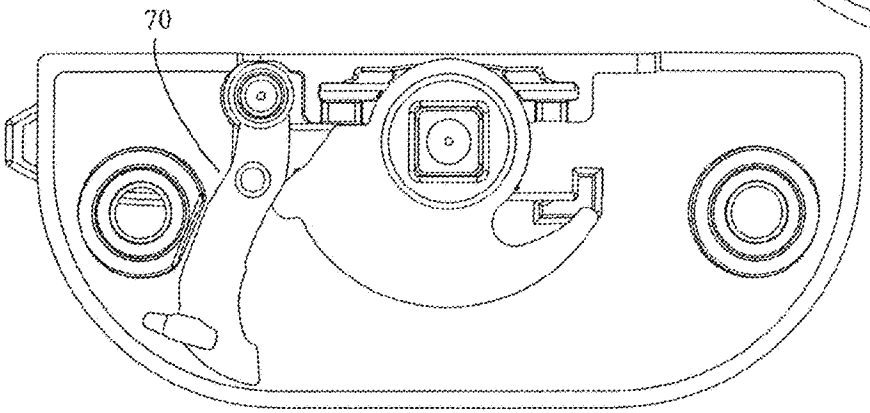
FIG. 43 is the bottom view of FIG. 42, but shown with the lever arm pivotally installed therein.
Figure 44:
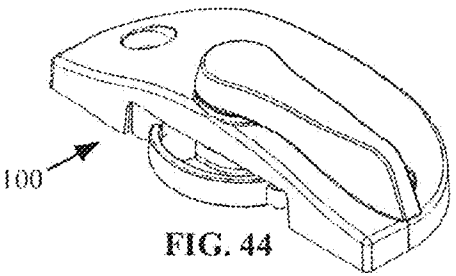
FIG. 44 is a first perspective view of the lock assembly of FIG. 43, shown with the cam in the extended position (i.e., shaft/handle at zero degrees of rotation).
Figure 45:
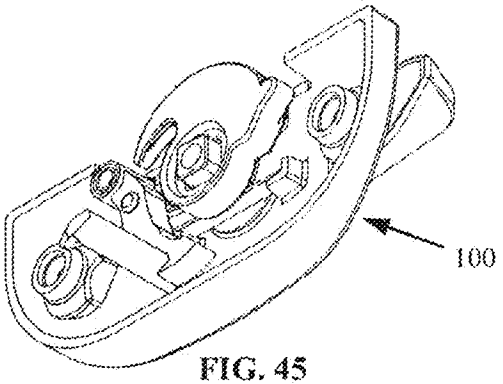
FIG. 45 is a second perspective view of the lock assembly of FIG. 44.
Figure 47:
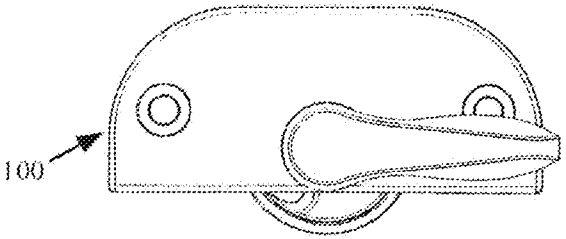
FIG. 47 is a top view of the lock assembly of FIG. 44.
Figure 49:
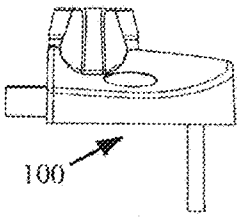
FIG. 49 is a first end view of the lock assembly of FIG. 44.
Figure 46:
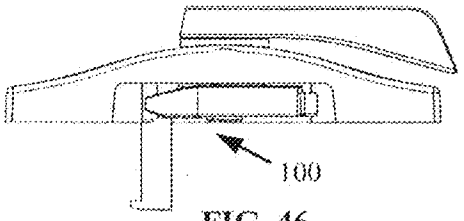
FIG. 46 is a front view of the lock assembly of FIG. 44.
Figure 48:
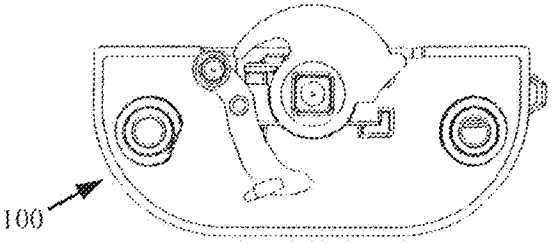
FIG. 48 is a bottom view of the lock assembly of FIG. 44.
Figure 50:
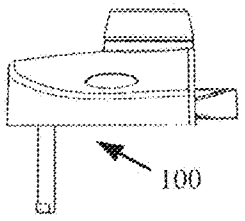
FIG. 50 is a second end view of the lock assembly of FIG. 44.
Figure 51:
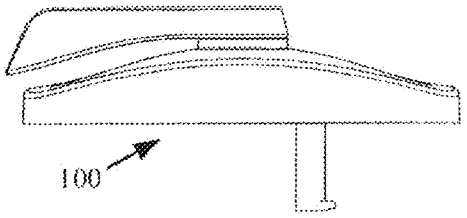
FIG. 51 is a rear view of the lock assembly of FIG. 44.
Figure 52:
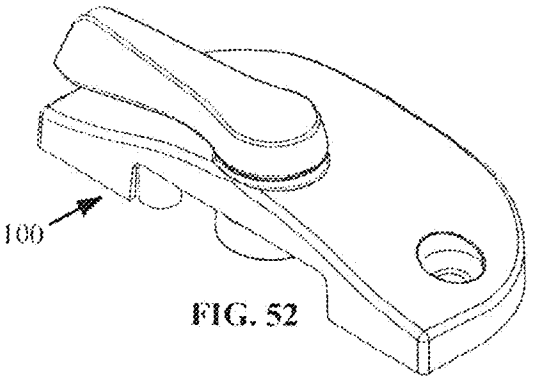
FIG. 52 is a first perspective view of the lock assembly of FIG. 43, shown with the cam in the fully retracted position (i.e., shaft/handle at 180 degrees of rotation).
Figure 53:
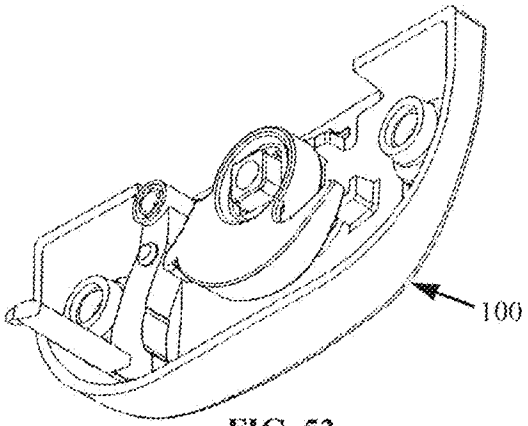
FIG. 53 is a second perspective view of the lock assembly of FIG. 52.
Figure 55:
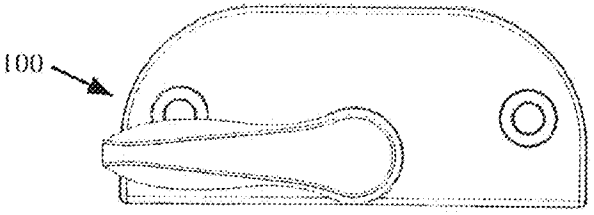
FIG. 55 is a top view of the lock assembly of FIG. 52.
Figure 54:
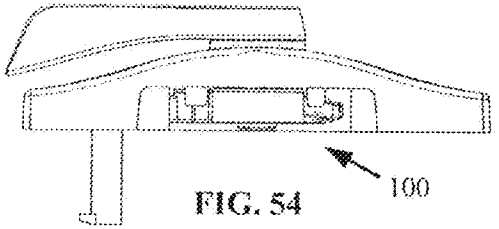
FIG. 54 is a front view of the lock assembly of FIG. 52.
Figure 57:
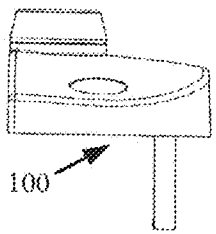
FIG. 57 is a first end view of the lock assembly of FIG. 52.
Figure 56:
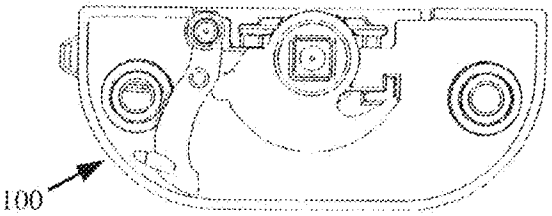
FIG. 56 is a bottom view of the lock assembly of FIG. 52.
Figure 58:
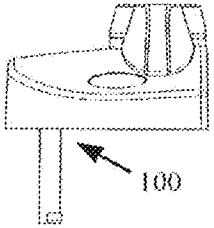
FIG. 58 is a second end view of the lock assembly of FIG. 52.
Figure 59:
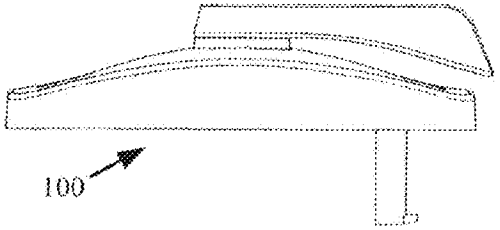
FIG. 59 is a rear view of the lock assembly of FIG. 52.

Next, as seen in FIGS. 42 and 43, the hole 74 of the hub 73 of the lever arm 70 may be pivotally received upon the shaft 25 that may protrude out from the interior surface 14 of the housing. To pivotally secure the lever arm 70 thereto, the end of the shaft 25 may be bucked like a rivet, to form a head to prevent the lever arm from slipping off of the post. Alternatively, a screw or other mechanical fastener may be used for pivotally securing the hub 73 of the lever arm 70 to the shaft 25 of the housing 10.

FIGS. 44-51 show various views of the sash lock assembly with the cam in the extended (lock) position.

FIGS. 52-59 show various views of the sash lock assembly with the cam in the third retracted (unlock) position.

FIGS. 60-63 show four key positions that may be occupied by the components of the assembled sash lock 100.

Figure 60:
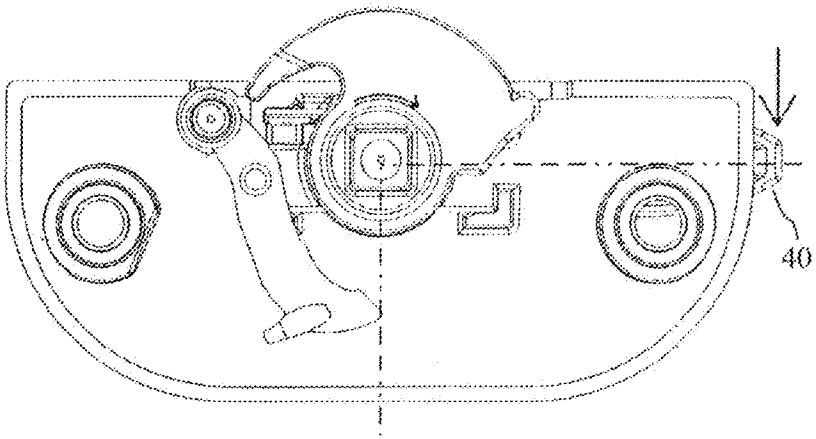
FIG. 60 is the bottom view of the sash lock of FIG. 48 with cam in the extended position (i.e., shaft/handle at zero degrees of rotation), but is shown enlarged.

FIG. 60 shows the sash lock assembly 100 in the extended locking position, where the curved wall 56 of cam 50 protrudes out from the housing 10, and may engage the key (or "tooth") of a keeper to secure the sliding sash window from sliding within the track of the master window frame, as discussed hereinafter. The lever arm 70 shown therein, is unaffected by the cam 50 in this position, and the lever arm is biased into the position shown by the interconnection with the biased latch member of the latch assembly.

Figure 61:
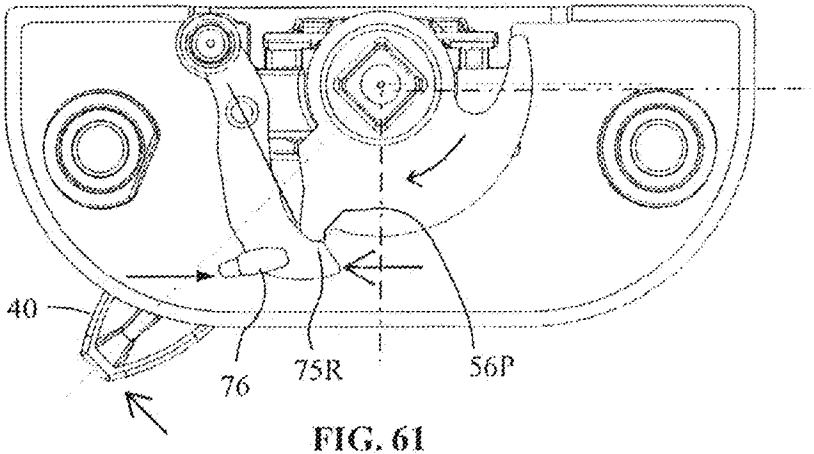
FIG. 61 is the bottom view of FIG. 60, but shown with the cam having been moved into the first retracted position (i.e., shaft/handle at 135 degrees of rotation), and with the protrusion on the cam having contacted and actuated the follower portion of the lever arm.

FIG. 61 shows the sash lock assembly 100 in the first retracted (unlocked) position, where the shaft/handle member 40 has been rotated 135 degrees from the extended locking position, for the curved wall 56 of cam 50 to disengage from the keeper and be retracted within the cavity of the housing 10, to permit the sash window to slide in the master window frame. During the final portion of the 135 degrees of rotation for the cam to reach the first retracted unlock position, the semi-cylindrical protrusion 56P of the locking cam 50 may contact the lever arm 70 and cause it to similarly rotate, but only a small amount. After the small amount of co-rotation of arm 70, the radiused surface 56$P_R$ of protrusion 75P on cam 50 may nest within the radiused feature 75R of the arm, for releasable engagement therebetween. With this arrangement of lever arm 70 and cam 50 at the first retracted position (for the fastener to serve as a window vent stop), if a force is applied to the post 76 of the arm by the latch, counter-rotation of the arm about its hub would be reacted by its engagement with the cam, and be further reacted, in part, through the pivotal mounting of the cam.

Figure 62:
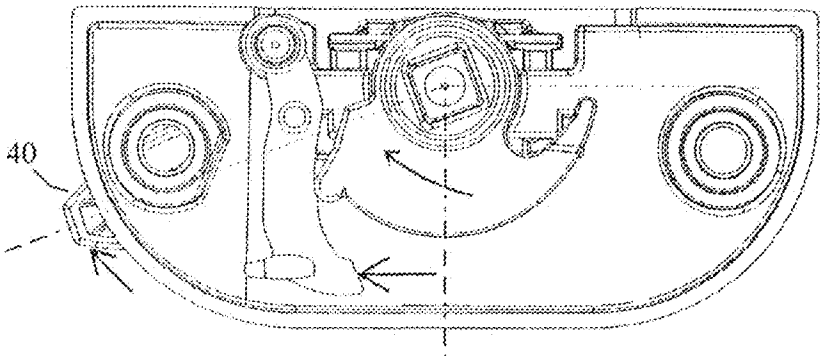
FIG. 62 is the bottom view of FIG. 61, but shown with the cam having been moved into the second retracted position (i.e., shaft/handle at 160 degrees of rotation), and with the protrusion on the cam having further driven the follower portion of the lever arm.

FIG. 62 shows the sash lock assembly 100 in the second retracted (unlocked) position, where the shaft/handle member 40 has been rotated an additional 25 degrees from the first retracted position (i.e., is rotated 160 degrees from the locking position). During those 25 degrees of rotation for the cam to reach the second retracted position, the semi-cylindrical protrusion 56P of the locking cam 50 may disengage from its position with respect to the radiused feature 75R (FIG. 61) of the arm, at which the detent mechanism provides a restraining force that inhibits motion away from that position, and drive the lever arm 70 to further co-rotate, after which the semi-cylindrical protrusion 56P of the locking cam may rest against the step 75T to provide a tactile indication of such positioning.

Figure 63:
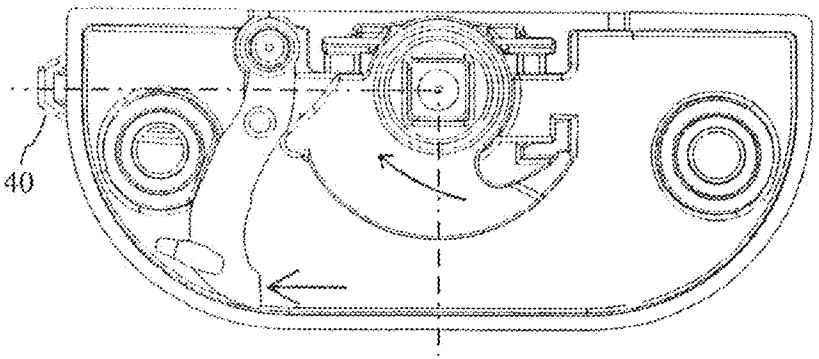
FIG. 63 is the bottom view of FIG. 62, but shown with the cam having been moved into the third retracted position (i.e., shaft/handle at 180 degrees of rotation), and with the protrusion on the cam having correspondingly driven the follower portion of the lever arm.

FIG. 63 shows the sash lock assembly 100 in the third retracted (unlock) position, where the shaft/handle member 40 has been rotated an additional 20 degrees past the second retracted position (i.e., is rotated 180 degrees from the locking position). During those 20 degrees of rotation for the cam to reach the third retracted position, the semi-cylindrical protrusion 56P of the locking cam 50 may pass over the step 75T (FIG. 62), and drive the lever arm 70 to further co-rotate. (Note that the herein described 135 degree, 160 degree, and 180 degree rotational amounts are merely exemplary, and the fastener may be constructed so that other rotational amounts to reach those key positions may alternatively be used).

The clocking of the flat 58A and flat 58B on the cylindrical member 57 on the hub 53 of locking cam 50 may respectively contact and be flush with the leaf springs 90 and 90', to releasably restrain the locking cam 50 from rotating out of the extended locking position and the third retracted unlock position, without being deliberately moved therefrom.

Also, the clocking of the flat 59A and flat 59B of the cylindrical member 57 on the hub 53 of locking cam 50 may be respectively engaged by the flexible leaf springs 90 and 90' when the cam is at the first retracted (unlocked) position. (Note, to increase flexibility of the leaf springs 90 and 90', only one end of each spring may be fixedly mounted in the housing, or alternatively, both ends may be slidably mounted therein, to easily permit lateral deflection of the leaf springs, but without permitting them to become loosened or disconnected from proper positioning within the housing adjacent to the locking cam). This contact of the flats of the cam with the leaf spring may serve to releasably restrain the kicking cam 50 from rotating out of the first retracted (unlocked) position, until being deliberately moved therefrom. Note that since the angle at which the flats 58A/58B were clocked from the flats 59A/59B was approximately 135 degrees, the shaft/handle 40 will need to rotate approximately 135 degrees to actuate the sash lock assembly 100 from the extended lock position to the first retracted (unlock) position. This is shown by the movement of the handle portion 46 of the shaft/handle 40 in both figures. As noted above, angular displacements other than 135 degrees are also possible, as long as the rotational movement is sufficient to move the curved wall 56 of cam 50 far enough away from the keeper to permit sliding movement of the sash window, and although it may be desirable, the cam need not even be fully retracted within the housing 10 at the first retraced unlock position.

The shaft/handle 40 and cam 50 may also be releasably secured at the second retracted (unlocked) position using the same detent mechanism, where the leaf springs 90 and 90' engage the flats 59C and 59D on the hub 53 of locking cam 50, where those flats may be utilized.

The shaft/handle 40 and cam 50 may furthermore be releasably secured at the third retracted position using the same detent mechanism, where the leaf springs 90 and 90' once again engage the flats 58A and 588 (i.e., after having been rotation 180 degrees).

The above noted interconnection between the sash lock assembly 100 and the latch assembly 200 may be through the use of the following latch assembly configuration.

Figures 64, 65, 66, 67, 68, 69, 70, 71, 72, 73, 74:
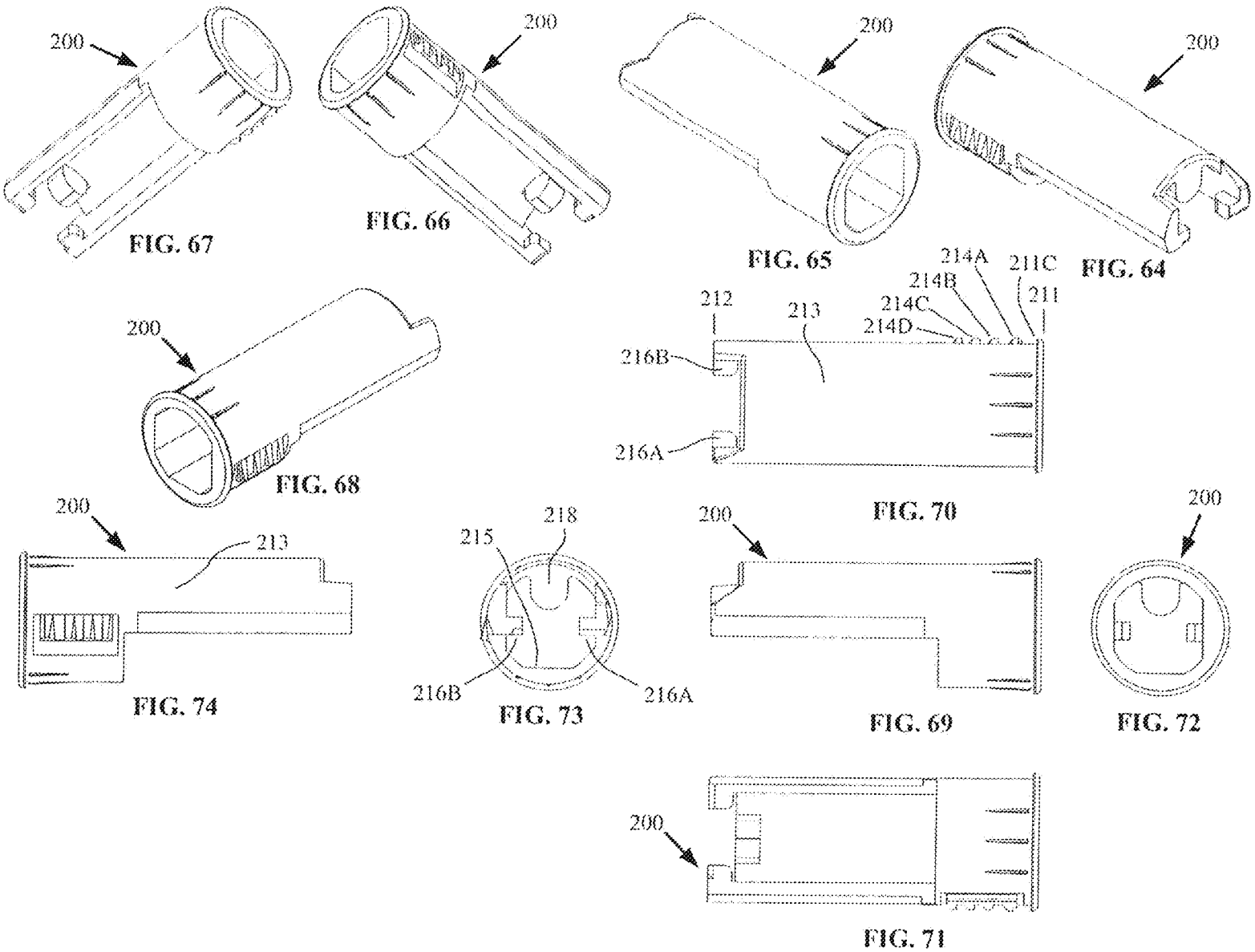
FIG. 64 is a first perspective view of a housing used to house the component parts of the latch assembly of FIG. 1.
FIG. 65 is a second perspective view of the housing shown in FIG. 64.
FIG. 66 is a third perspective view of the housing shown in FIG. 64.
FIG. 67 is a fourth perspective view of the housing shown in FIG. 64.
FIG. 68 is a fifth perspective view of the housing shown in FIG. 64.
FIG. 69 is a first side view of the latch housing of FIG. 64.
FIG. 70 is a top view of the latch housing of FIG. 64.
FIG. 71 is a bottom view of the latch housing of FIG. 64.
FIG. 72 is a first end view of the latch housing of FIG. 64.
FIG. 73 is a second end view of the latch housing of FIG. 64.
FIG. 74 is a second side view of the latch housing of FIG. 64.
Figure 75:
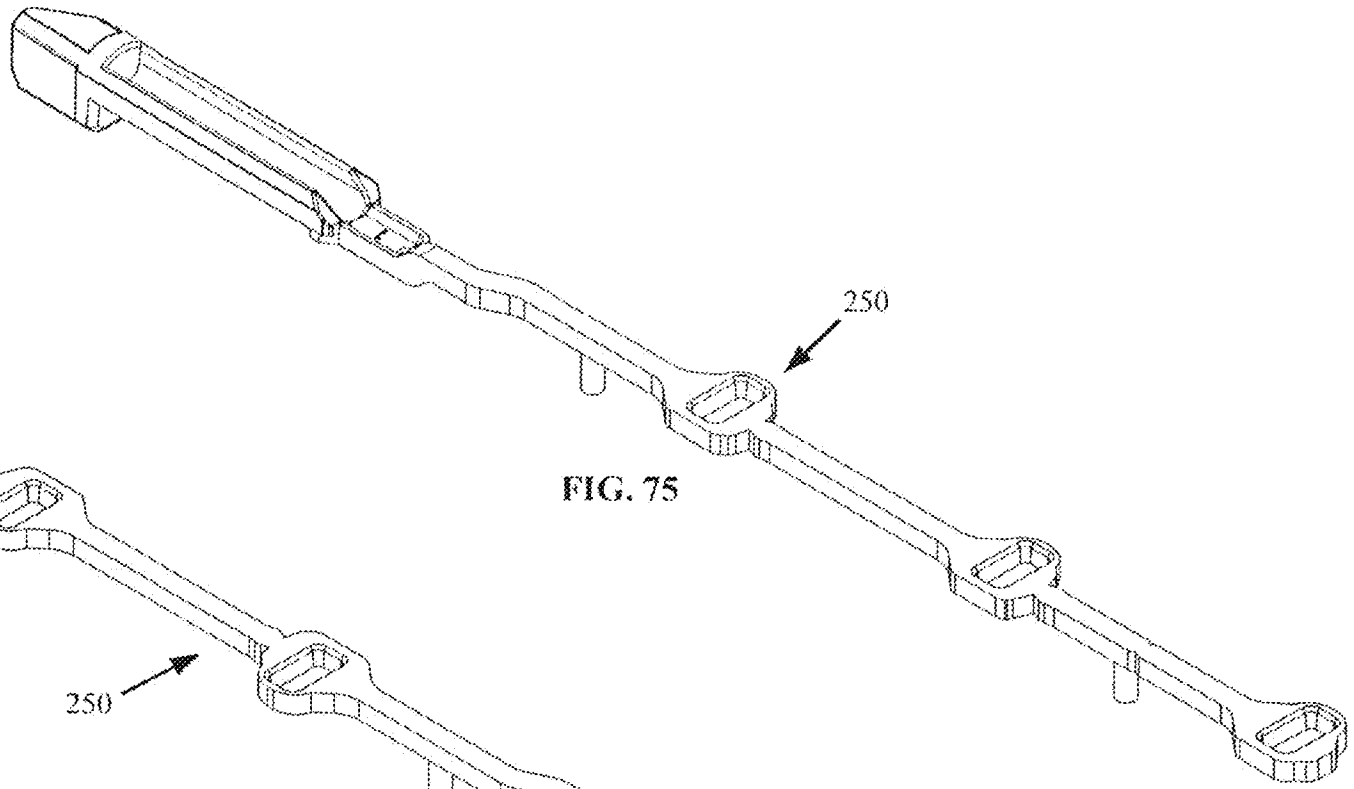
FIG. 75 is a first perspective view of a latch member used in the latch assembly of FIG. 1.
Figure 76:
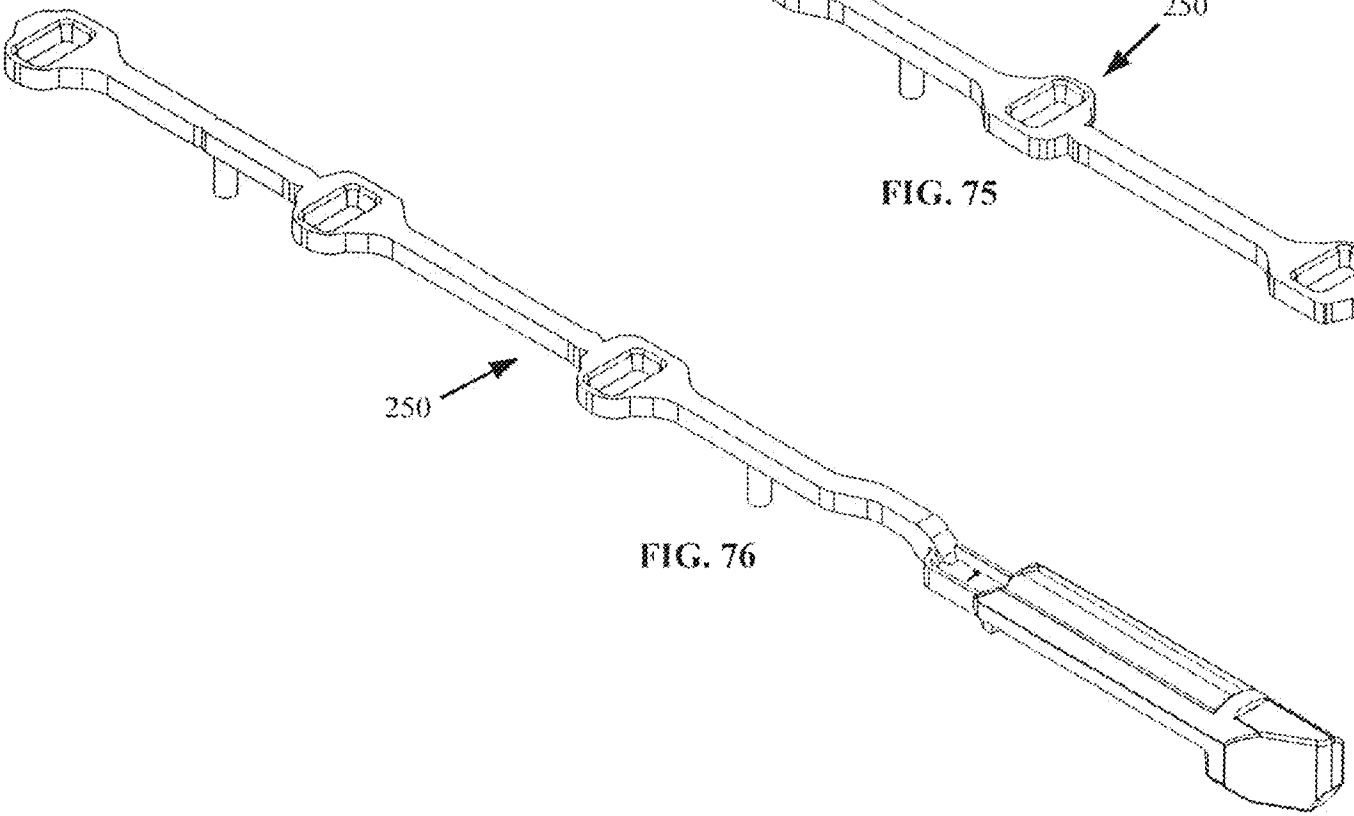
FIG. 76 is a second perspective view of the latch member shown in FIG. 75.

The latch assembly 200 may include a latch housing 210, shown in FIGS. 64 to 74, which may have a simple exterior surface (e.g., generally cylindrical), the complement of which may be easily formed (e.g., bored) into the sliding sash window frame, to permit ease of its installation therein. However, the housing 210 is not limited to the shape illustrated within those figures, and could take on many different appropriate shapes, including an elongated rectangular shape. However, at least a portion of the housing 210 may be desirably shaped to have a cylindrical outer surface 213, which may span from a first end 211 to second end 212 (FIG. 70). At the first end 211 of the housing 210, the cylindrical outer surface 213 may transition into a protruding lip 211C. A portion of the cylindrical outer surface 213 may also have a series of successive teeth (e.g., 214A, 214B, 214C, 214D, etc.) formed thereon, for securing of the housing within the hole that is bored/formed in the window rail. The housing 210 may be hollowed out to form an interior surface 215. Protruding into the interior surface 215 may be one stop 216A or a pair of stops (e.g., 216A and 216B). A wall 218 may protrude inward to obstruct a portion of the hollowed out interior between the first end 211 and the second end 212. The housing 210 being so formed may slidably receive a latch member 250 therein.

Perspective views of the latch member 250 are shown in FIGS. 75-78, while corresponding orthogonal views are shown in FIGS. 79-83. The latch member 250 may extend from first end 251 to second end 252, and may include a tongue 253 that may begin at the first end of the latch member and extend only part way to its second end. The tongue 253 may have a generally flat engagement surface 254E that may engage the track of the master window frame to prevent outward tilting of the sliding sash window, and it may also have an angled surface 254A that tapers toward the engagement surface 254E to create an apex. The angled surface 254A may be used, upon contact with the master window frame, to oppose biasing of the latch member and assist in driving it into a retracted position, until the tongue enters the track of the master window frame, and is biased into its extended position to have the engagement surface 254E re-engage the track. The bottom of tongue 253 may have an angled surface 253A formed thereon (FIG. 79). The tongue 253 may also have one stop 266A protruding therefrom (FIG. 81) or a pair of stops (e.g., 266A and 266B). Extending away from the tongue 253 may be an elongated beam 255 that may be flexible.

The generally slender beam 255 may transition and widen to form peripheral walls about an opening 275A, the size of which may depend upon the cross-sectional shape of the post 76 of lever arm 70 of the lock assembly 100, to provide for engagement of the post with the latch assembly. The opening 275A may be an elongated shape, which may, for example, be generally rectangular-shaped, as shown in FIGS. 80 and 81. The elongated opening may be oriented so that the longer direction of the opening is substantially perpendicular to the axis 255X of the beam 255. The rectangular opening 275A may therefore have a length 275L extending substantially normal to the axial direction 255X of the beam, and a width 275W extending substantially parallel to the axial direction of the beam. The internal corners of the rectangular opening 275 may be radiused.

Extending away from the far end of the peripheral walls formed about opening 275A may be a secondary beam 255A that may be formed substantially the same as beam 255, and the distal end of which may similarly widen to form peripheral walls about an opening 275B that may be constructed the same as opening 275A. The connection of the beam 255A with the peripheral walls about opening 275A may include a first notch 255N1 on a first side of the beam and a second notch 255N1 on a second side of the beam, to produce an area that may be weakened. The weakened area may be used to sever the secondary beam 255A from the peripheral walls associated with beam 255, where it is necessary to use the first opening 275A for receiving the post 76 of the lever arm 70 of the sash lock 100, with respect to mounting upon a meeting mail of a window of a particular size. A third beam 255B with peripheral walls about an opening 275C may be similarly formed. An additional pair of notches (255BN1 and 255BN2) may be formed in its central region, to permit severing of the most distal portion of the beam, being just beyond the cylindrical protrusion 255P2.

Biasing of the slidable latch member 250 relative to the housing 210 may be through the use of a suitably arranged tension spring, or by using a compression spring. To simplify the presentation, the figures herein only depict an embodiment where a compression spring is utilized.

Figure 84:
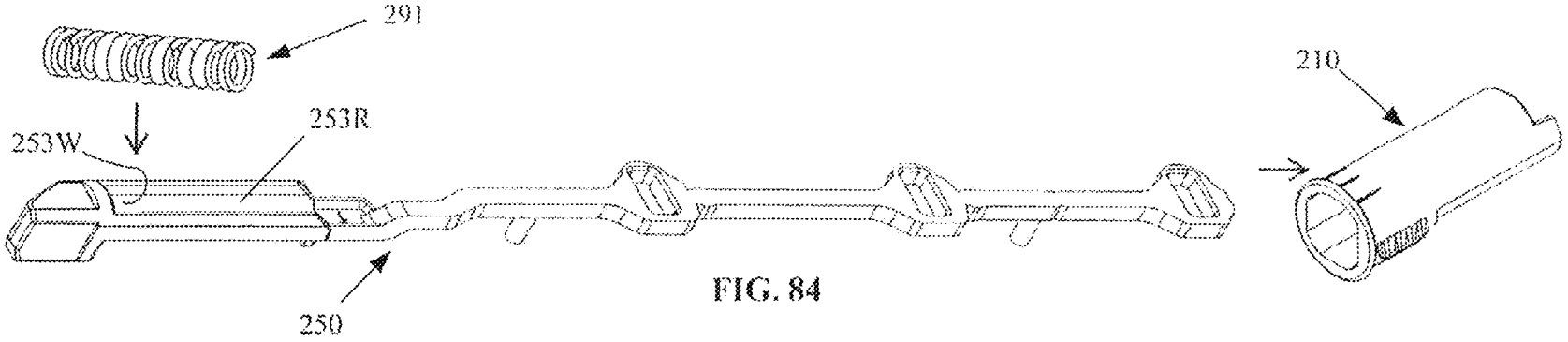
FIG. 84 is an exploded view showing the latch member of FIG. 77, the latch housing of FIG. 68, and a helical spring used for biasing the latch member with respect to the housing, in the latch assembly of FIG. 1.
Figure 85:
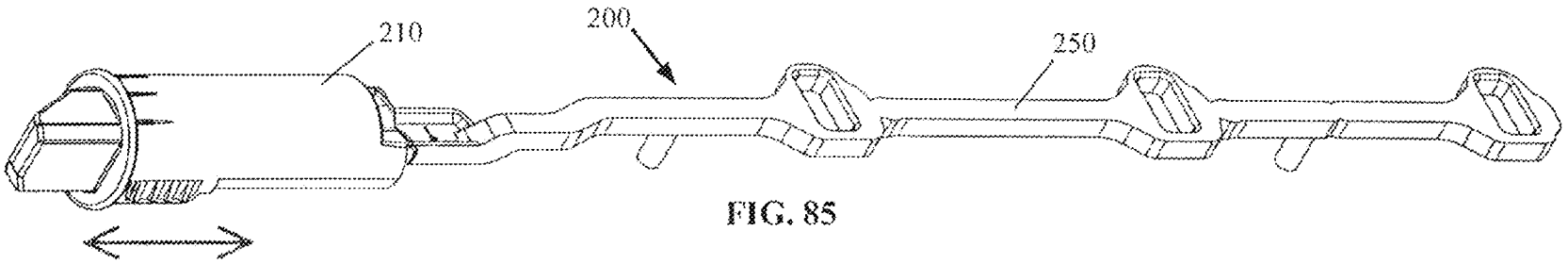
FIG. 85 is the perspective view of FIG. 84, but showing the latch member, the helical spring, and the latch housing after being assembled together, with the latch member biased into its extended position.
Figure 86:
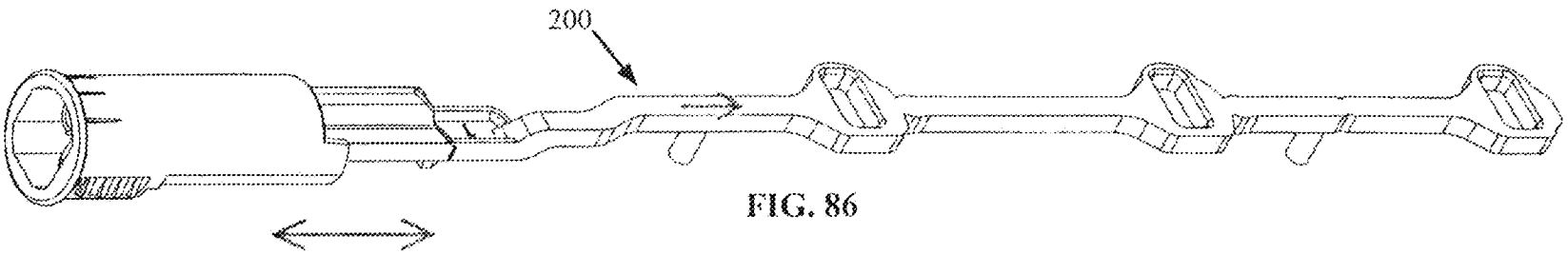
FIG. 86 is the perspective view of FIG. 85, but showing the latch member in a fully retracted position.
Figure 87:
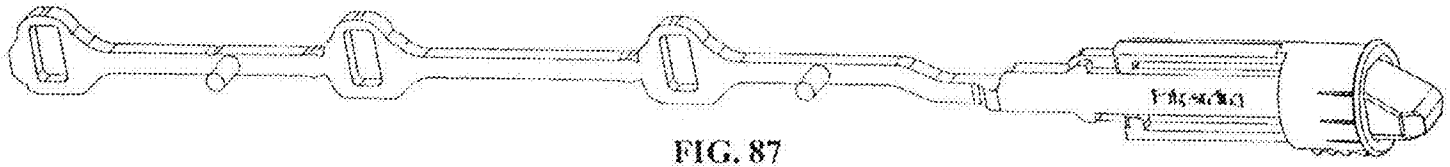
FIG. 87 is a reverse perspective view of the latch assembly shown in FIG. 85.
Figure 88:
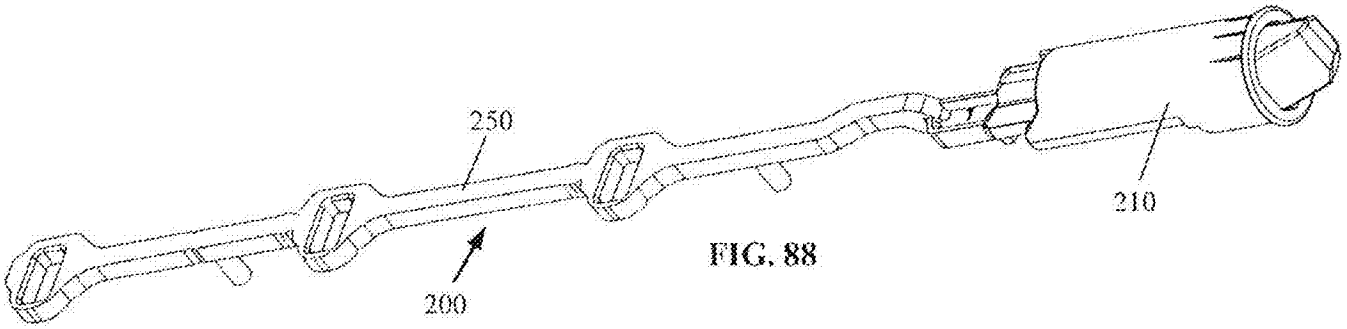
FIG. 88 is another perspective view of the latch assembly shown in FIG. 85.
Figure 90:
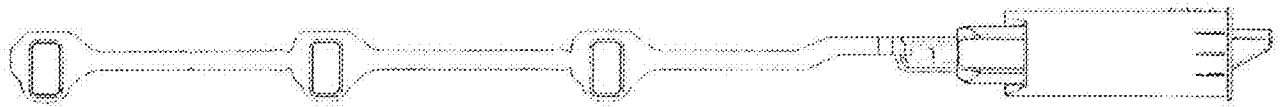
FIG. 90 is a top view of the latch assembly shown in FIG. 85.
Figure 89:
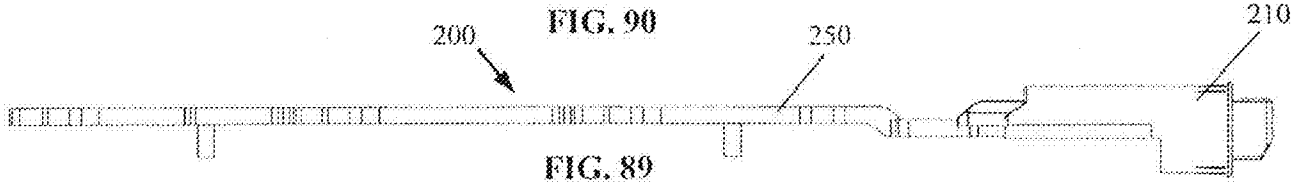
FIG. 89 is a side view of the latch assembly shown in FIG. 85.
Figure 92:
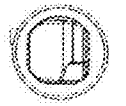
FIG. 92 is a first end view of the latch assembly shown in FIG. 85.
Figure 91:
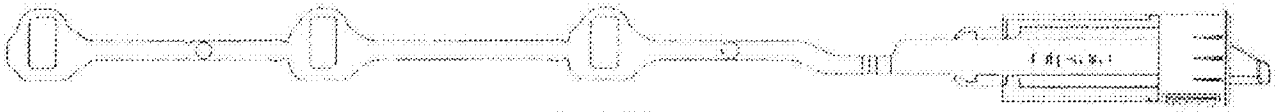
FIG. 91 is a bottom view of the latch assembly shown in FIG. 85.
Figure 93:
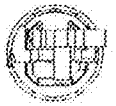
FIG. 93 is a second end view of the latch assembly shown in FIG. 85.
Figure 95:
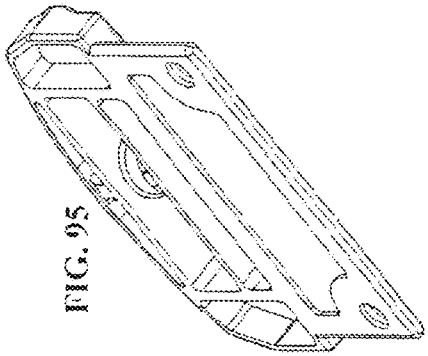
FIG. 95 is a second perspective view of the keeper shown in FIG. 94.
Figure 96:
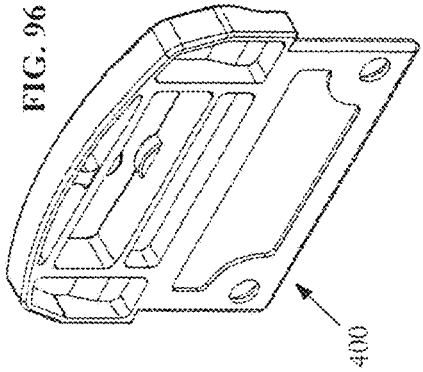
FIG. 96 is a third perspective view of the keeper shown in FIG. 94.
Figure 94:
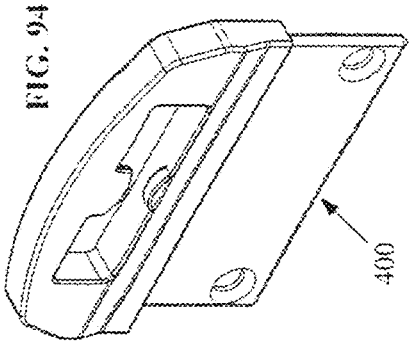
FIG. 94 is a perspective view of a keeper that may be mounted on a master window frame in which the sash window slides (or a second sash window), to be useable for securing the cam of the lock assembly of FIG. 1 to lock the sliding sash window(s).
Figure 98:
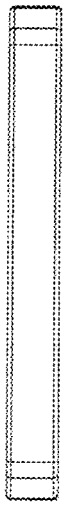
FIG. 98 is a top view of the keeper shown in FIG. 94.
Figure 97:
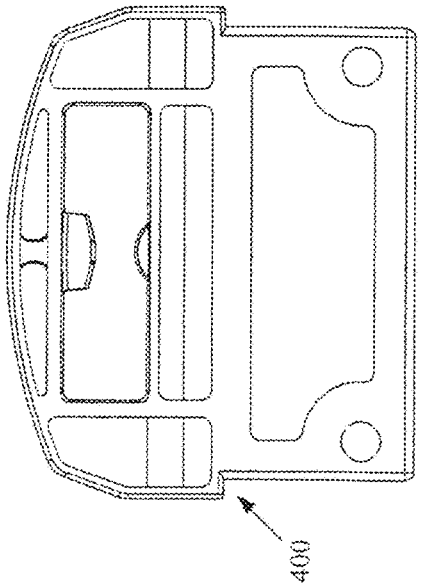
FIG. 97 is a front view of the keeper shown in FIG. 94.
Figure 101:
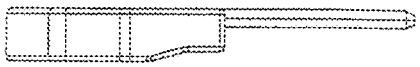
FIG. 101 a second end view of the keeper shown in FIG. 94.
Figure 100:
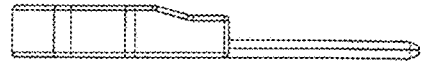
FIG. 100 is a first end view of the keeper shown in FIG. 94.
Figure 99:
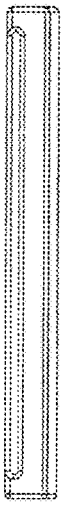
FIG. 99 is a bottom view of the keeper shown in FIG. 94.
Figure 102:
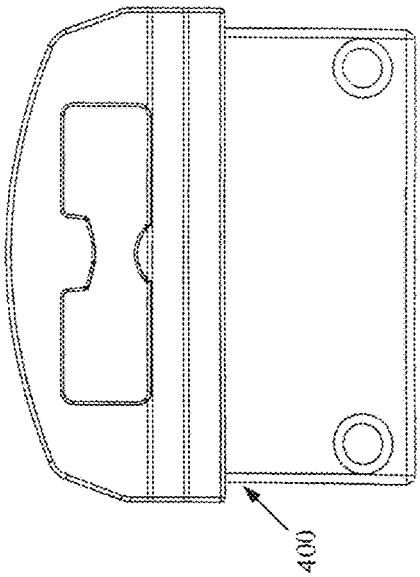
FIG. 102 is a rear view of the keeper shown in FIG. 94.
Figure 110:
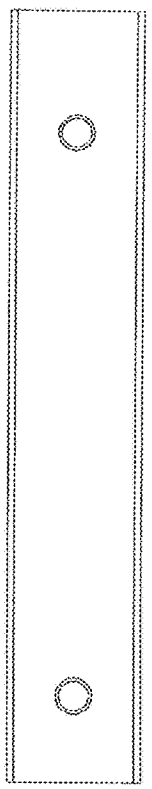
FIG. 110 is a rear view of the stepped stop of FIG. 103.
Figure 109:
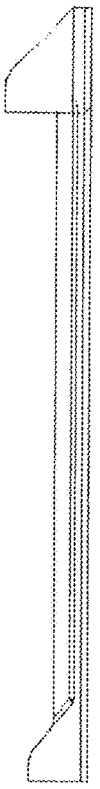
FIG. 109 is a second side view of the stepped stop of FIG. 103.
Figure 107:
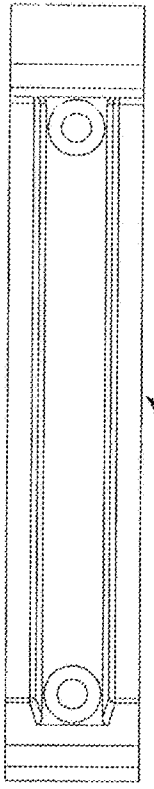
FIG. 107 is a front view of the stepped stop of FIG. 103.
Figure 108:
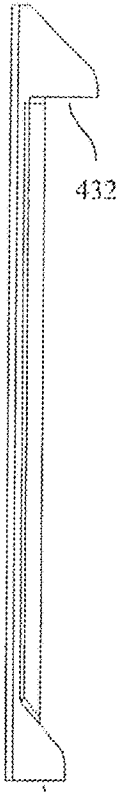
FIG. 108 is a first side view of the stepped stop of FIG. 103.
Figure 111:
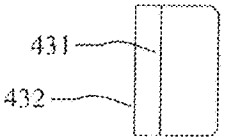
FIG. 111 is an end view of the stepped stop of FIG. 103.
Figure 104:
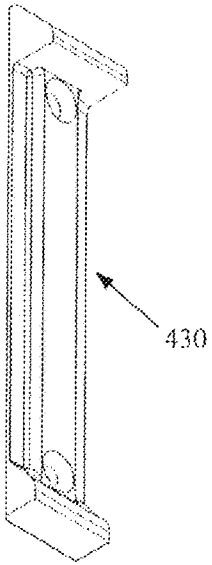
FIG. 104 is a second perspective view of the stepped stop of FIG. 103.
Figure 106:
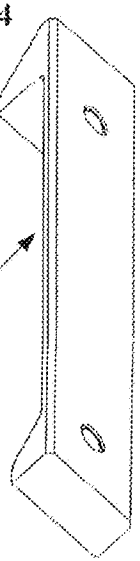
FIG. 106 is a fourth perspective view of the stepped stop of FIG. 103.
Figure 103:
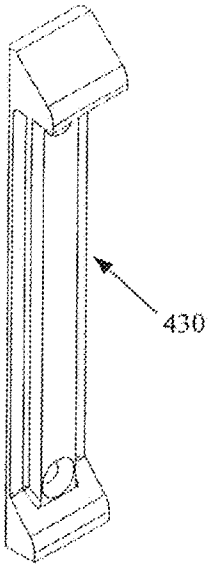
FIG. 103 is a first perspective view of the stepped stop used in conjunction with the latch assembly, as seen in FIG. 1.
Figure 105:
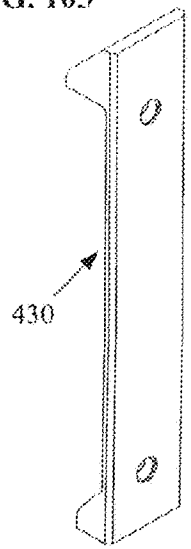
FIG. 105 is a third perspective view of the stepped stop of FIG. 103.
Figure 112:
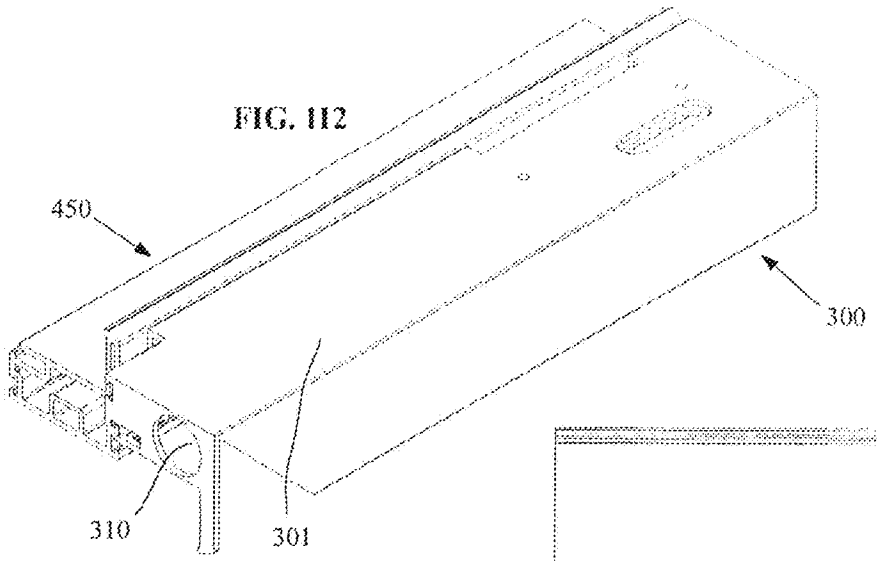
FIG. 112 is a perspective view of a meeting rail of a sash window frame engaged with a master window frame (or a second sash window frame) in the window closed position, and showing a cutout on the top of the meeting rail to receive the lever arm of the sash lock assembly, a pair of holes on the top of the meeting rail to receive a pairs of screws for mounting of the sash lock assembly thereto, and an opening in the side of the window frame to receive a latch assembly therein.
Figure 115:
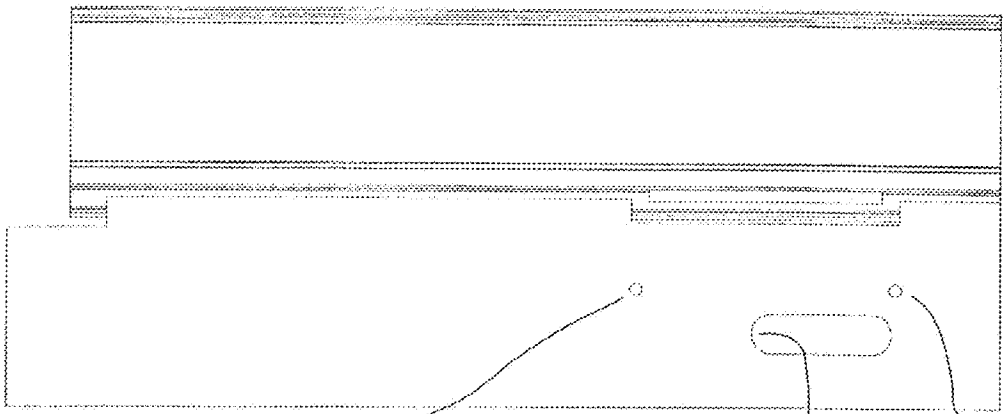
FIG. 115 is a top view of the sash window frame engaged with the master window frame, as seen in FIG. 112.
Figure 113:
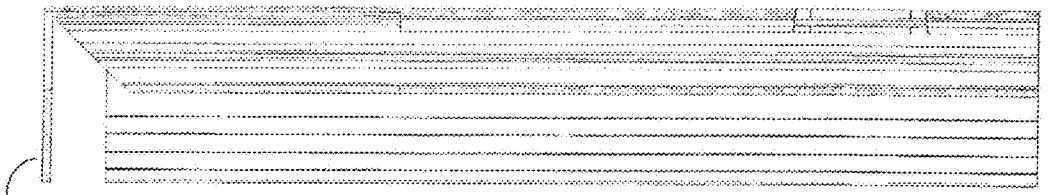
FIG. 113 is a front view of the sash window frame engaged with the master window frame, as seen in FIG. 112.
Figure 114:
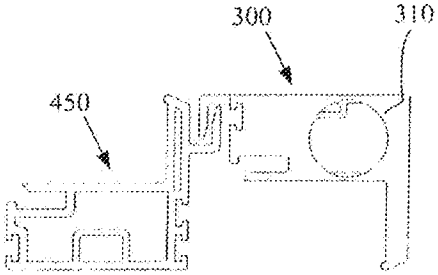
FIG. 114 is an end view of the sash window frame engaged with the master window frame, as seen in FIG. 112.

Assembly of the helical compression spring 291 and the latch member 250 into the housing 210 is illustrated initially in FIG. 84. The helical spring 291 may be nested in a recess 253R proximate to the tongue 253. One end of the spring may act upon the wall 253W of the tongue 253, while the other end of the compression spring may act upon the wall 218 of the housing 210 (FIG. 73), to bias a portion of the tongue, including its apex, to protrude out from the latch housing, as seen in FIG. 85. The extent that biasing by spring 291 may cause the tongue 253 to protrude out from the housing 210 may be limited by the stops 266A and 266B on the tongue (FIG. 81) contacting the stops 216A and 216B on the housing (FIG. 70). Actuation of the latch member 250 relative to the housing 210 may cause the apex of the tongue to retract within the hollow of the housing, as seen in FIG. 86.

Figure 116:
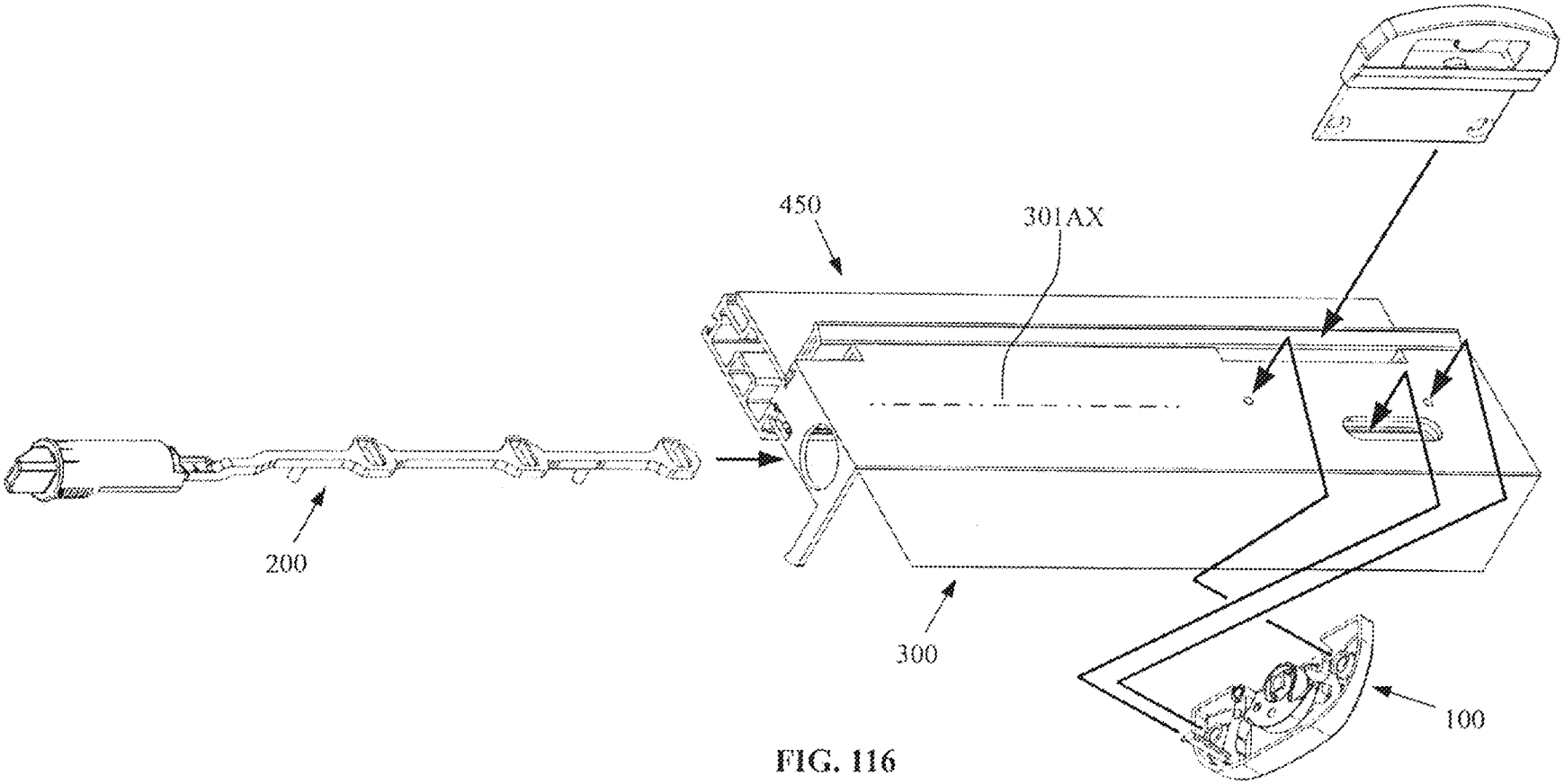
FIG. 116 is an exploded view showing the sash window frame engaged with the master window frame, as seen in FIG. 112, and also showing the latch assembly of FIG. 85, the sash lock assembly of FIG. 53, and the keeper of FIG. 94, prior to respective installation with respect to the sash window frame and the master window frame.
Figure 118:
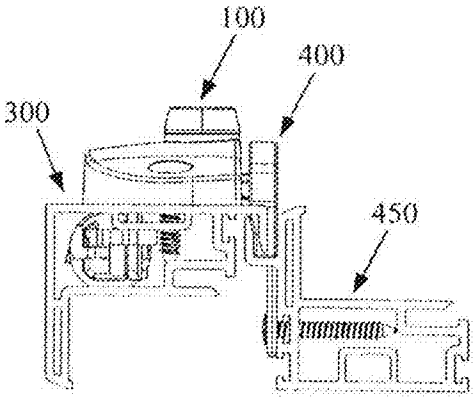

A suitable keeper 400 is shown in FIGS. 94-102, the installation of which, upon the master window frame 450, is shown in FIG. 116 and FIG. 118. A suitable stepped stop member 430, for use in combination with the latch assembly 200 disclosed herein, is defined in FIGS. 103-111, and may include a first step 431, and a second step 432. (Note that two separate stop members may be used and be separately mounted to the master window frame instead of the two-stepped stop member 430).

To accommodate installation of the latch assembly 200, the sash window frame 300, as illustrated in FIGS. 112-115, may have an opening 310 on one side of the frame. The sliding sash window 300 may have a horizontal meeting rail 301, a first vertical stile 302A extending downward therefrom, and a second stile (not shown) and a bottom rail (not shown), which may form a framed enclosure to support the glazing therein.

To accommodate installation of the sash lock assembly 100, the top of the meeting rail 301 may have an elongated opening 312 formed therein, adjacent to which may be a first hole 313A, and a second opening 313B. The elongated opening 312 may be shaped and positioned to suitably provide clearance for the post 76 of the lever arm 70, and for its movement between the extended locking position (FIG. 60) and the third retracted unlock position (FIG. 63).

Figure 117:
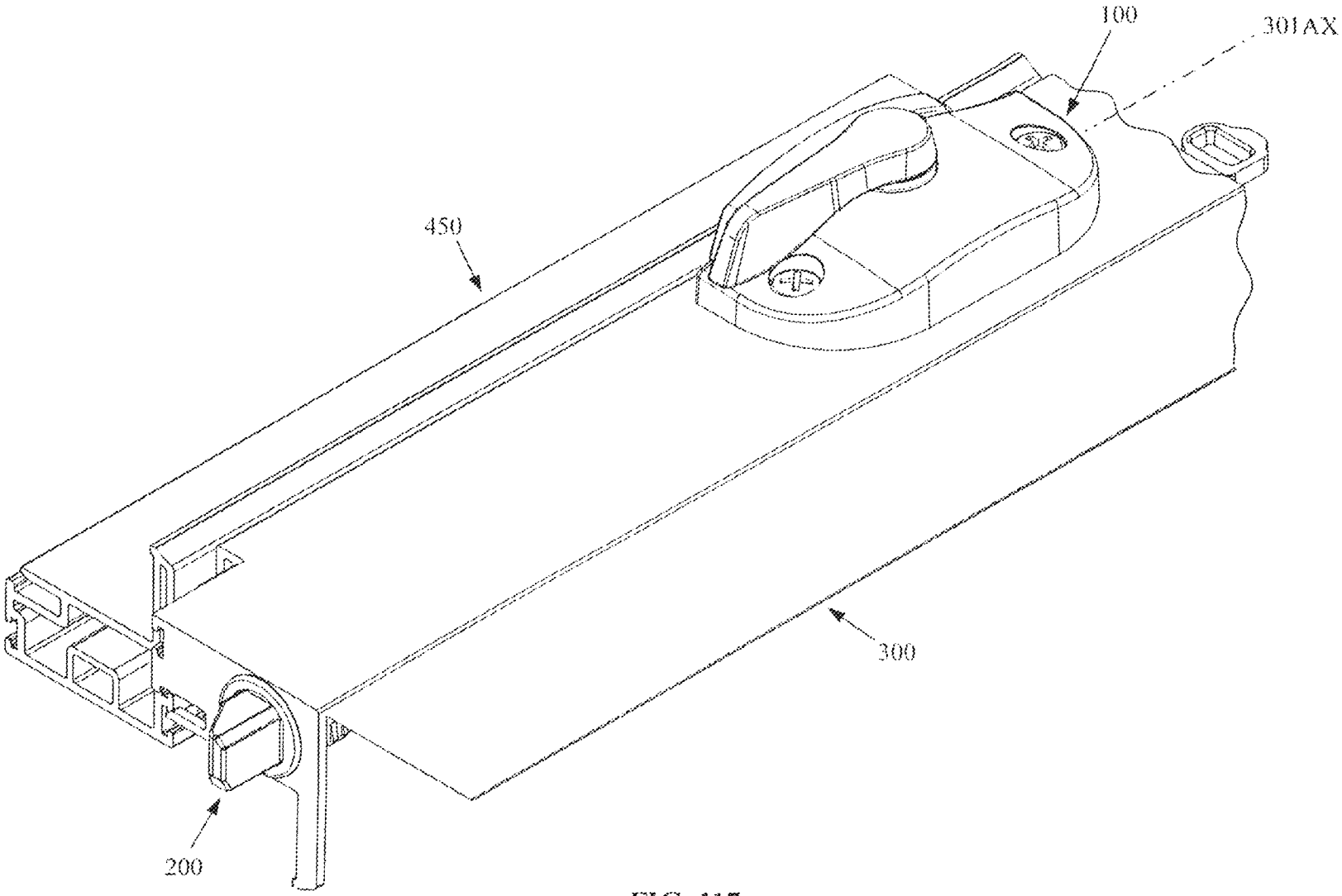
FIG. 117 shows the perspective view of the meeting rail of the sash window frame engaged with the master window frame, as seen in FIG. 116, but after installation of the tilt latch and the sash lock with respect to the sash window frame, and after installation of the keeper upon the master window frame.
Figure 119:
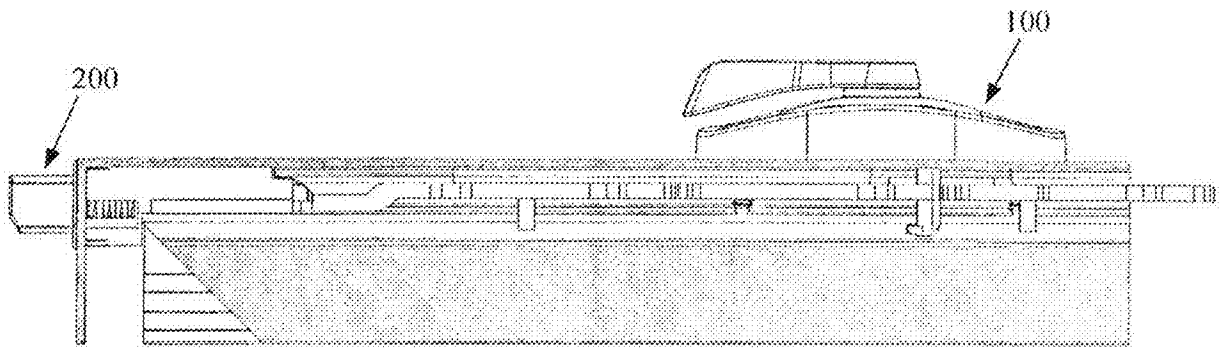

The initial installation of the latch assembly 200 is shown in FIG. 116. The end of the latch assembly 200 may be received through the opening 310 in the window frame 300, to be as seen in FIGS. 117-119.

One or more of the beams (255, 255A, and 255B) of the latch member may be formed to include a vertical protrusion. For example, beams 255 and 255B of the latch member 250A are formed to each include a respective vertical protrusion 255P1/255P2 that may protrude down from the bottom surface of the beam. The protrusions 255P1/255P2, which may be cylindrical, may be formed of a selective length so as to contact the bottom wall of the meeting rail 301A to provide support for the beam to be maintained at a substantially horizontal position, which may be a substantially central position within the hollow meeting rail of the sash window, or may be just a desired height above the bottom wall of the meeting rail. The protrusions 255P1/255P2 may also serve to prevent disengagement of the post 76 of the lever arm 70 from the opening.

The suitable opening (e.g., 275A, 275B, or 275C) on one of the beams (e.g., 255, 255A, or 255B) of the latch assembly 200 may be coordinated with and properly positioned for alignment below the top opening 312 in the meeting rail 301 of the window frame 300 (see FIG. 119). For the window frame 300 shown in FIG. 116, the elongated opening 312 in the meeting rail 301 may be positioned a particular distance away from the end of the window frame, which may accommodate alignment with opening 275B of the latch assembly 200 shown therein. In this case, the beam 255B could be removed using the notches 255BN1 and 255BN2, leaving the protrusion 266P2 to support the end of the latch member. For a larger window, the elongated opening in the top of the meeting rail may be more appropriately positioned to be a greater distance away from the end of the window frame, and may thus be positioned for alignment with opening 275C of the latch assembly 200. Similarly, for a smaller window, the elongated opening in the top of the meeting rail may be positioned a smaller distance away from the end of the window frame, and may be positioned for alignment with opening 275A of the latch assembly 200. In the latter example, the connection of the beam 255A with the peripheral walls formed about opening 275A may be severed using notches 255N1 and 255N2.

The initial installation of the sash lock assembly 100 upon the sash window frame 300 is also illustrated in the exploded view of FIG. 116. The post 76 of the lever arm 70 of the sash lock assembly 100 may be received through the opening 312 in the top of the meeting rail 301. However, because of the elongated cross-sectional shape of the post 76 (see FIG. 38), and because of the protrusion 77 protruding laterally therefrom, for the post to be also be received through the elongated opening 275B of the latch member 250 of the latch assembly 200, the lock assembly should be positioned substantially transverse to the axial direction 301AX of the meeting rail 301A. Such initial positioning may orient the long transverse direction of the post 76 and the protrusion 77 of lever arm 70 to be perpendicular to the axial direction 301AX of the meeting rail 301A, so that it may be generally in-line with the length wise side 275L of the rectangular opening 275A in the latch member 250.

After insertion of the post 76 through the opening 312 in the top of the meeting rail 301 and into the rectangular opening 275B of the latch bean, the sash lock, assembly 100 may then be rotated roughly 90 degrees, and then may be lowered for the bottom surface 11 of the sash housing to contact and be flush with the top of the meeting rail, and be fastened to the holes 313A and 313*b* therein, using fasteners through the hollow cylindrical protrusions 15 and 16 of the housing 10. The 90 degree rotation of the sash lock assembly 100 just prior to its mounting of the sash lock to the meeting rail may orient the long transverse direction of the post 76 of lever arm 70 to be parallel to the axial direction 301AX of the meeting rail 301A, so that it may be generally in-line with the shorter width 275W of the rectangular opening 275A in the latch member 250.

The width 275W of the rectangular opening 275A in the latch member 250 may be just slightly larger than the long transverse direction of the post 76 of the lever arm 70 positioned therein, so that movement of the post actuates the latch member of the latch assembly, to provide the interconnection therebetween. The protrusion 77 may redundantly serve to prevent disconnection of the post 76 of the lever arm from the opening 275B in the latch member (i.e., preventing the latch member from falling off of the post), in conjunction with the protrusions 255P1 and 255P2 that may serve to maintain the latch beam(s) (e.g., 255, 255A, and 255B) at the proper elevation within the meeting rail. For further information regarding this aspect of the installation, if required, a more detailed description and corresponding illustrations are provided within Applicant's co-pending application Ser. No. 14/278,226.

The sash lock assembly 100 and the latch assembly 200 are shown installed with respect to the sliding sash window 300, in FIGS. 117-119, with the sash window slidably installed with respect to the master window frame 450.

Figure 122:
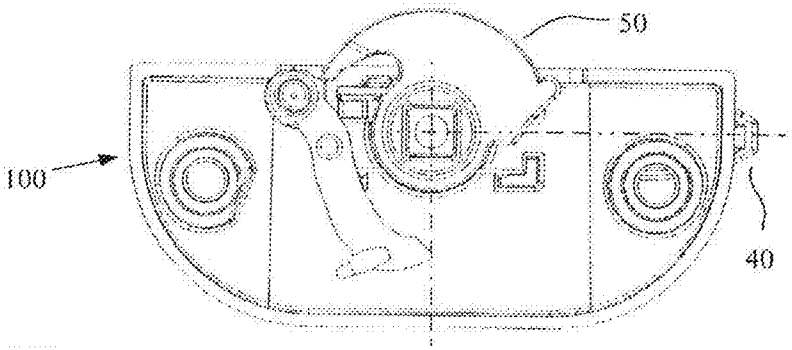
Figure 121:
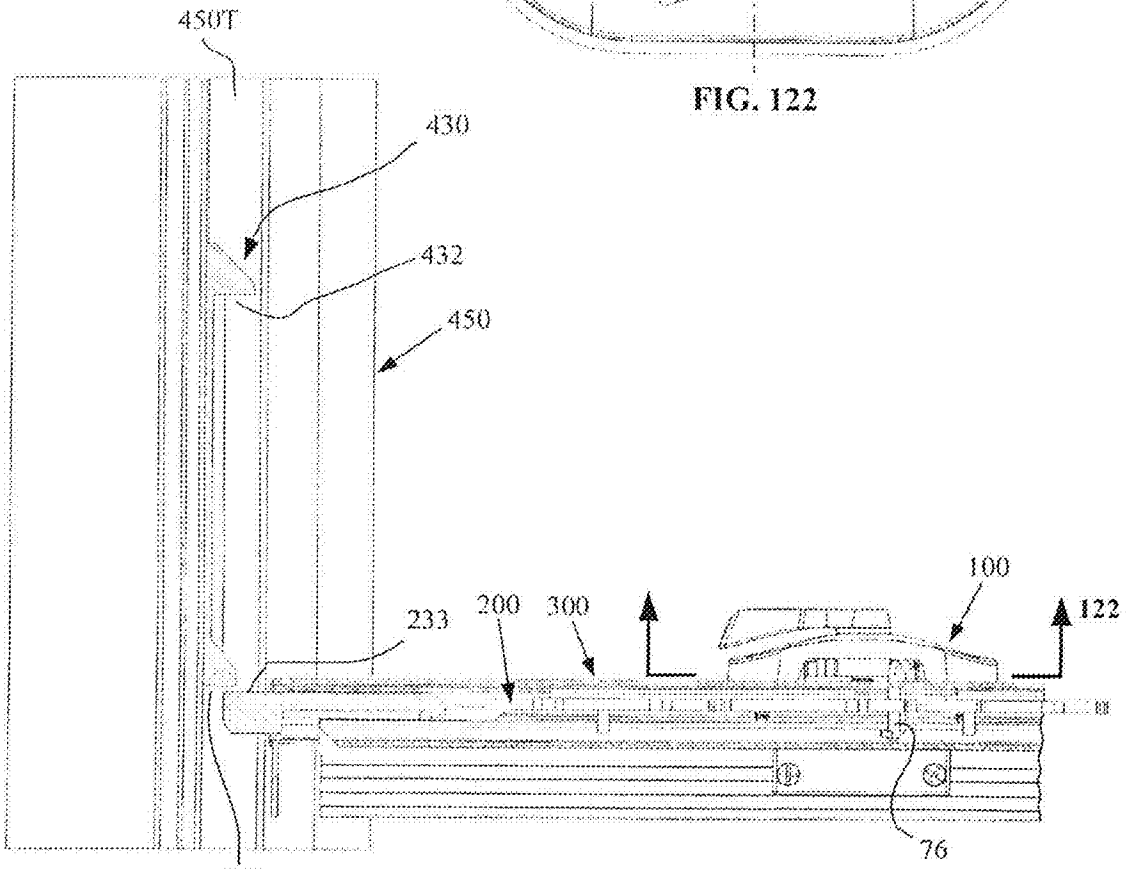
Figure 120:
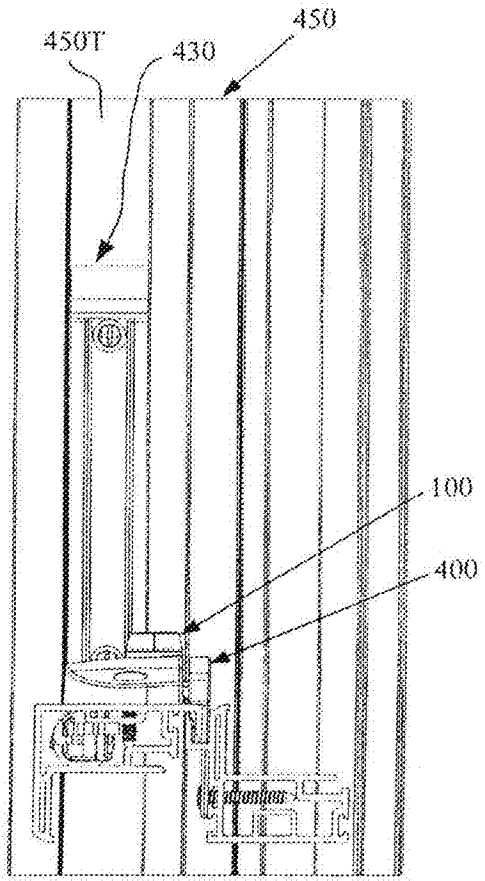
Figure 123:
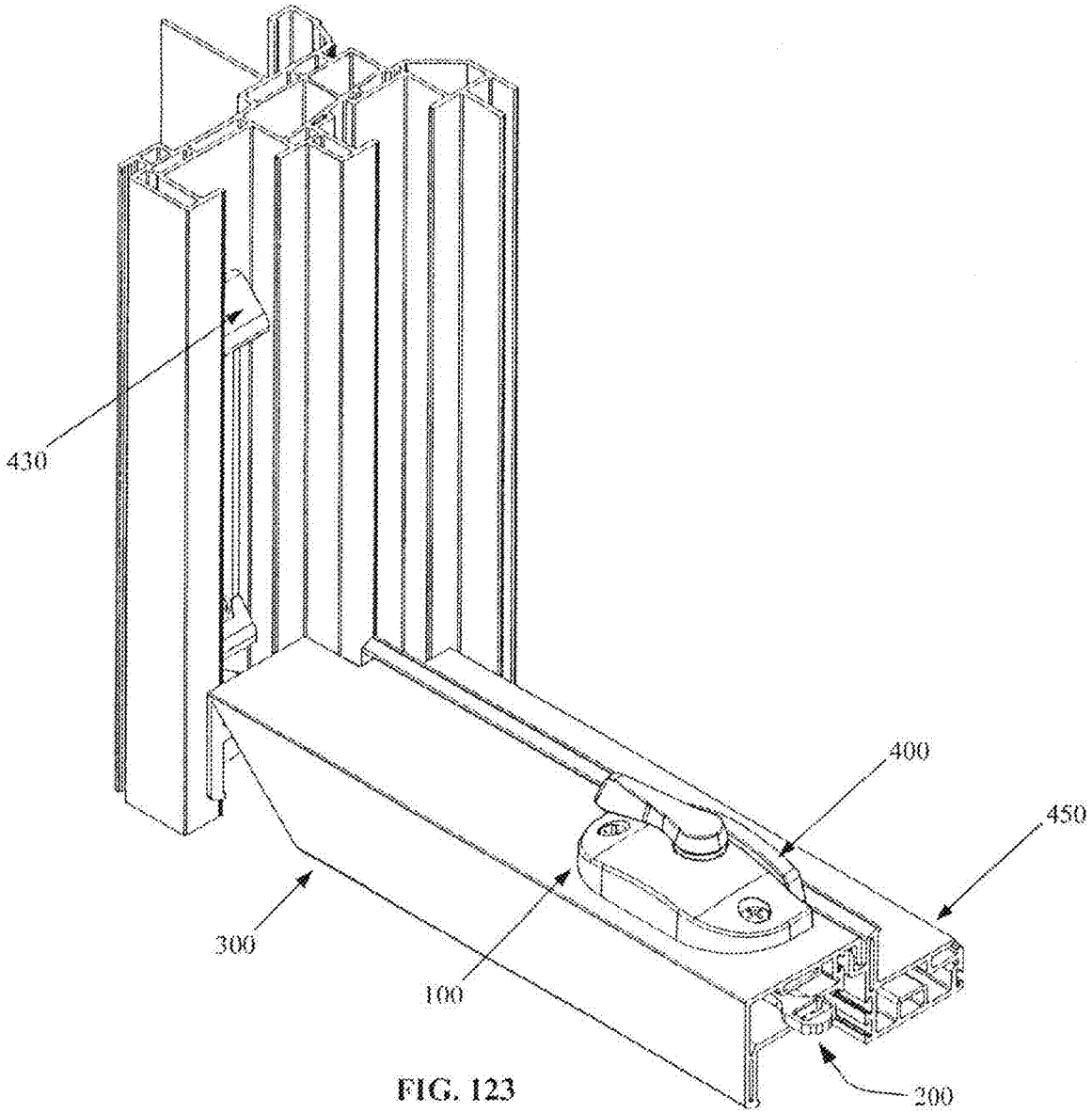

FIGS. 120, 121, and 123 show the stop member 430 installed within a track 450T of the master window frame 450—the track within which the tongue of the latch member 200 moves for the sash window 300 to be slidable with respect to the master window frame. The sash fastener is shown locked and latched, preventing the sash window from either sliding or tilting, as the sash lock 100 is shown with the shaft/handle member 40 and cam 50 in the extended lock position (FIG. 122) where the cam engages the keeper 400 (FIG. 120) to prevent sliding, and where the post 76 of the sash lock does not oppose the spring 291 from biasing the latch member 250 into its corresponding extended position, so that a portion of tongue 253 is disposed within track 450T to prevent tilting. The sash window 300 may be redundantly locked and prevented from sliding, as the first step 431 of the stop 430 may be positioned just above the top of the tongue 253 of the latch member 250, to block any upward movement of the sash window 300 from its closed position.

Figure 126:
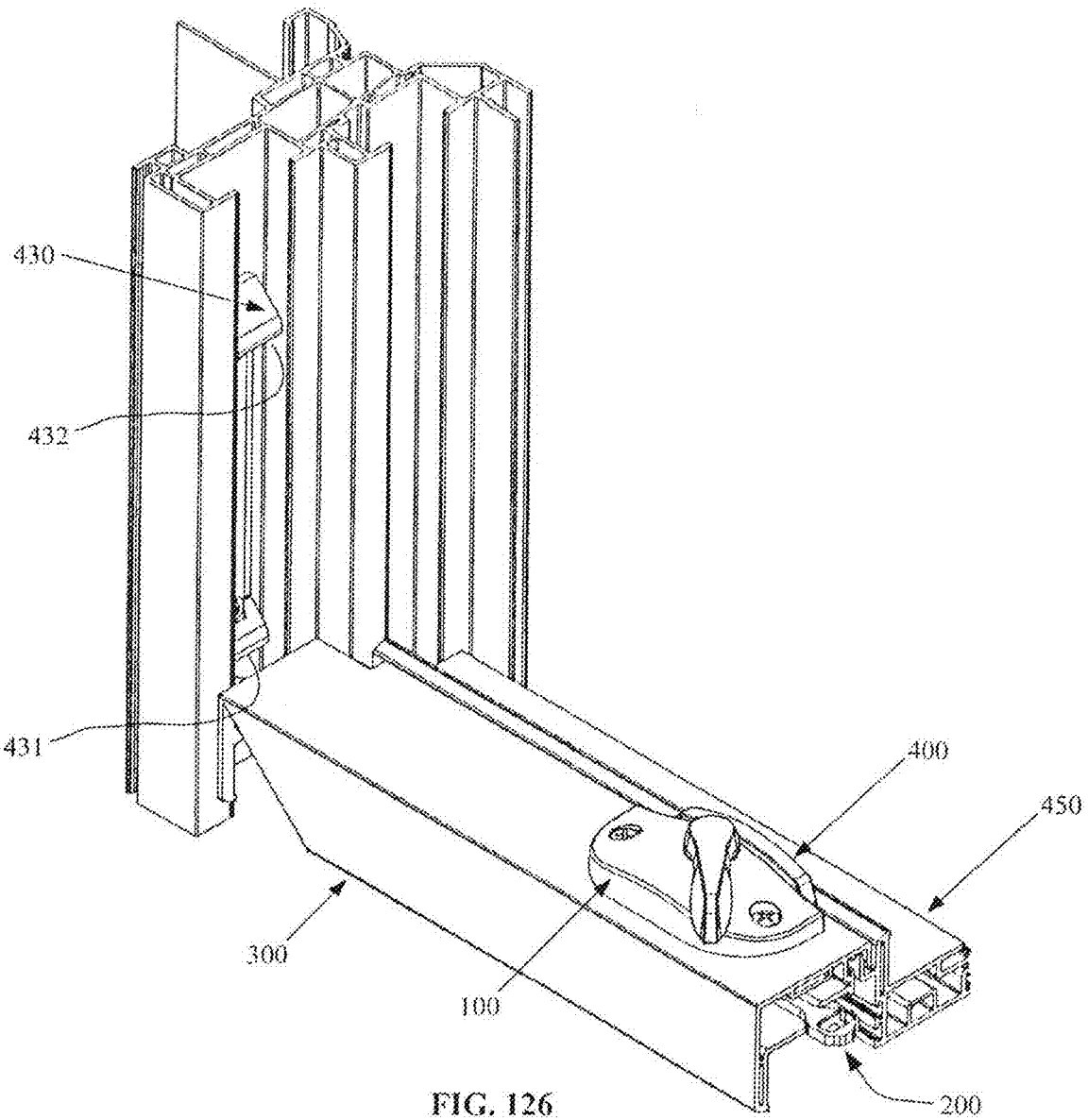
Figure 128:
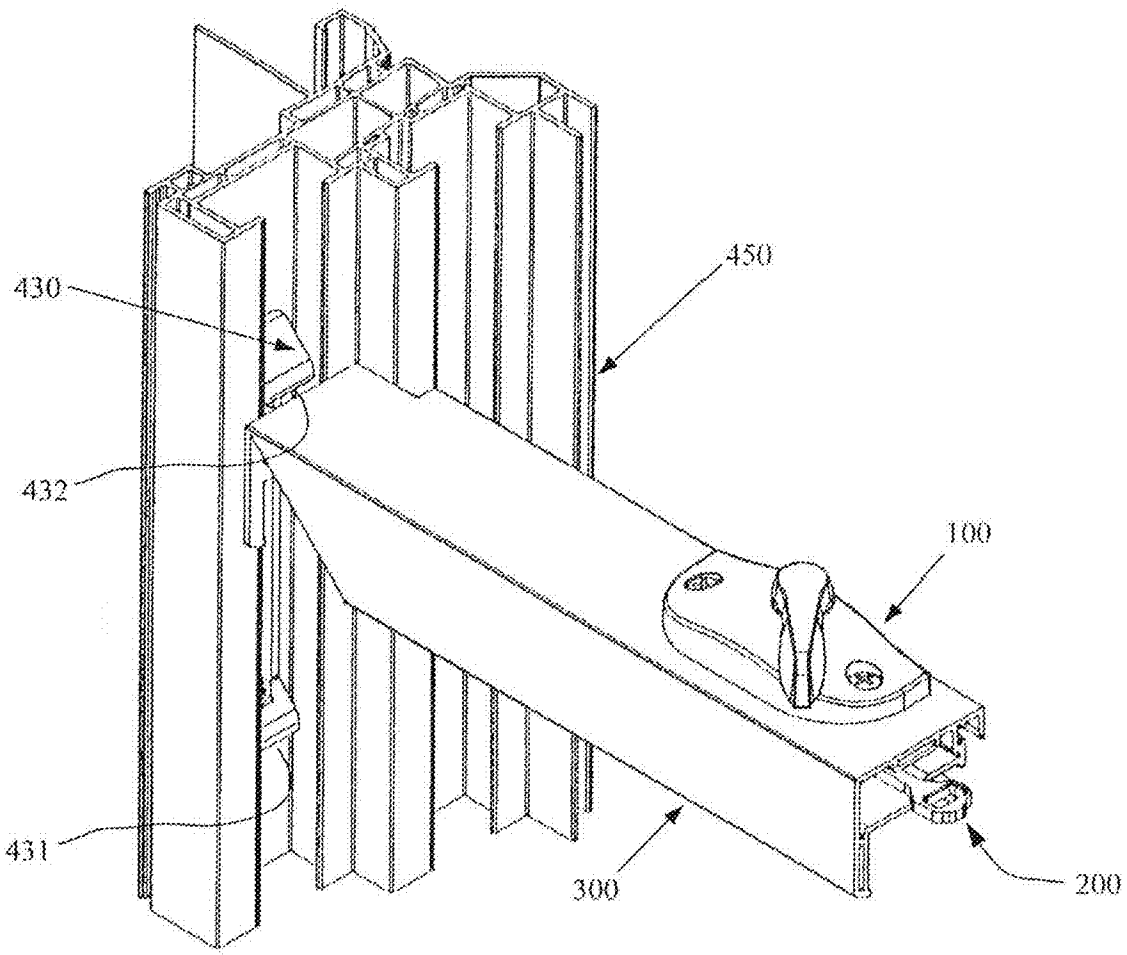

FIGS. 124 and 126 show the sash fastener unlocked and latched, permitting the sash window to slide upwardly from its closed position, but still being prevented from tilting. The shaft/handle member 40 and cam 50 of the sash lock 100 has been rotated 135 degrees to be in the first retracted unlock position (FIG. 125B), where it has disengaged from the keeper 400 to permit sliding, and the lever arm 70 of the sash lock has been driven to rotate by the cam a discrete amount (compare FIG. 125A and FIG. 125B) causing the post 76 to countered biasing of latch member 250 by spring 291 to be moved into its corresponding first retracted position. With the tongue 253 in its first retracted position, a portion thereof is still disposed within track 450T to prevent tilting. However, the sash window 300 is no longer redundantly prevented from sliding upward from its closed position, as the end of the tongue 253 has been moved sufficiently to clear the first step 431 of the stop 430. But the second step 432 of the stop 430 protrudes further into the track than the first step 431, and is positioned above the top of the tongue 253 of the latch member 250 (see arrow 233V), to thereat block upward movement of the sash window 300 beyond the open-limited window position shown in FIGS. 127 and 128. The distance that the second step 432 is positioned above the first step 431 of the stop 430 may be selected to limit upward movement of the window to a position that may be sufficient to provide ventilation, but which may still be small enough to prevent a small child from egressing therefrom. Additional steps may be utilized for the stop 430 to provide for other window open limited positions, or alternatively, separate stop members may be utilized and mounted within the track 450T of the master window frame 450.

FIGS. 129, 130B, and 131B show the sash fastener unlocked and latched, but now permitting the sash window to slide upwardly beyond its open-limited position, and still being prevented from tilting. The shaft/handle member 40 and cam 50 of the sash lock 100 has been rotated an additional 25 degrees (compare FIGS. 130A and 130B) to be in the second retracted unlock position (FIGS. 130B and 131B), where the post 76 of the lever arm 70 of the sash lock, as described hereinabove, has been actuated another discrete amount and has countered biasing of the latch member 250 by spring 291 for the latch member to be moved into its corresponding second retracted position. With the tongue 253 of the latch member 250 in its second retracted position, a portion thereof is still disposed within track 450T to prevent tilting. However, the sash window 300 is no longer prevented from sliding upward beyond its window limited position, as the end of the tongue 253 has been moved sufficiently to also now clear the second step 431 of the stop 430 (see arrow 233V'). However, as noted above, the semi-cylindrical protrusion 56P of the locking cam may contact and rest against the step 75T merely to provide a tactile indication of such positioning, but which may be insufficient to retain the cam at that position, so that once the user releases the force being applied to the shaft/handle member 40, it may be biased back towards the first retracted unlock position (see e.g., FIGS. 127 and 135).

FIGS. 132, 133B, and 134B show the sash fastener unlocked and unlatched, now permitting the sash window to tilt out of the master window frame to permit the outside of the glazing to be easily cleaned. The shaft/handle member 40 and cam 50 of the sash lock 100 has been rotated an additional 20 degrees (compare FIGS. 133A and 133B) to be in the third retracted unlock position (FIGS. 133B and 134B), where the post 76 of the sash lock, as described hereinabove, has been actuated another discrete amount and has countered biasing of the latch member 250 by spring 291 for it to be moved into its corresponding third retracted position. With the tongue 253 in its third retracted position, it is no longer disposed within track 450T to prevent tilting.

Once the outside of the glazing of the window 300 has been cleaned, the window may be pivoted back into the master window frame 450, and the shaft/handle member may be moved back into the second retracted position, where it may be biased back into the first retracted unlock position, or the user may simply move the shaft/handle member 46 to directly place the shaft/handle member 40 and cam 50 in the first retracted unlock position (see e.g., FIGS. 127 and 135), to permit sliding of the window, and to prevent it from inadvertently tilting away from the master window frame.

As seen in FIG. 135, a person may apply a downward force to the sash window 300 shown therein, so that it may be lowered to a position at or below its window limited position, without directly actuating the shaft/handle member 40 of sash lock 100, because the angled bottom surface 253A of the bottom of the tongue 253 may contact the upper surface 432U of the second step 432 of the stop 430, which may be similarly angled.

The contact therebetween may create a horizontal force component FC in the latch member 250, which may oppose the basing of the latch member and the retaining force of the detent mechanism, and may be transmitted to the post 76 of the lever arm 70 by the interconnection with the latch member, which may drive the cam 50 to counter-rotate a small amount. Since the tongue 253 of the latch member 250 only needs to retract a small amount to clear the second step 432 of the stop 430 for the sash window 300 to be lowered, the cam will not be driven to counter-rotate vary far from the first retracted unlock position. Thus, once the tongue 253 is below the second step 432 of the stop 430, the biasing of the latch member 250 by spring 291 may automatically move the cam 50 back into the first retracted unlock position, and similarly move the latch member 250 into its first retracted unlock position (e.g., FIG. 127).

FIG. 137 shows another embodiment of an integrated sash lock/tilt latch fastener, which may include a latch assembly 500 and the sash lock assembly 100, which may be blindly mated to the latch assembly 500 during its installation upon the meeting rail of the sash window. The latch assembly may interact with a stop member 630, which may have a single protrusion, or a double protrusion, as shown in FIG. 137. Where two such sash lock/tilt latch fasteners are used on a sash window (i.e., left-hand side and right-hand fasteners on corresponding left-hand and right-hand portions of the window meeting rail), the arrangement may provide for locking of the sash window at four locations.

The cam 50 and handle 40 combination of the sash lock assembly 100 may occupy several key positions, and certain intermediate positions. FIG. 138A shows the cam/handle combination in the extended lock position (i.e., zero degrees of rotation), at which the cam 50 may engage a keeper on the master window frame to lock the sash window in a closed position. FIG. 138D shows the cam/handle combination in a first retracted unlock position (i.e., 135 degrees of rotation), at which the cam 50 has driven the lever arm 70 and the latch member 550, which is coupled thereto, so that the sash window may then slide within the master window frame, but is prevented from tilting out of the master window frame. FIG. 138E shows the cam/handle combination in a second retracted unlock position (i.e., 180 degrees of rotation), at which the cam 50 has driven the latch member into a retracted position within the latch assembly that may permit the sash window to tilt out of the master window frame. FIG. 138B illustrates an intermediate cam/handle position, at which the cam/handle combination has been rotated roughly 120-123 degrees from the lock position, and the cam 50 just makes contact with the lever arm 70, but has not yet driven it to rotate. (Note that other angular amounts may be utilized in different embodiments). FIG. 138C illustrates another intermediate position, at which the cam/handle combination has been rotated roughly 130 degrees from the lock position, so that an apex on the follower surface of the lever arm 70 rests on a central portion of the protrusion of the cam 50. Once the cam 50 is rotated the small additional amount (e.g., roughly 5 degrees in one embodiment) to reach the first retracted unlock position, as indicated by the corresponding arrow in FIG. 138C, the lever arm 70, which is biased through its coupling to the latch member, may counter-rotate a small amount, as shown by the corresponding arrow. This small amount of counter-rotation of the lever arm 70 permits movement of the latch member into a cocked position, which is discussed hereinafter, particularly with reference to FIGS. 220B-242C.

The housing 510 of the latch assembly 500, shown within FIGS. 139A-145, may be formed similar to housing 210, and may include a contoured track formed within an interior portion of the housing, as shown within FIG. 141 and the enlarged view of FIG. 141A. The track of housing 510 may act as a cam surface, which is discussed further hereinafter.

The latch member 550 is shown within FIGS. 146-151, and may have a flexible follower member formed integrally therewith or secured thereto. In one embodiment, a separate flexible follower member 592 may be formed as a torsion spring, as shown within FIG. 153. In this embodiment the latch member 550 may at least include a post and flange configured to secure the flexible follower member 592 thereto to form a latch sub-assembly (FIG. 154A), which, along with the helical spring 591, may be received within the housing 510 to form the latch assembly 500. When the latch sub-assembly is mated with the latch housing 510 of FIGS. 139A-145, the flexible follower member 592 may be positioned to selectively contact the track (FIG. 164). The latch assembly is thus configured so that the tongue portion of the latch member may occupy an extended position (FIG. 162 and FIG. 173), or a retracted position (FIG. 163), or, when limited by selective contact of the flexible follower member 592 with a particular nest portion of the track, as discussed hereinafter, it may occupy a partially extended position (see e.g., FIG. 178 and FIG. 222B).

Movement (i.e., cycling) of the latch subassembly (i.e., latch member 550 and flexible follower member 592) relative to the latch housing 510 may result in the tip 592T of the flexible follower member circumnavigating the track of the latch housing 510 in a unidirectional manner, as shown within FIGS. 165-165E. The discrete positions of the tip 592T of the flexible follower member 592 are represented in FIG. 165 as a solid black circle. (Note that in another embodiment, the tip could be more simplified than is shown in FIG. 164, and it may not be formed by a turn in the wire-like member, as the wire-like member may alternatively just terminate in a rounded or hemispherical end).

When the latch member 550 is in the fully extended position (e.g., FIG. 173 and FIG. 220B), the tip 592T of the flexible follower member 592 may occupy the position "A" shown within FIG. 165. When the outward spring biasing of the latch member 550 is opposed to place it in a retracted position (e.g., FIG. 163 and FIG. 221B), at which the tongue portion need not be fully retracted within the latch housing 510, the tip 592T of the flexible follower member 592 may occupy the position "B" shown within FIG. 165. Note that for tilting of the sash window, the tongue portion only needs to be clear of the master window frame when the fastener is installed thereon. Therefore, the retracted position of latch member 550 for cycling of the sash lock described hereinafter, may, but need not be, different than the retracted position utilized for tilting of the window. The retracted position for cycling of the sash lock may be slightly less retracted than for tilting, so that tilting may not occur when the user is merely trying to slide the window open, as the tongue may remain engaged within the master window track.

When the opposition to the biasing of the latch member 550 is removed, the latch member is biased outwardly, but is inhibited at a partially extended position (e.g., FIG. 178 and FIG. 222B), because the tip 592T of the flexible follower member 592 may drop down into the nested position "C" shown within FIG. 165 and FIG. 222C. It should be apparent from FIG. 165 that unidirectional travel of the tip is provided by the wall surfaces of the track shown therein, which direct travel of the tip 592T of the flexible follower member 592 to prohibit backward movement. The elevation changes and wall surfaces that provide such unidirectional travel are illustrated schematically within FIGS. 165A-165E.

When the outward spring biasing of the latch member 550 is once again opposed to move it at least slightly back towards its retracted position, the tip 592T of the flexible follower member 592 may exit the nested position and may move to occupy the position "D" shown within FIG. 165 and FIG. 223C. When the opposition to the biasing of the latch member 550 is again removed, the latch member is biased outwardly, and is no longer inhibited from returning to its fully extended position, and tip 592T of the flexible follower member 592 is moved back to the position "A" shown within FIG. 165, and the tip has completed one full loop around the track. Note that for at least Position "B," the extreme distal location, of the tip member be exaggerated within FIG. 165 for the benefit of the reader (compare FIG. 165 with FIG. 221C). Also note that the image of the track shown within FIGS. 220C-242C is rotated 180 degrees from its appearance in FIGS. 165, 176, etc., so that movement of the tip 592T in the image sequences of FIGS. 220C-242C may correspond to movement of the tongue portion of the latch member 550 as shown within FIGS. 220B-242B.

The latch member 550 may redundantly prevent opening/sliding of the sash window from the closed window position (i.e., it may lock the window in a closed position in combination with the cam, or without the cam also being locked), through positioning of its tongue portion relative to (i.e., immediately below) the stepped stop member 630 shown within FIGS. 166-172. The various shaped surfaces for each of the lower protrusion 630L and the upper protrusion 630U of the stop member 630 may also act as a cam surface, with the tongue portion of the latch member being biased into contact therewith to act as a follower, which may cause the tip 592T of the flexible follower member 592 to be cycled through the track to impart specific positioning to the tongue portion of the latch member 550, as the sash window is raised, an/or as it is lowered. The interaction of the tongue portion of the latch member 550 with the various shaped surfaces for each of the lower protrusion 630L and the upper protrusion 630U may result in different positioning of the tip 592T of the flexible follower member 592 upon the track, as discussed in greater detail hereinafter.

When the sash window is closed and the latch member 550 is in the fully extended position (e.g., FIG. 173 and FIG. 220B), the tongue prevents opening/elevating of the sash window because its movement is inhibited by the tongue being positioned immediately below the bottom surface 630Li of the lower protrusion 630L of the stop member 630 (see FIGS. 170 and 171). As shown in FIG. 173 and FIG. 220A, the cam/handle combination may also be in the locked position (i.e., the zero degrees of rotation shown in FIG. 138A), for the cam 50 to engage the keeper installed on the master window frame, and thus the window may be redundantly locked (i.e., it may be locked at two places—cam to keeper, and latch tongue to stop member). Where two integrated sash lock/tilt latch fastener of the present invention are used on one window, the window may be locked at four places, which locking positions may be equally spaced with respect to the meeting rail, through use of the appropriate length for the latch member.

When the user desires to open the sliding sash window, the cam/handle combination may be rotated away from the locked position shown in FIG. 220A. As described above, when the cam 50 reaches roughly 120-123 degrees of rotation, as shown in FIG. 138B, the cam 50 may initially contact the lever arm 70. As the cam 50 undergoes further rotation, it may drive the lever arm 70 to also rotate with respect to its pivotal mounting to the sash lock housing 10. When the cam/handle combination has been rotated roughly 130 degrees, as shown in FIG. 138C and FIG. 221A, an apex on the follower surface of the lever arm 70 may rest on a portion (e.g., a central portion) of the protrusion of the cam 50. In moving the cam/handle combination from the 120-123 degree rotation position to the 130 degree rotation position, the tongue portion of the biased latch member 550, which is interconnected with the lever arm 70 (see FIG.

137A), is driven to overcome its biasing and moves a small amount, moving from the extended position of FIG. 220B into the retracted position of FIG. 221B. The tip 592T of the flexible follower member 592 has correspondingly moved from the position shown within FIG. 220C to the position shown in FIG. 221C.

Once the cam 50 is rotated the small additional amount (e.g., 5 degrees) to reach the first retracted unlock position (i.e., the 135 degree rotation position of FIG. 138D), the protrusion of the cam 50 moves past the apex on the lever arm 70, and the lever arm may be temporarily unsupported by the cam, thus the lever arm may be biased to counter-rotate a small amount. This small amount of counter-rotation of the lever arm 70 permits movement of the latch member into a cocked position, as the tip 592T of the flexible follower member 592 may correspondingly move from the position shown within FIG. 221C, to the position shown in FIG. 222C, in which the tip is releasably retained within a nest portion of the track (position "C" in FIG. 165). The tongue portion of the latch member 550 has also moved from the retracted position shown in FIG. 221B, which may nonetheless be sufficient to remain engaged within the track of the master window frame, to the cocked position shown in FIG. 222B. The sash window is then unlocked, and may be opened (e.g., may be elevated).

As the sash window is opened, as indicated by the upwardly pointing arrow in FIG. 222B, the upper surface 550U (FIG. 148) of the tongue portion (which may be curved or just angled), being located adjacent to the correspondingly shaped (curved/angled) surface 630Lii of the lower protrusion of the stop member 630 (FIG. 170), may be driven by contact therewith to retract as it being elevated. This is represented by the angled arrow shown within FIG. 223B, with the tongue portion of the latch member 550 shown therein to have been retracted slightly. This small amount of retraction of the tongue portion of the latch member 550 may be sufficient to cause the tip 592T of the flexible follower member 592 to exit from the nest portion of the track, to move from the position shown in FIG. 222C to the position shown within FIG. 223C. The handle continues to remain in the 135 degree rotation position, as is shown within FIG. 222A and FIG. 223A; however, as seen therein the lever arm has moved away slightly from its contact with the cam 50 (FIG. 222A), to be as shown within FIG. 223A.

Continued opening (e.g., elevating) of the sash window may result in the tongue portion of the latch member 550 being driven to retract to a distal position, as shown in FIG. 224B, which retraction amount may be based on the extent (i.e., height) of the apex of the surface 162Lii. During the continued opening of the sash window, the tip 592T of the flexible follower member 592 may continue its movement away from the nest positioning toward position "D" (FIG. 165), which is shown within FIG. 224C. The handle still remains in the 135 degree rotation position, as shown within FIG. 224A; however, the lever arm is moved even further away from its separated positioning relative to the cam 50 in FIG. 223A, to be as shown within FIG. 224A.

Continued opening of the sash window may result in the tongue portion of the latch member 550 being driven to extend slightly, and then to correspondingly retract slightly, as the tongue portion successively contacts the surfaces 630Liii, 630Liv, and 630Lv of the lower protrusion 630L, which may be seen in comparing FIGS. 224B, 225B, and 226B. During opening of the window, such contact merely causes the tip 592T of the flexible follower member 592 to oscillate on the same portion of the track, first moving away from and then moving hack towards position "D," which may be seen in comparing FIGS. 224C, 225C, and 226C (Note that when the sash window is being closed/lowered, such contact with those surfaces 630Liii, 630Liv, and 630Lv has a different effect upon the tip 592T of the flexible follower member 592, as discussed hereinafter with respect to FIGS. 236A-242C). A similar comparison of FIGS. 224A, 225A, and 226A shows that the handle still remains in the 135 degree rotation position, while the lever arm is correspondingly moved with respect to the latch member 550, to be closer to its contact position with the earn 50 (compare FIG. 224A with FIG. 225A), and then to again be farther away from that, contact position (compare FIG. 225A to FIG. 226A).

As the sash window continues to be opened (e.g., is elevated further), the biased latch member will be start to extend, as shown by the angled arrow in FIG. 226B. Once the sash window is opened sufficiently for the tongue portion of the latch member to be clear of (i.e., be above) the lower protrusion 630L, latch member may return to the fully extended position shown in FIG. 227B. The tip 592T of the flexible follower member 592 is correspondingly moved into position "A" (see FIG. 227C), and has then completed one cycle of movement about the track.

As the latch member moves past the protrusion 630L and is unrestrained, and thus biased back into the fully extended position, the corresponding movement of the lever arm 70 causes it to then contact the cam 50, and drive the cam/handle combination to rotate. The force of the lever arm 70 contacting and driving the cam/handle combination may be sufficient to drive the cam/handle combination out of the 135 degree detent position to be back at the 123 degree position, as shown in FIG. 227A. The window may be opened even further.

In an embodiment where a second protrusion 630U is utilized on the stop member 630, further opening of the sash window will be limited by contact of the top of the fully extended tongue portion of the latch member 550 with the lower stop surface 630Ui of the upper protrusion 630U, as shown in FIG. 228B. The positions of the tip 592T of the flexible follower member 592, the cam 50, handle 40, and lever arm 70 remain unchanged from such movement of the sash window and the latch member 550 from the position in FIG. 227B to the position in FIG. 228B (i.e., FIGS. 228C and 228A are each the same, respectively, as FIGS. 227C and 227A). The second protrusion 630U may thus serve as a vent stop.

If the user desires to open the window further, beyond the limited position shown in FIG. 228B, the user may manually rotate the handle from the 120-123 degree position shown within FIG. 228A, through the 130 degree position of FIG. 229A, to again be back in the 135 degree detent position shown within FIG. 230A. This movement, just as before, will cause the tongue portion of the latch member 550 to again occupy the cocked position of FIG. 230B, with the tip 592T of the flexible follower member 592 being positioned back in the nested portion of the track, as shown in FIG. 230C. Further opening of the sash window may then cause the same positions for the tongue portion of the latch member 550, the lever arm 70, and the tip 592T of the flexible follower member 592, shown within FIGS. 231A-235C, as occurred for sash window and tongue movement relative to the lower protrusion 630L, shown within FIGS. 223A-227C. With the tongue portion of the latch member 550 now positioned beyond (e.g., above) the upper protrusion 630U (FIG. 235B), the sash window may be moved into a fully opened position.

If the user decides to close the sash window, as indicated by the downward pointing arrow within FIG. 236B, a lower curved/angled surface 550L of the tongue portion of the latch member 550 (FIG. 148) will contact a correspondingly curved/angled surface 630Uvi of the upper protrusion 630U (see FIG. 170). Continued downward moment of the sash window will cause the tongue portion of the latch member 550 to again be retracted into the position shown in FIG. 237B, as a result of such contact with the surface 630Uvi. During such downward movement, the tip 592T of the flexible follower member 592 may move from its position in FIG. 236C to be as shown in FIG. 237C. In order for the tip 592T of the flexible follower member 592 to automatically navigate through the nest portion of the track during downward movement of the window, the surfaces 630Uiii, 630Uiv, and 630Uv are provided on the upper protrusion 630U, and the surfaces 630Liii, 630Liv, and 630Lvi are similarly provided on the lower protrusion 630L, which surfaces are not necessary (i.e., functional) in the same manner for opening of the window, as they are during closing of the sash window (i.e., the nest portion is utilized during opening of the window but not during closing of the window).

Once the tongue portion of the latch member 550 begins to contact the surface 630Uvi of the upper protrusion 630U of the stop member 630, it may begin to extend until the tongue portion contacts the surface 630Uiv, as shown in FIG. 238B. During this extension of the tongue portion of the latch member 550, the tip 592T of the flexible follower member 592 may move from its position in FIG. 237C to enter the nest portion of the track, as shown in FIG. 238C. Continued downward movement of the sash window will cause the tongue portion of the latch member 550 to then contact the surface 630Uiii of the upper protrusion 630U (FIG. 239B), which again causes the latch member 550 to begin retracting, and causes the tip 592T of the flexible follower member 592 to exit the nest portion of the track, as shown in FIG. 239C.

Continued downward movement of the sash window causes further retraction of the tongue portion of the latch member 550 until reaching the distal position of the stop member, as shown in FIG. 240B, and the tip 592T of the flexible follower member 592 is correspondingly driven to the position "D" shown in FIG. 240C. With continued downward movement of the sash window, the tongue portion of the latch member 550 will begin to extend, as shown in FIG. 241B, and once the sash window has moved downward far enough, the top of the tongue portion will again be disposed below the bottom stop surface 630Ui of the upper protrusion 630U, which positioning below the protrusion may again permit it to serve as a vent stop. The tip 592T of the flexible follower member 592 has then completed its cycle and has returned to the starting point on the track—position "A"—as shown in FIG. 242C. Note that the cam 50 and handle 40 combination remain at the 120-123 degree position throughout the downward movement of the sash window and the corresponding movements of the tongue portion of the latch member 550, as shown within FIGS. 236B-242B.

The sash window could then be opened beyond the vent stop position the same manner as was previously described hereinabove (i.e., by manually turning the handle back to the 135 degree detent position and be elevating of the window).

Instead, the sash window could then be moved into the closed window position shown within FIGS. 173 and 220B. The movements (retraction/extension) of the tongue portion of the latch member 550, and the cycling of the tip 592T of the flexible follower member 592 would be the same with respect to moving past the lower protrusion 630L, as just described with respect to its movement past the upper protrusion 620U, as shown within FIGS. 236A-242C.

Once the sash window reaches the closed position, the tongue portion of the latch member 550 is again positioned as shown within FIG. 220B, and the sash window is thus automatically locked when it is moved back into the closed position. Additionally, the handle 40 may be counter-rotated from its 120-123 degree position shown in FIG. 242A, to return to the zero degree rotation position of FIGS. 138A and 220A, to again reengage the cam 50 with the keeper, and redundantly lock the sash window.

The examples and descriptions provided merely illustrate preferred embodiments of the present invention. Those skilled in the art and having the benefit of the present disclosure will appreciate that further embodiments may be implemented with various changes within the scope of the present invention. Other modifications, substitutions, omissions and changes may be made in the design, size, materials used or proportions, operating conditions, assembly sequence, or arrangement or positioning of elements and members of the preferred embodiment without departing from the spirit of this invention.

We claim:

1. A window fastener, for use with a sash window configured to at least slide with respect to a master window frame, said window fastener comprising:

a sash lock comprising: a housing; and a cam;

a latch assembly comprising:

a housing comprising a selectively shaped cam surface;

a latch member comprising a tongue, at least a portion of said latch member slidably disposed within said housing of said latch assembly;

a spring configured to bias said latch member into an extended position where at least a portion of said tongue protrudes out from said housing of said latch assembly; and a flexible follower member configured to extend from said latch member, for a tip of said follower member to movably contact said cam surface;

a stop member configured to be mounted to the master window frame, said stop member comprising a protrusion;

wherein when the sash window is in a closed window position and said cam is in a locked position, said latch member is configured to occupy said extended position with a first portion of said tongue engaged within the master window frame, and being positioned adjacent to a first portion of said protrusion to thereat inhibit sliding of the sash window and redundantly lock the sash window;

wherein movement of said cam into an unlocked position causes said latch member to retract from said extended position into a cocked position, and causes movement of said tip of said flexible follower member into selective engagement with a portion of said selectively shaped cam surface to oppose said bias and releasably hold said latch member in said cocked position, to permit sliding of the sash window;

wherein when said latch member is in said cocked position and the sash window is moved away from the closed window position toward a fully open window position, contact of a second portion of said tongue with a second portion of said protrusion causes movement of said latch member to trigger said tip of said flexible follower member to disengage from said portion of said cam surface, for said spring to bias said latch member away from said cocked position toward said extended position within a recess in said protrusion, and further movement of the sash window towards at least a partially open window position allows said tongue to slide along and away from said recess in said protrusion until said tongue is biased into said extended position, allowing the sash window to be moved further toward the fully open position;

wherein said recess in said protrusion is shaped to correspond to at least said portion of said selectively shaped cam surface; and wherein when the sash window is moved toward the closed window position from at least the partially open window position, contact of at least a third portion of said tongue with at least a third portion of said protrusion causes said tongue to retract and to subsequently move past said protrusion by tracking along and past said recess, wherein said tracking along said recess causes said tip of said flexible follower member to traverse through said correspondingly shaped portion of said cam surface and automatically disengage from said portion of said track upon reaching said portion of said track, and when the sash window reaches the closed window position, said tongue is biased into said extended position, and thereat being adjacent to said first portion of said protrusion, said latch member automatically relocks the sash window without said cam being moved into said locked position.

2. The window fastener according to claim 1, further comprising: a second said protrusion being positioned on said stop member a distance away from said first protrusion to inhibit sliding of the sash window beyond a partially open window position, until said earn is actuated to place said tongue of said latch member in said cocked position, and the window is moved beyond said partially open window position towards the fully open window position.

3. The window fastener according to claim 1, wherein when said cam is further retracted and moved into a second retracted unlock position, said tongue is retracted beyond said cocked position and disengages from the master window frame.

* * * * *